US012065901B1

(12) United States Patent
Brown et al.

(10) Patent No.: US 12,065,901 B1
(45) Date of Patent: Aug. 20, 2024

(54) EXPANDING AND COLLAPSING APPARATUS HAVING BOOKEND SEAL CARTRIDGES

(71) Applicant: Schlumberger Technology Corporation, Sugar Land, TX (US)

(72) Inventors: Gareth Brown, Aberdeen (GB); Oliver Fry, Aberdeen (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/696,220

(22) PCT Filed: Oct. 18, 2021

(86) PCT No.: PCT/US2021/055439
§ 371 (c)(1),
(2) Date: Mar. 27, 2024

(87) PCT Pub. No.: WO2023/069069
PCT Pub. Date: Apr. 27, 2023

(51) Int. Cl.
*E21B 33/129* (2006.01)
*E21B 23/01* (2006.01)
*E21B 33/12* (2006.01)

(52) U.S. Cl.
CPC ..... *E21B 33/1291* (2013.01); *E21B 23/01* (2013.01); *E21B 33/12* (2013.01); *E21B 33/129* (2013.01)

(58) Field of Classification Search
CPC .... E21B 33/129; E21B 33/1291; E21B 33/12; E21B 23/01
See application file for complete search history.

(56) References Cited

U.S. PATENT DOCUMENTS

| | | | | |
|---|---|---|---|---|
| 3,572,627 | A | 3/1971 | Jones | |
| 3,915,424 | A | 10/1975 | Lerouax | |
| 7,290,603 | B2 | 11/2007 | Hiorth | |
| 7,921,921 | B2 | 4/2011 | Bishop | |
| 8,167,033 | B2 * | 5/2012 | White | E21B 33/128 166/134 |
| 10,801,284 | B2 | 10/2020 | Brown | |

(Continued)

FOREIGN PATENT DOCUMENTS

| | | | |
|---|---|---|---|
| EP | 0794316 | A2 | 9/1997 |
| WO | 2017109506 | A2 | 6/2017 |

(Continued)

OTHER PUBLICATIONS

Search Report and Written Opinion of International Patent Application No. PCT/US2021/055439 dated Jul. 11, 2022, 10 pages.

*Primary Examiner* — Yong-Suk (Philip) Ro
(74) *Attorney, Agent, or Firm* — Jeffrey D. Frantz

(57) ABSTRACT

Systems and methods presented herein include expanding and collapsing apparatus that include a slips cartridge that is bookended by seal elements. The pressure (e.g., whether from uphole and/or from downhole of the downhole tool) pushes at axial points at which the seal elements abut the slips cartridge. In addition, all of the load is transferred to the wellbore casing, and not to an inner mandrel at all. Specifically, the inner mandrel only experiences the setting force in tension. In addition, the elastomer that is being used is not stretched during expansion, but simply moved as it is expanded.

20 Claims, 53 Drawing Sheets

(56) References Cited

U.S. PATENT DOCUMENTS

| | | | | |
|---|---|---|---|---|
| 10,822,882 | B2 | 11/2020 | Brown | |
| 11,078,746 | B2 | 8/2021 | Brown | |
| 11,168,536 | B2 | 11/2021 | Brown | |
| 11,885,196 | B1 * | 1/2024 | Nettles | E21B 33/1291 |
| 11,965,391 | B2 * | 4/2024 | Tonti | E21B 33/1293 |
| 2003/0226668 | A1 * | 12/2003 | Zimmerman | E21B 33/1204 166/134 |
| 2010/0071908 | A1 | 3/2010 | Bishop | |
| 2013/0319654 | A1 | 12/2013 | Hiorth | |
| 2018/0363410 | A1 * | 12/2018 | Dey | E21B 33/134 |
| 2019/0352988 | A1 | 11/2019 | Brown | |
| 2019/0352997 | A1 | 11/2019 | Brown | |
| 2020/0277837 | A1 * | 9/2020 | Hern | E21B 23/0417 |
| 2021/0131219 | A1 | 5/2021 | Brown | |
| 2022/0136349 | A1 * | 5/2022 | Mitchell | E21B 33/1293 166/382 |
| 2022/0136358 | A1 * | 5/2022 | Mitchell | E21B 33/1216 166/387 |
| 2022/0195830 | A1 * | 6/2022 | Chen | E21B 33/128 |

FOREIGN PATENT DOCUMENTS

| | | | |
|---|---|---|---|
| WO | 2018094184 | A1 | 5/2018 |
| WO | 2019002882 | A1 | 1/2019 |

* cited by examiner

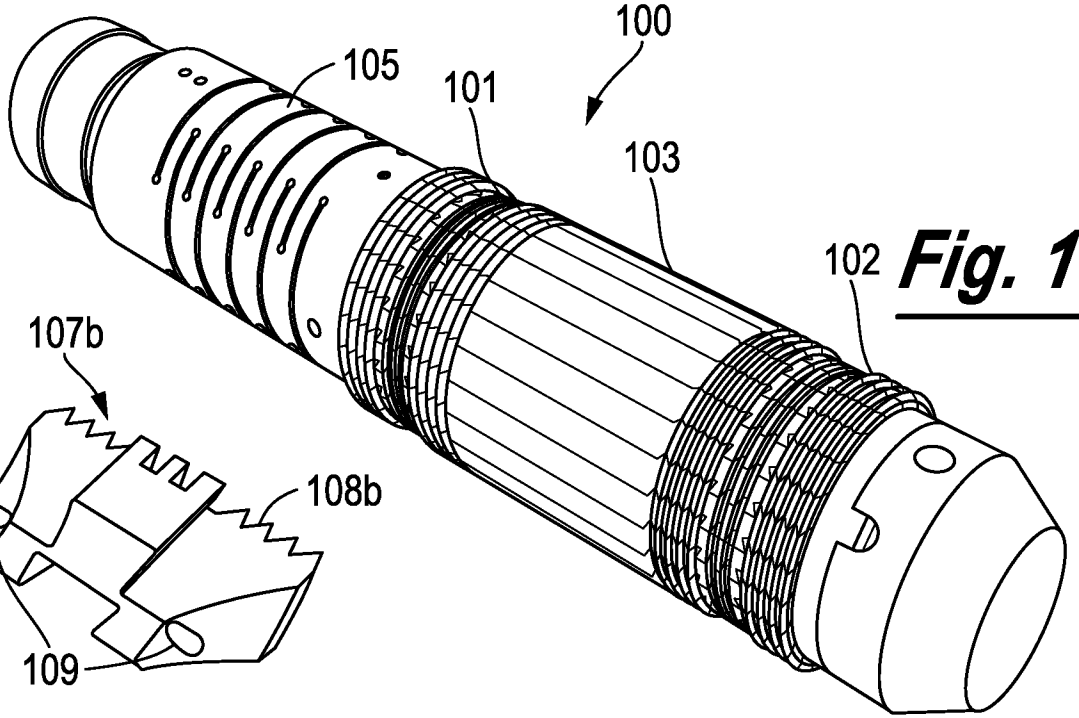
Fig. 10A
Fig. 11B
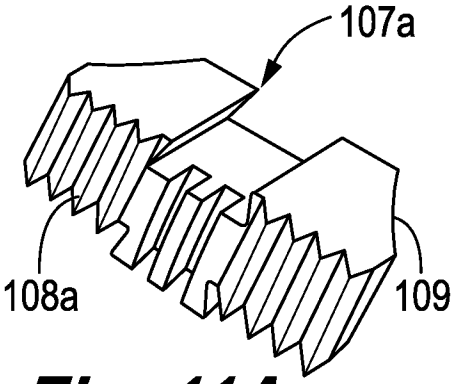
Fig. 11A
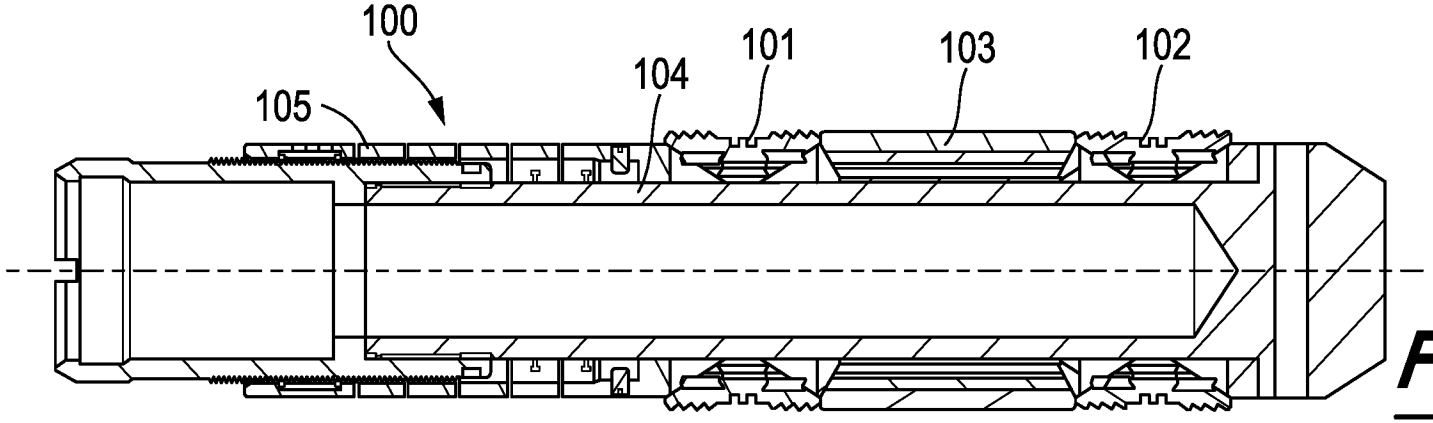
Fig. 10B

EXPANDING AND COLLAPSING APPARATUS HAVING BOOKEND SEAL CARTRIDGES

BACKGROUND

The present disclosure relates to an expanding and collapsing apparatus and methods of use, and in particular aspects, to an expanding apparatus in the form of a ring, operable to move between a collapsed condition and an expanded condition. The present disclosure also relates to tools and devices incorporating the expansion apparatus and methods of use. Certain embodiments of the present disclosure relate to oilfield apparatus (including, but not limited to, downhole apparatus and wellhead apparatus) incorporating the apparatus and methods of use.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

In many fields of mechanical engineering, and in the field of hydrocarbon exploration and production in particular, it is known to provide expansion mechanisms for the physical interaction of tubular components. Expansion mechanisms may expand outwardly to engage an external surface, or may collapse inwardly to engage an internal surface.

Applications are many and varied, but in hydrocarbon exploration and production include the actuation and setting of flow barriers and seal elements such as plugs and packers, anchoring and positioning tools such as wellbore anchors, casing and liner hangers, and locking mechanisms for setting equipment downhole. Other applications include providing mechanical support or back up for elements such as elastomers or inflatable bladders.

A typical anti-extrusion ring is positioned between a packer or seal element and its actuating slip members, and is formed from a split or segmented metallic ring. During deployment of the packer or seal element, the segments move to a radially expanded condition. During expansion and at the radially expanded condition, spaces are formed between the segments, as they are required to occupy a larger annular volume. These spaces create extrusion gaps, which may result in failure of the packer or seal under working conditions.

Various configurations have been proposed to minimize the effect of spaces between anti-extrusion segments, including providing multi-layered rings, such that extrusion gaps are blocked by an offset arrangement of segments. For example, U.S. Pat. No. 6,598,672 describes an anti-extrusion rings for a packer assembly which has first and second ring portions which are circumferentially offset to create gaps in circumferentially offset locations. U.S. Pat. No. 2,701,615 discloses a well packer comprising an arrangement of crowned spring metal elements which are expanded by relative movement.

Other proposals, for example those disclosed in U.S. Pat. Nos. 3,572,627, 7,921,921, U.S. Pat. App. No. 2013/0319654, U.S. Pat. Nos. 7,290,603 and 8,167,033 include arrangements of circumferentially lapped segments. U.S. Pat. No. 3,915,424 describes a similar arrangement in a drilling BOP configuration, in which overlapping anti-extrusion members are actuated by a radial force to move radially and circumferentially to a collapsed position which supports annular sealing elements. Such arrangements avoid introducing extrusion gaps during expansion, but create a ring with uneven or stepped faces or flanks. These configurations do not provide an unbroken support wall for a sealing element, are spatially inefficient, and may be difficult to reliably move back to their collapsed configurations. U.S. Pat. No. 8,083,001 proposes an alternative configuration in which two sets of wedge shaped segments are brought together by sliding axially with respect to one another to create an expanded gauge ring.

In anchoring, positioning, setting, locking and connection applications, radially expanding and collapsing structures are typically circumferentially distributed at discrete locations when at their increased outer diameter. This reduces the surface area available to contact an auxiliary engagement surface, and therefore limits the maximum force and pressure rating for a given size of device.

SUMMARY

A summary of certain embodiments described herein is set forth below. It should be understood that these aspects are presented merely to provide the reader with a brief summary of these certain embodiments and that these aspects are not intended to limit the scope of this disclosure.

Certain embodiments of the present disclosure include a downhole tool that includes a combined seal and anchor assembly configured to anchor the downhole tool against a wellbore casing within which the downhole tool is disposed, and to provide a radial seal between the downhole tool and the wellbore casing only in compression. The combined seal and anchor assembly includes a central slips cartridge having a plurality of slip elements disposed in a central ring structure and configured to move radially outward and slide circumferentially relative to each other to form a relatively constant outer diameter to enable the central slips cartridge to anchor the downhole tool against the wellbore casing. The combined seal and anchor assembly also includes a first seal cartridge disposed on a first axial side of the central slips cartridge. The first seal cartridge includes a first plurality of seal body elements disposed in a first ring structure and configured to move radially outward and slide circumferentially relative to each other to form the relatively constant outer diameter. Each seal body element of the first plurality of seal body elements has a seal element mounted to a first axial end of the seal body element. Each respective seal element is configured to provide the radial seal between the downhole tool and the wellbore casing only in compression, and to provide a first axial seal between the respective seal body element and the central slips cartridge. The combined seal and anchor assembly further includes a second seal cartridge disposed on a second axial side of the central slips cartridge opposite the first axial side. The second seal cartridge includes a second plurality of seal body elements disposed in a second ring structure and configured to move radially outward and slide circumferentially relative to each other to form the relatively constant outer diameter. Each seal body element of the second plurality of seal body elements has a seal element mounted to a first axial end of the seal body element. Each respective seal element is configured to provide the radial seal between the downhole tool and the wellbore casing only in compression, and to provide a second axial seal between the respective seal body element and the central slips cartridge.

Other embodiments of the present disclosure include a downhole tool that includes a combined seal and anchor assembly configured to anchor the downhole tool against a wellbore casing within which the downhole tool is disposed, and to provide a seal between the downhole tool and the wellbore casing only in compression. The combined seal and anchor assembly includes a hybrid slips/seal cartridge having a plurality of slip elements disposed in a ring structure and configured to move radially outward and slide circumferentially relative to each other to form a relatively constant outer diameter to enable the hybrid slips/seal cartridge to anchor the downhole tool against the wellbore casing. Each slip element of the plurality of slip elements has a first seal element mounted to a first axial end of the slip element and a second seal element mounted to a second axial end of the slip element opposite the first axial end. The first and second seal elements are configured to provide the seal between the downhole tool and the wellbore casing only in compression. The combined seal and anchor assembly also includes a first support cone having a first tapered surface configured to contact the first seal elements of the hybrid slips/seal cartridge. The combined seal and anchor assembly further includes a second support cone having a second tapered surface configured to contact the second seal elements of the hybrid slips/seal cartridge. In addition, the downhole tool also includes first and second seal energizing spring assemblies disposed on opposite axial ends of the combined seal and anchor assembly and configured to maintain a minimum compression load against the seals provided by the combined seal and anchor assembly.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings, in which:

FIGS. 10A and 10B are respectively perspective and sectional views of a permanent plug, shown in a set position;

FIGS. 11A and 11B are respectively first and second perspective views of a slip element of the apparatus of FIGS. 10A and 10B;

DETAILED DESCRIPTION

Figure 1A:
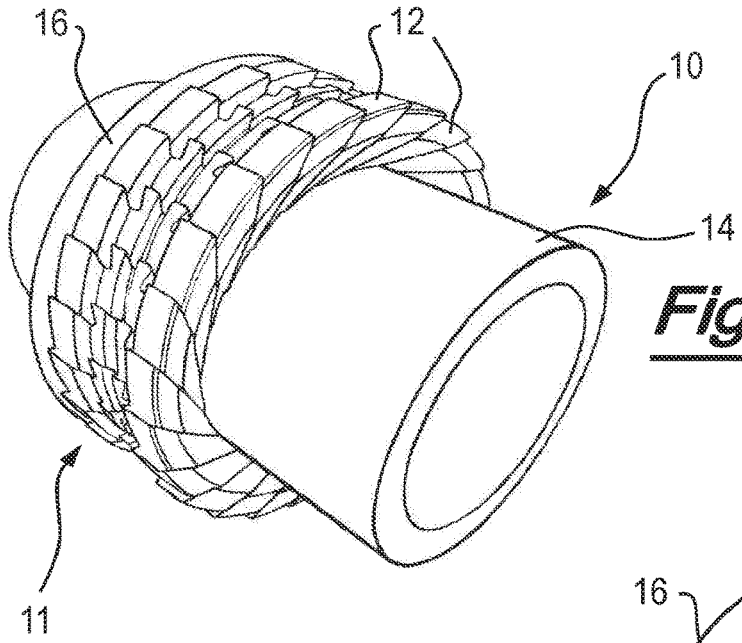
FIGS. 1A through 1D are respectively perspective, first end, part sectional and second end views of an apparatus according to a first embodiment, shown in a collapsed condition.

One or more specific embodiments of the present disclosure will be described below. These described embodiments are only examples of the presently disclosed techniques. Additionally, to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "connect," "connection," "connected," "in connection with," and "connecting" are used to mean "in direct connection with" or "in connection with via one or more elements"; and the term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down," "uphole" and "downhole," "upper" and "lower," "top" and "bottom," and other like terms indicating relative positions to a given point or element are utilized to more clearly describe some elements. Commonly, these terms relate to a reference point as the surface from which drilling operations are initiated as being the top (e.g., uphole or upper) point and the total depth along the drilling axis being the lowest (e.g., downhole or lower) point, whether the well (e.g., wellbore, borehole) is vertical, horizontal or slanted relative to the surface. In addition, as used herein, the terms "proximal" and "distal" may be used to refer to components that are closer to and further away from, respectively, other components being described.

Referring firstly to FIGS. 1 to 4, the principles of the present disclosure will be described with reference to an expanding apparatus in accordance with the first embodiment. In this embodiment, the expanding apparatus, generally depicted at 10, comprises an expanding ring structure configured to be expanded from a first collapsed or unexpanded condition (shown in FIGS. 1A to 1D) and a second expanded condition (shown in FIGS. 2A to 2D). The apparatus of this and other embodiments may be referred to as "expanding apparatus" for convenience, as they are operable to move to an expanded state from a normal collapsed state. However, the apparatus may equally be referred to as a collapsing apparatus, or an expanding or collapsing apparatus, as they are capable of being expanded or collapsed depending on operational state.

The expanding apparatus 10 comprises a plurality of elements 12 assembled together to form a ring structure 11. The elements 12 define an inner ring surface which is supported by the outer surface of cylinder 14. Each element comprises an inner surface 20, an outer surface 21 and first and second contact surfaces 22, 23. The first and second contact surfaces are oriented in non-parallel planes, which are tangential to a circle centered on the longitudinal axis of the apparatus. The planes converge towards the inner surface of the element. Therefore, each element is in the general form of a wedge, and the wedges are assembled together in a circumferentially overlapping fashion to form the ring structure 11. In use, the first and second contact surfaces of adjacent elements are mutually supportive.

Figure 3A:
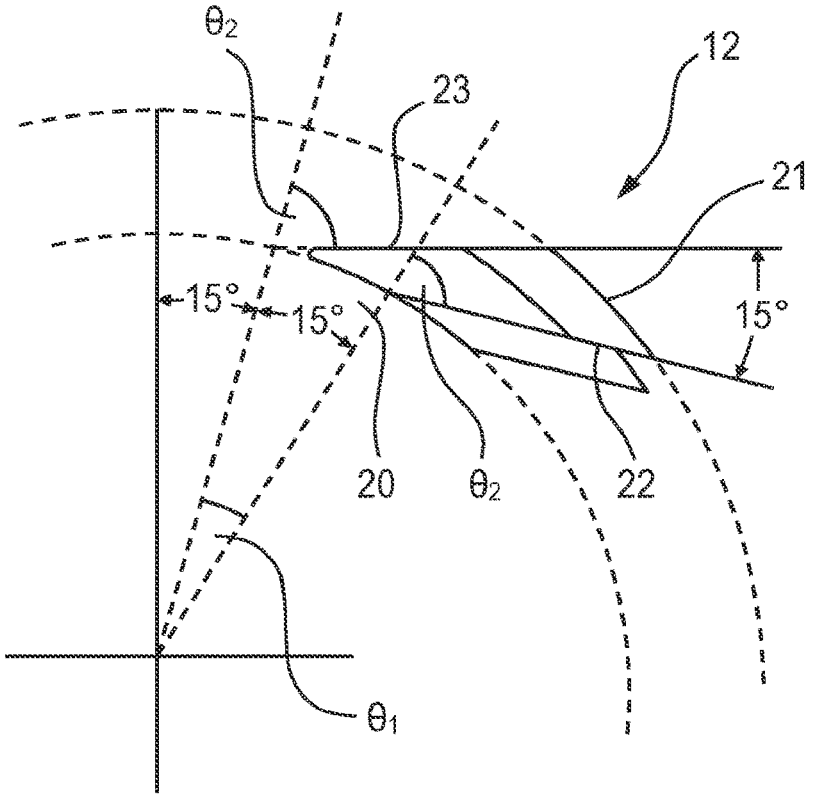
FIGS. 3A and 3B are geometric representations of an element of the apparatus of FIGS. 1A through 1D, shown from one side.
Figure 3B:
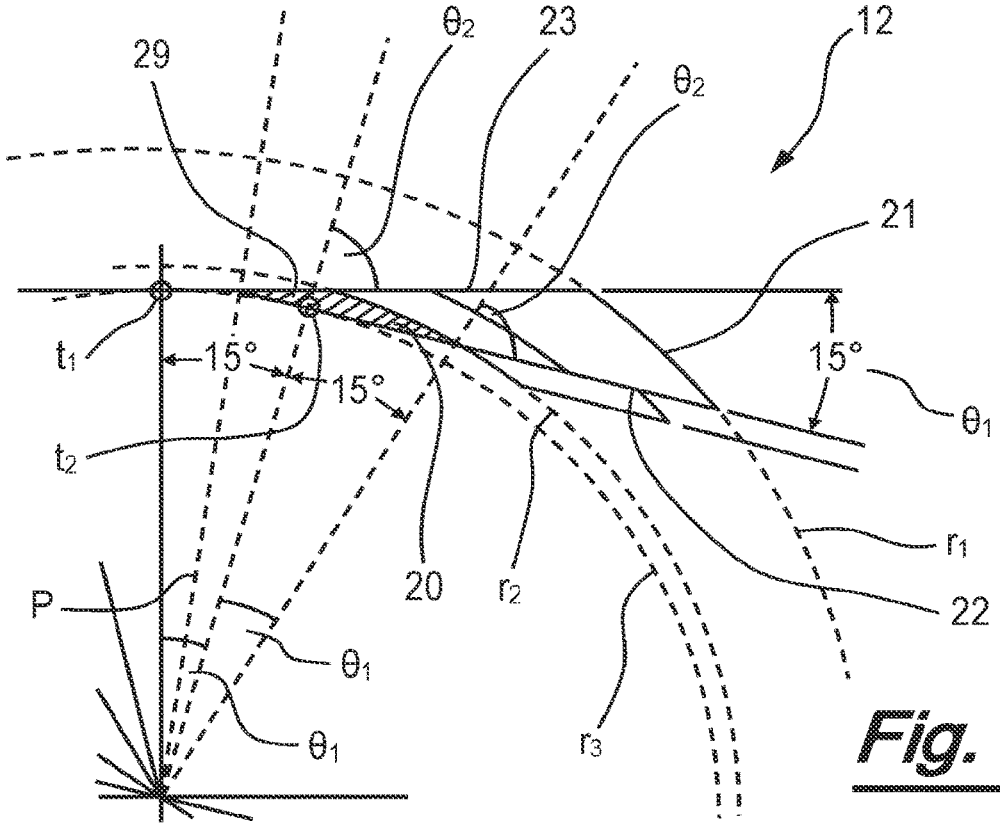
Figure 4A:
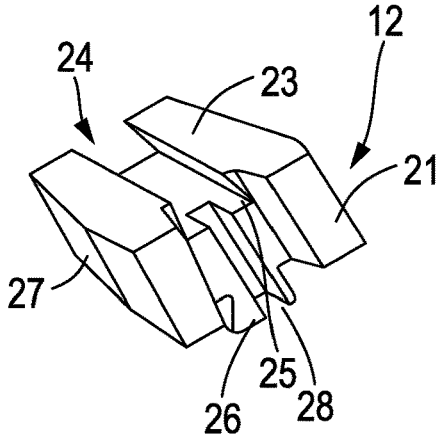
FIGS. 4A through 4F are respectively first perspective, second perspective, plan, first end, lower, and second end views of an element of the apparatus of FIGS. 1A through 1D.
Figure 4B:
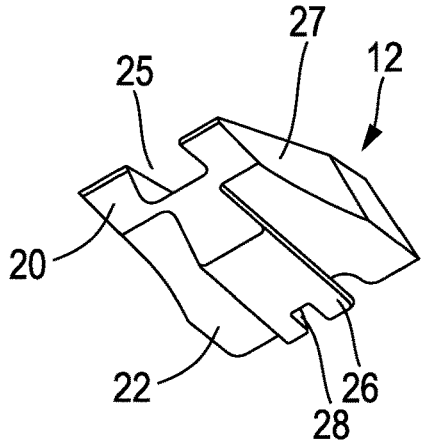
Figure 4C:
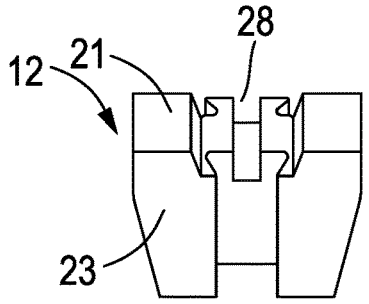
Figure 4D:
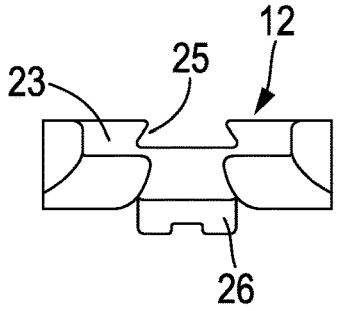
Figure 4E:
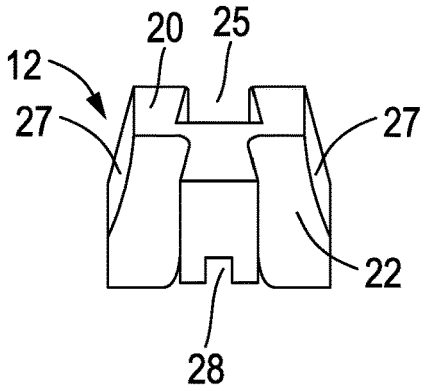
Figure 4F:
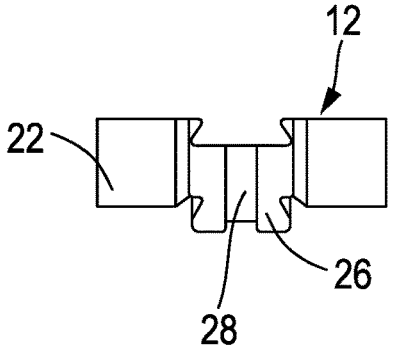

As most clearly shown in FIGS. 3A and 3B, when the ring structure is expanded to its optimal outer diameter, the orientation planes of the first and second contact surfaces intersect an inner surface of the ring structure, and together with the longitudinal axis of the apparatus, the lines of intersection define a sector of a cylinder. In this case, the ring structure is formed from twenty-four identical elements, and the central angle $\theta_1$ is 15 degrees. The angle described between the orientation planes of the first and second contact surface is the same as the central angle of the cylindrical sector, so that the elements are arranged rotationally symmetrically in the structure.

As shown in FIG. 3B, each element is based on a notional wedge-shaped segment of a ring centered on an axis, with each notional wedge-shaped segment being inclined with respect to the radial direction of the ring. The nominal outer diameter of the segment is at the optimum expansion condition of the ring (with radius shown at $r_1$).

The orientation planes of the first and second contact surfaces of the element are tangential to a circle with radius $r_3$ concentric with the ring at points $t_1$, $t_2$. The angle described between the tangent points is equal to the angle $\theta_1$ of the segment. The orientation planes of the first and second contact surfaces of each notional wedge-shaped segment intersect one another on a radial plane P which bisects radial planes located at the tangent points (i.e., is at an angle of $\theta_1/2$ to both). This intersection plane P defines the expanding and collapsing path of the segment.

Figure 1B:
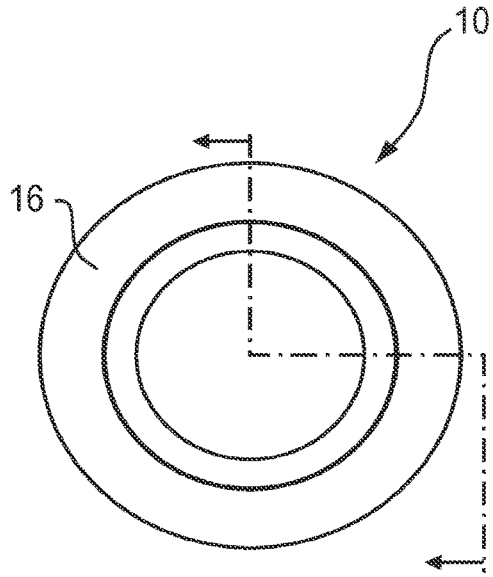
Figure 1D:
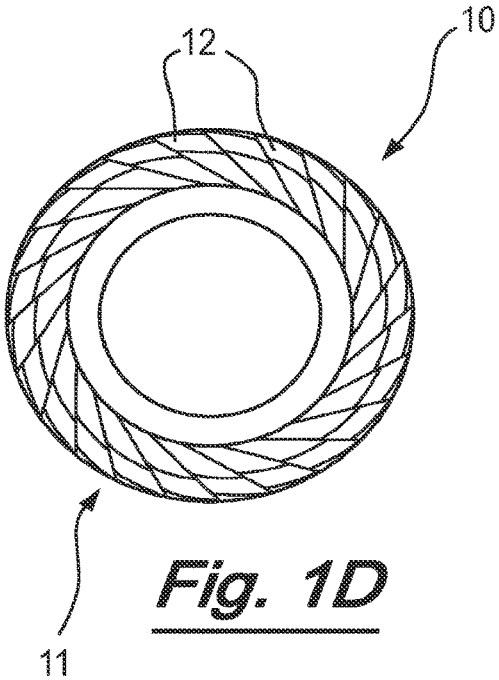
Figure 1C:
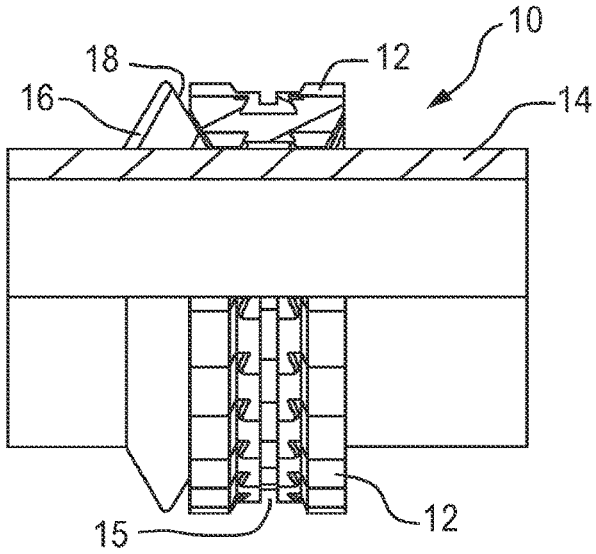
Figure 2A:
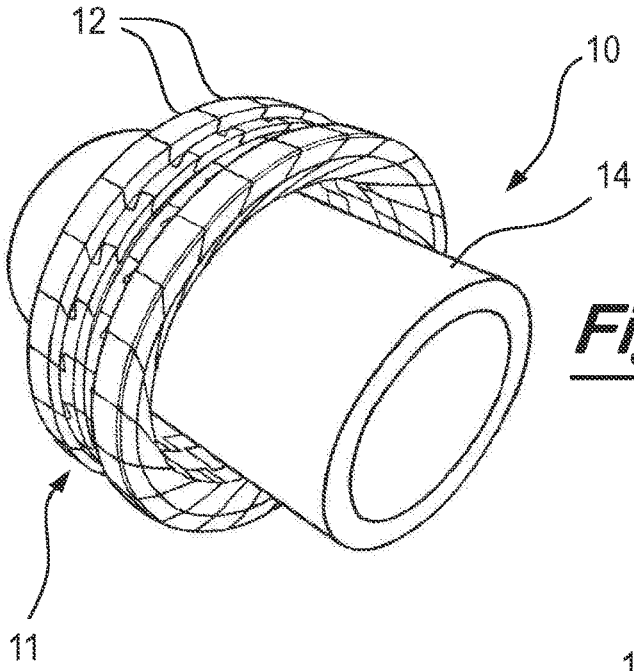
FIGS. 2A through 2D are respectively perspective, first side, part sectional and second side views of the apparatus of FIGS. 1A through 1D, shown in an expanded condition.
Figure 2B:
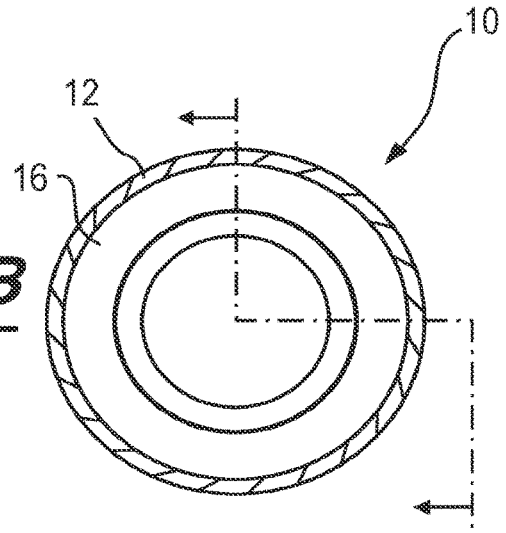
Figure 2D:
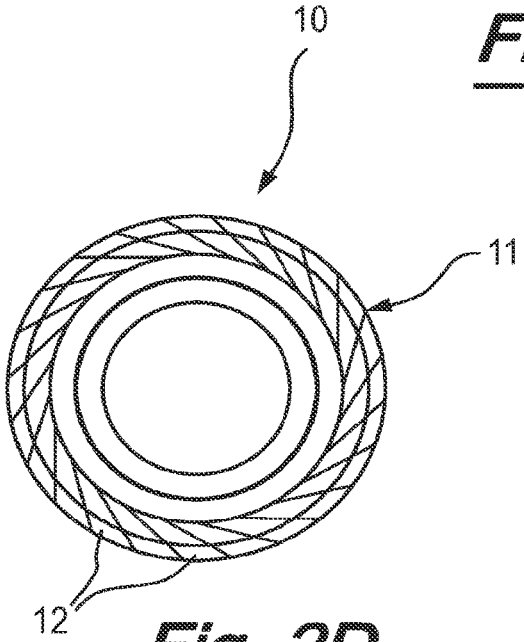
Figure 2C:
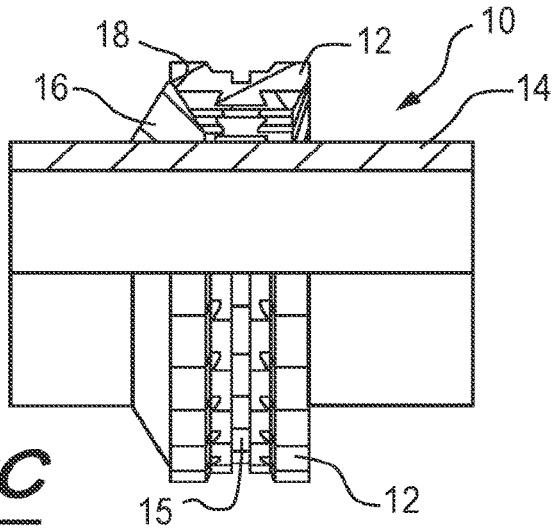

In the configuration shown in FIGS. 1 and 2, notional wedge-shaped segments are modified by removal of the tips 29 of the wedges, to provide a curved or arced inner surface 20 with radius $r_2$ when the ring is in its expanded condition shown in FIGS. 2A and 2D. The modification of the wedge-shaped elements can be thought of as an increase in diameter of an internal bore through the ring structure by $2(r_2-r_3)$, or a truncation of the inner diameter. This change in the inner diameter from the notional inner diameter r3 to which the contact surfaces are tangential to a truncated inner diameter $r_2$, has the effect of changing an angle between the contact surfaces and the radial plane from the center of the ring. Taking angle $\theta_2$ to be the angle described between the contact surface and a radial plane defined between the center point of the ring structure and the point at which the orientation surface meets or intersects a circle at the radial position of the inner surface, $\theta_2$ is changed in dependence on the amount by which the segment has its inner diameter truncated. For the notional wedge shaped segment, the orientation planes of the contact surfaces are tangential to a circle at the inner diameter at $r_3$ (i.e. angle $\theta_2$ is 90 degrees). For the modified elements 12, the orientation planes of the contact surfaces instead intersect a circle at the (increased) inner diameter at $r_2$ and are inclined at a reduced angle $\theta_2$.

The angle $\theta_2$ at which the segment is inclined is related to the amount of material removed from the notional wedge-shaped segment, but is independent from the central angle $\theta_1$ of the wedge. Angle $\theta_2$ is selected to provide element dimensions suitable for manufacture, robustness, and fit within the desired annular volume and inner and outer diameters of the collapsed ring. As the angle $\theta_2$ approaches 90 degrees, a shallower, finer wedge profile is created by the element, which may enable optimization of the collapsed volume of the ring structure. Although a shallower, finer wedge profile may have the effect of reducing the size of the gaps created at the inner surface of the ring in the collapsed condition and/or enabling a more compact collapsed condition, there are some consequences. These include the introduction of flat sections at the inner surfaces of the elements, which manifest as spaces at the inner diameter of the ring when in an expanded or partially expanded condition. When $\theta_2$=90 degrees, all the segments are purely tangential to inner diameter, the collapsed volume for a given outer diameter and inner diameter is most efficient, but the inner surface of the ring structure is polygonal with flat sections created by each segment. In some configurations, these flat sections may be undesirable. There may also be potential difficulties with manufacture of the elements and robustness of the elements and assembled ring structure. However, in many applications, where the profile of the inner surface of the expanded ring is not critical, for example when the inner diameter of the ring structure is floating, and/or the true inner diameter is defined by an actuation wedge profile rather than the inner surface of the ring, this compromise may not be detrimental to the operation of the apparatus, and the reduced collapse volume may justify an inclination angle $\theta_2$ of (or approaching) 90 degrees.

In the apparatus of FIGS. 1 to 4, the angle $\theta_2$ is 75 degrees. Relaxing $\theta_2$ to a reduced angle provides a smooth outer diameter and inner diameter profile to the expanded ring, as a portion of the inner circular arc is retained at the expense of slightly increased collapsed volume. It should be noted that the angle $\theta_2$ is independent from the angle $\theta_1$. Where the ring structure is desired to have a circular inner surface, preferred arrangements may have an angle $\theta_2$ which is in the range of (90 degrees$-2\theta_1$) to 90 degrees inclusive, and particularly preferred arrangements have an angle $\theta_2$ in the range of 70 degrees to 90 degrees (most preferably in the range of 73 degrees to 90 degrees). In general, to provide sufficient truncation of the inner diameter to retain a useful portion of an inner arc and provide a smooth inner surface to the ring structure, a maximum useful value of $\theta_2$ is (90 degrees$-\theta_1/2$). This would be 82.5 degrees in the described arrangements.

In other configurations, also in accordance with embodiments of the present disclosure (and as will be described below) the geometry of the notional wedge-shaped segments forming the elements may be unmodified (save for the provision of functional formations such as for interlocking and/or retention of the elements), without the removal of material from the tip of the notional wedge-shaped segments. Such embodiments may be preferred when there is no requirement for the ring structure to have a circular inner surface.

As most clearly shown in FIGS. 4A to 4F, the first and second contact surfaces of the element have corresponding interlocking profiles 24 formed therein, such that adjacent elements can interlock with one another. In this case, the interlocking profiles comprise a dovetail groove 25 and a corresponding dovetail tongue 26. The interlocking profiles resist circumferential and/or radial separation of the elements in the ring structure, but permit relative sliding motion between adjacent elements. The interlocking profiles also facilitate smooth and uniform expansion and contraction of the elements during use. It will be appreciated that alternative forms of interlocking profiles, for example comprising recesses and protrusions of other shapes and forms, may be used within the scope of the present disclosure.

The elements are also provided with inclined side wall portions 27, which may facilitate deployment of the apparatus in use. The side wall portions are formed in an inverted cone shape which corresponds to the shape and curvature of the actuating cone wedges profiles when the apparatus is in its maximum load condition (typically at its optimum expansion condition).

Each element is also provided with a groove 28, and in the assembled ring structure, the grooves are aligned to provide a circular groove which extends around the ring. The groove accommodates a biasing element (not shown), for example a spiral retaining ring of the type marketed by Smalley Steel Ring Company under the Spirolox brand, or a garter spring. In this case, the biasing means is located around the outer surface of the elements, to bias the apparatus towards the collapsed condition shown in FIGS. 1A to 1D. Although one groove for accommodating a biasing means is provided in this embodiment, in alternative embodiments of the apparatus, multiple grooves and biasing means may be provided.

The apparatus 10 comprises a wedge member 16, which in this case is an annular ring having a conical surface 18 opposing one side of the ring structure 11. The wedge angle corresponds with the angle of the inclined conical side walls 27 of the elements. A corresponding wedge shaped profile (not shown) is optionally provided on the opposing side of the ring structure to facilitate expansion of the ring elements. In alternative embodiments, this optional additional wedge may be substituted with an abutment shoulder.

Operation of the expansion apparatus will now be described. In the first, collapsed or unexpanded condition, shown most clearly in FIG. 10, the elements are assembled in a ring structure 11 which extends to a first outer diameter. In this embodiment, and as shown in FIGS. 1B and 10, the wedge member 16 defines the maximum outer diameter of the apparatus in the first condition. The elements are biased towards the unexpanded condition by a spiral retaining ring (not shown), and are supported on the inner surface by the outer surface of the cylinder 14.

In use, an axial actuation force is imparted on the wedge member 16. Any of a number of suitable means known in the art can be used for application of the axial actuation force, for example, the application of a force from an outer sleeve positioned around the cylinder. The force causes the wedge member 16 to move axially with respect to the cylinder, and transfer a component of the axial force onto the recessed side wall of the elements. The angle of the wedge transfers a radial force component to the elements 12, which causes them to slide with respect to one another along their respective contact surfaces.

The movement of the expanding elements is tangential to a circle defined around the longitudinal axis of the apparatus. The contact surfaces of the elements mutually support one another before, during, and after expansion. The radial position of the elements increases on continued application of the axial actuation force until the elements are located at a desired outer radial position. This radial position may be defined by a controlled and limited axial displacement of the wedge member, or alternatively can be determined by an inner surface of a bore or tubular in which the apparatus is disposed.

FIGS. 2A to 2D show clearly the apparatus in its expanded condition. At an optimal expansion condition, shown in FIGS. 2B and 2D, the outer surfaces of the individual elements combine to form a complete circle with no gaps in between the individual elements. The outer surface of the expansion apparatus can be optimized for a specific diameter, to form a perfectly round expanded ring (within manufacturing tolerances) with no extrusion gaps on the inner or outer surfaces of the ring structure. The design of the expansion apparatus also has the benefit that a degree of under expansion or over expansion (for example, to a slightly different radial position) does not introduce significantly large gaps.

It is a feature of the present disclosure that the elements are mutually supported before, throughout, and after the expansion, and do not create gaps between the individual elements during expansion or at the fully expanded position. In addition, the arrangement of elements in a circumferential ring, and their movement in a plane perpendicular to the longitudinal axis, facilitates the provision of smooth side faces or flanks on the expanded ring structure. With deployment of the elements in the plane of the ring structure, the overall width of the ring structure does not change. This enables use of the apparatus in close axial proximity to other functional elements.

The apparatus has a range of applications, some of which are illustrated in the following example embodiments. However, additional applications of the apparatus are possible which exploit its ability to effectively perform one or more of blocking or sealing an annular path; contacting an auxiliary surface; gripping or anchoring against an auxiliary surface; locating or engaging with radially spaced profiles; and/or supporting a radially spaced component.

There will now be described an application of the expansion apparatus described herein to a downhole oilfield apparatus, specifically a retrievable bridge plug. A retrievable bridge plug is a downhole tool which is located and set in order to isolate a part of the wellbore, in a way that enables it to be unset and retrieved from the wellbore after use. A typical retrievable bridge plug includes an arrangement of slips for anchoring the plug in the well, and a seal element for creating a fluid seal. Slips used in bridge plugs are typically expensive to manufacture, as they may be required to be milled, turned, machined, wire cut and/or heat treated. Moreover, slips used in bridge plugs conventionally work for a particular range of tubing weights. This may require the wellbore contractor to have an inventory of slips for a single plug, which will be installed depending on where in the completion the plug is required to be placed. The arrangement of slips and their deployment mechanism increases the axial length of the tool, which is generally undesirable and may be a critical issue in some applications. In addition, an unsupported seal assembly may have a tendency to deform and fail through an extrusion gap between the maximum outer diameter of a gauge ring which supports the seal and the surrounding bore to which the seal element has been expanded.

The expansion apparatus described herein offers a number of advantages in a bridge plug application, as will be apparent from the following description.

Figure 5A:
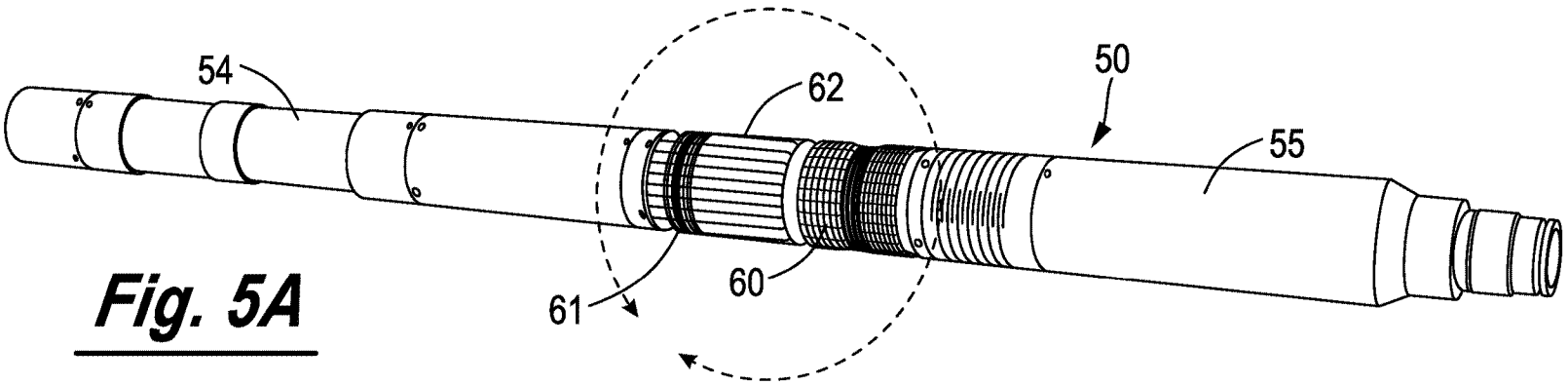
FIGS. 5A and 5B are respectively perspective and sectional views through a retrievable bridge plug incorporating apparatus described herein, shown in a run position.
Figure 5B:
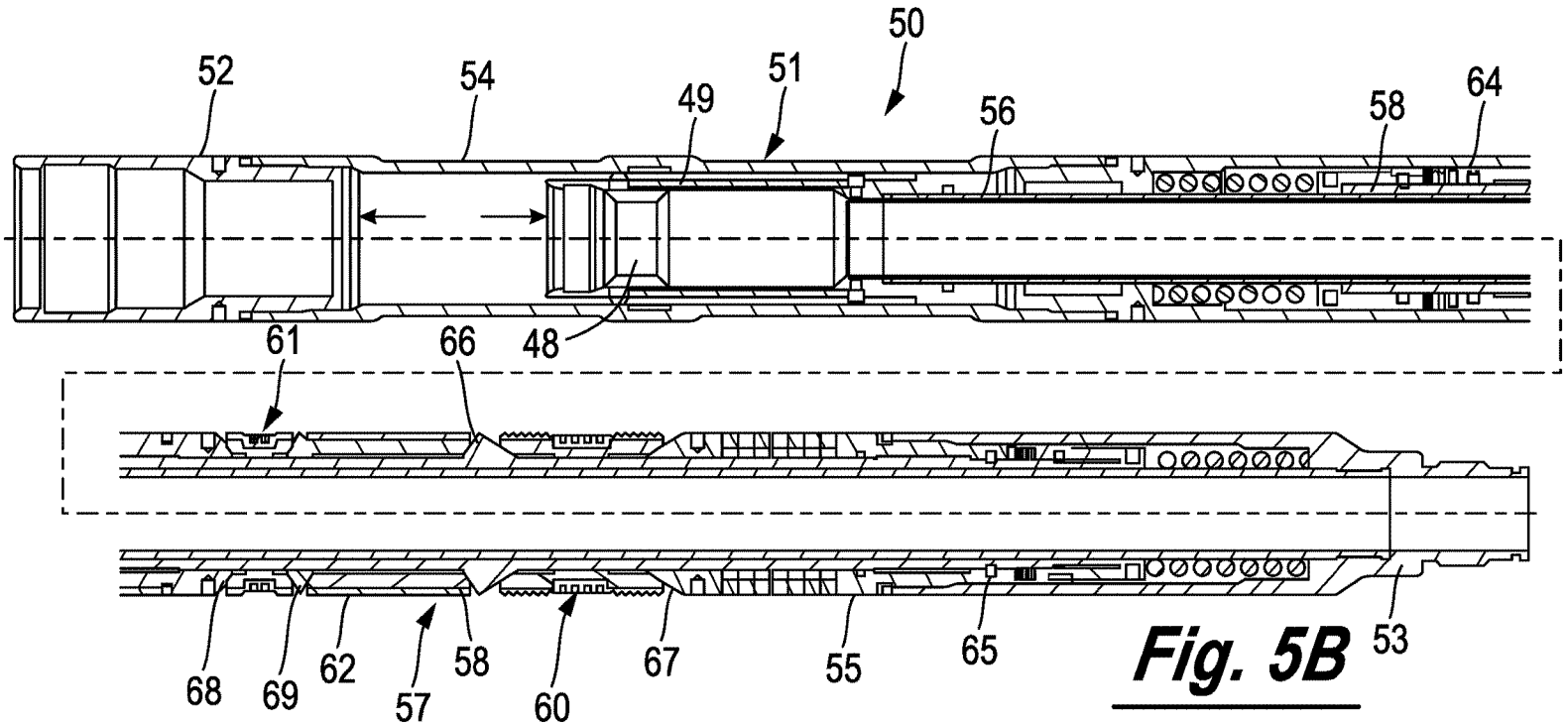

FIG. 5A is an isometric view of a retrievable bridge plug according to an embodiment, into which an expansion apparatus has been incorporated to perform anchoring and anti-extrusion functions. FIG. 5B is a longitudinal section through the bridge plug, generally shown at 50, in a run position.

The plug 50 comprises a housing assembly 51, and upper and lower connectors 52, 53 for connecting the plug into a tool string. The housing assembly 51 comprises upper and lower housing subs 54, 55 located on a mandrel 56 on either side of a seal and anchor assembly 57. An actuation sleeve 58 connects the upper and lower housing subs on the mandrel.

The slip and seal assembly 57 comprises an expanding slip assembly 60, an expanding anti-extrusion ring 61, and an elastomeric seal element 62 disposed between the expanding slip assembly 60 and the expanding anti-extrusion ring 61. The expanding anti-extrusion ring 61 is similar to the expansion apparatus 10, and will be understood from FIGS. 1 to 4 and the accompanying description. FIGS. 8A to 8D show the individual elements 63 of the expanding anti-extrusion ring 61 in more detail. The elements 63 are similar to the elements 12, and comprise inner and outer surfaces 70, 71, and first and second contact surfaces 72, 73. The first and second contact surfaces are oriented in non-parallel planes, which are tangential to a circle centered on the longitudinal axis of the apparatus. The elements 63 also comprise corresponding interlocking profiles 74. The elements 63 are slightly longer in an axial direction of the tool, and comprise a pair of grooves 75 for accommodating a pair of biasing springs.

The slip assembly 60 is also constructed and operated according to the principles of the present disclosure. The assembly 60 comprises a ring structure formed from a number of individual expansion slip elements, which interlock to create the ring structure. Perspective views of the expansion slip elements 77 are provided in FIGS. 9A to 9D. Each slip element 77 is similar in form and function to the elements 12 and 63, and their operation will be understood from the foregoing description. However, in this embodiment, the outer surface of the element is provided with engaging means 78 defined by a series of grooves 81 and ridges 82 in the outer surface 79, disposed on either side of retaining ring grooves 80. In this embodiment, the slip elements 77 are bidirectional; the engaging means on respective sides of the of the slip surface are asymmetrically formed in opposing directions, to provide an anchoring forces which resist movement in both upward and downward directions.

Figure 6:
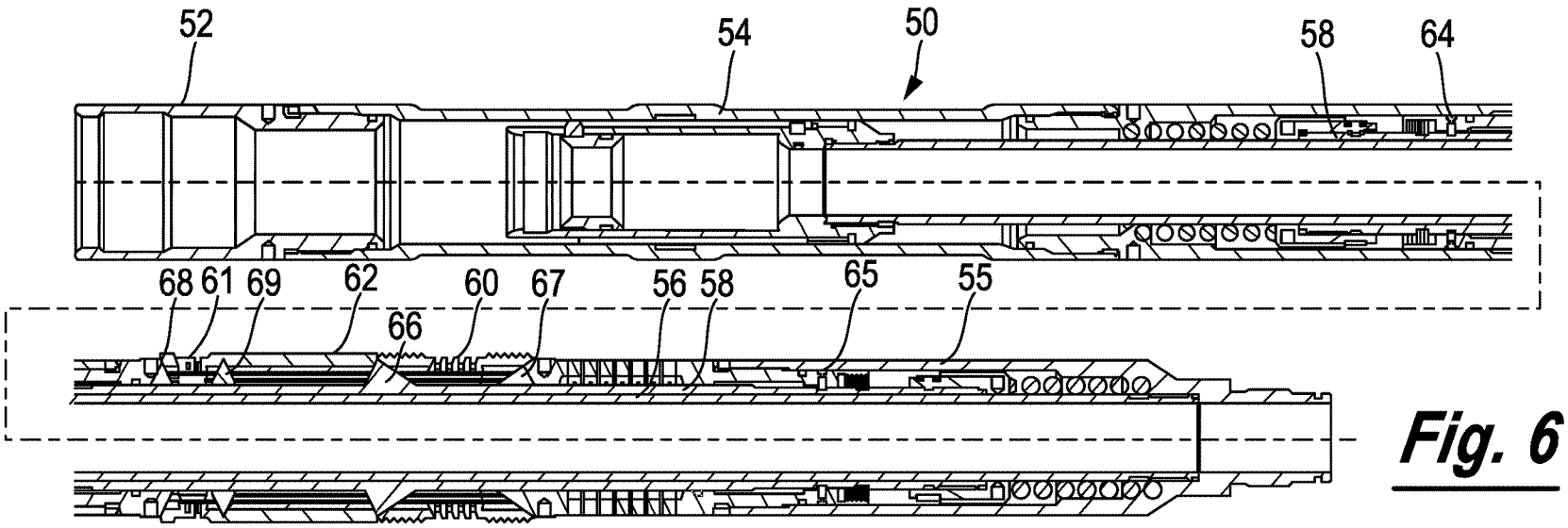
FIG. 6 is a sectional view of the apparatus of FIGS. 5A and 5B, shown in a set position.

Operation of the bridge plug will now be described with particular reference to FIGS. 5B, 6 and 7. When the plug is located at the desired position in the wellbore, it is ready to be set, and a setting tool is used to impart a force to the plug in a manner known in the art. In this example embodiment, a setting tool (not shown) impart a downward force on the outer housing 51 relative to the mandrel 56, resulting in a relative movement between the housing and the mandrel. The downward axial force is transferred from the upper housing sub 54 to the actuation sleeve 58 via upper shear screws 64. An initial downward force on the outer housing with respect to the mandrel 56 causes lower shear screws 65 to shear, enabling the upper housing sub 54 and actuation sleeve 58 to move downward with respect to the lower housing sub 55.

Downward movement of the actuation sleeve 58 moves the fixed upset wedge profile 66 of the actuation sleeve towards the slip assembly 60, to impart an axial force on the slip assembly 60. The slip assembly is axially compressed between the wedge profile 66 of the actuation sleeve and a lower wedge profile 67 on the lower housing sub 55. The slip elements slide with respect to one another in a tangential direction and move to their radially extended positions, in the manner described with reference to FIGS. 1 and 2. The outer surface of the ring structure formed by the slip elements is moved into engagement with the inner surface of the wellbore, where the engaging means anchors the slips at the plug to the wellbore. As the upper housing sub moves downwards with respect to the mandrel, a ratchet sleeve 49 and ratchet clip locks the position of the sub 54, and prevents return movement of the housing and release of the slips.

A further downward force on the upper housing sub with respect to the inner mandrel causes the upper shear screws 64 to shear, which enables the upper housing sub 54 to move downwards with respect to the mandrel 56 and the actuation sleeve 58. Movement of the upper housing assembly 54 imparts an axial force on the anti-extrusion ring 60 between a wedge profile 68 of the upper housing sub 54 and a movable wedge member 69 disposed between the seal assembly 62 and the anti-extrusion ring 60. The axial force results in radial deployment of the element in the manner described above. The downward force also acts on the movable wedge member 69 to compress the seal element 62 between the wedge 69 and the upset profile 66 on the slip actuation sleeve. The compressed seal 62 is expanded in a radial direction into contact with the surrounding wellbore wall. The expanded condition is shown in FIG. 6, with the position locked by the ratchet sleeve 49 and ratchet clip to prevent return movement of the housings and release of the slips and anti-extrusion ring 61. The anti-extrusion ring 61 provides a full extrusion barrier at the upper end of the seal element 62. The expanded slip assembly 60 provides a similar anti-extrusion barrier at the lower end of the seal 62, in addition to its anchoring functionality.

By appropriately using shear screws 64, 65, the plug is made operable to fully deploy the anti-extrusion ring before the seal element is fully compressed. This ensures that there is a fully contained volume, with little or no extrusion gap, into which the seal element is compressed. In a preferred embodiment of the anti-extrusion ring is fully expanded before the seal element begins to be compressed.

Figure 7:
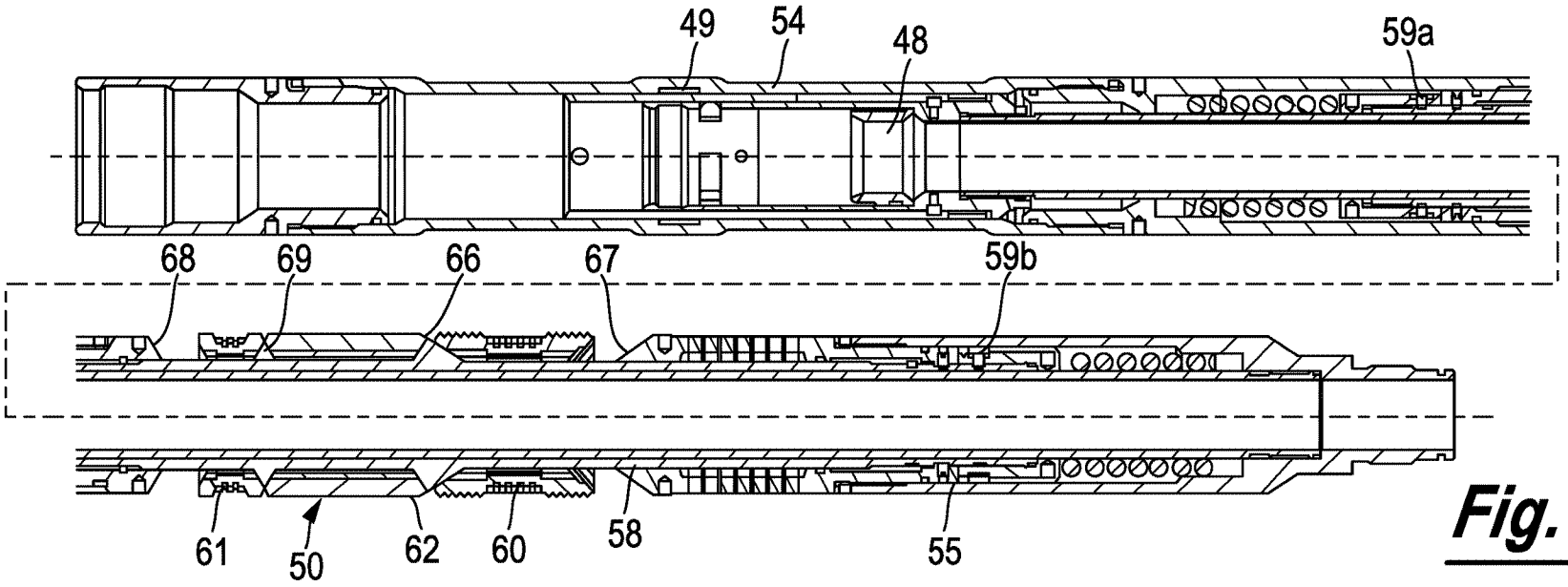
FIG. 7 is a sectional view of the apparatus of FIGS. 5A and 5B, shown in a pull position.
Figure 8A:
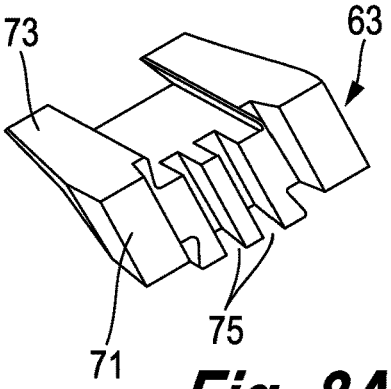
FIGS. 8A through 8D are respectively first perspective, second perspective, third perspective, fourth perspective, plan, end, lower, first side and second side views of a ring segment of apparatus of FIGS. 5A and 5B.
Figure 8B:
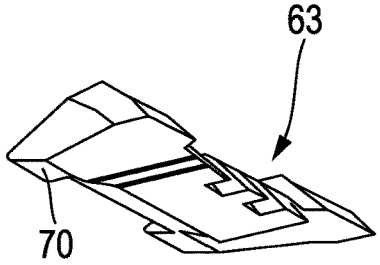
Figure 8C:
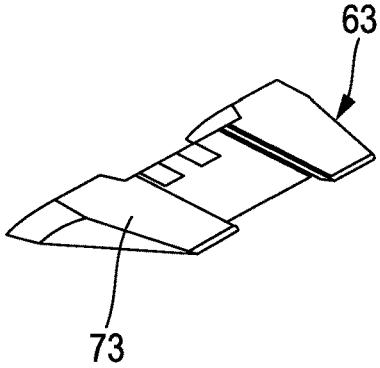
Figure 8D:
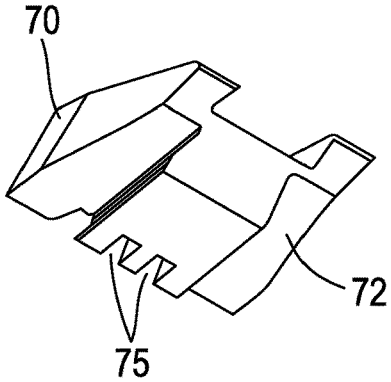
Figure 9A:
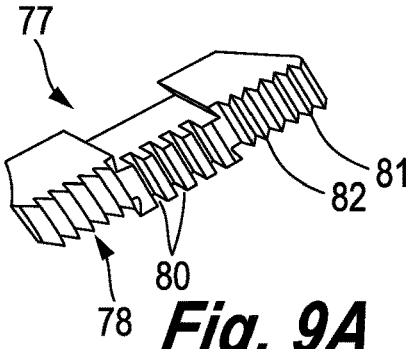
FIGS. 9A through 9D are respectively first perspective, second perspective, third perspective, fourth perspective, plan, end, lower, first side and second side views of a slip element of the apparatus of FIGS. 5A and 5B.
Figure 9B:
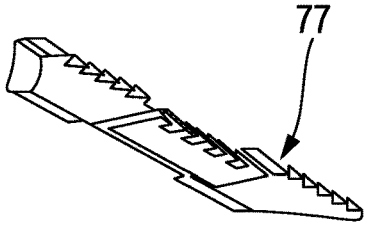
Figure 9C:
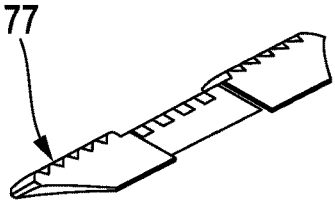
Figure 9D:
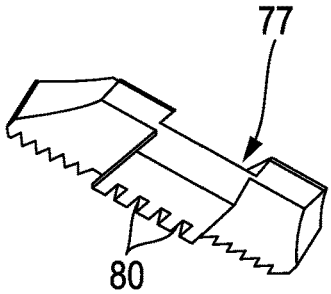

FIG. 7 shows the plug 50 in a pull position. A release tool is run to the plug and engages with a ratchet release sleeve 48, to move it downwards with respect to the mandrel. Movement of the release sleeve releases keys which support the ratchet sleeve 49 on the mandrel. With the ratchet released, the upper and lower housings and actuation sleeve may move upwards relative to the mandrel, to release the actuation force on the slips and seal, resulting in their collapse. Movement of the sleeve relative to the housing subs results in engagement of an upper ratchet lock-out mechanism 59*a* between the upper end of the actuation sleeve and the upper housing sub and a lower ratchet lock-out mechanism 59*b* between the lower end of the actuation sleeve and the lower housing sub. With these components locked together, relative movement of the wedge elements is prevented, to stop expansion of the respective expansion components during pulling out of hole (for example if a restriction is encountered during pulling).

Referring now to FIGS. 10A to 11B, there is shown the application of the present disclosure to a permanent plug, in accordance with an alternative embodiment. FIG. 10A is a perspective view of the permanent plug, generally depicted at 100, and FIG. 10B is a longitudinal sectional view. In each of FIGS. 10A and 10B, the plug is shown in a set position. The plug 100 is similar to the retrievable plug 50, and is general form and function will be understood from FIGS. 5 to 7 and the accompanying description. However, the plug 100 is designed to be permanently installed in a wellbore, and therefore lacks the retrievable functionality of the plug 50. The plug 100 comprises an upper slip assembly 101, and a lower slip assembly 102, positioned either side of an elastomeric seal element 103 disposed on a mandrel 104. A housing 105 enables a downward force to be imparted to the slip assemblies 101, 103, with the wedge members directing a radial expansion force to slip elements, resulting in relative tangential sliding movement of the individual slip elements. The plug 100 differs from the plug 50 in that the anti-extrusion functionality is provided by a pair of slip assemblies rather than providing a dedicated anti-extrusion ring.

FIGS. 11A and 11B are perspective views of individual slip elements 107*a*, 107*b* used respectively in the upper and lower slip assemblies 101, 102. The slip elements are similar to the slip elements 77, and function in the same manner. However, in this embodiment, because a slip assembly is provided above and below the seal element, the engagement profiles on the slips are not bidirectional. Instead, the engagement profiles 108*a*, 108*b* of the respective slip assemblies are unidirectional. The elements of the upper slip assembly are arranged to engage a surrounding surface and resist movement in one direction, whereas the slip elements of the lower assembly are arranged with engaging means configured to resist movement in the opposite direction. Together, the upper and lower slip assemblies provide bidirectional anchoring of the plug in the wellbore. The angles of the respective wedges and the corresponding surfaces in the slip assemblies, along with the retaining force of the biasing means, are selected so that the lower slip assembly can be deployed by an axial force which is directed through the elastomeric seal element. In other words, the axial force required to press the seal element between the anti-extrusion surfaces created by the slip assemblies is greater, and preferably much greater, than the force required to deploy the slip assemblies. This facilitates a full and proper deployment of the slip assemblies before the elastomeric seal element is radially expanded by compression between the wedges.

The slip elements 107*a*, 107*b* of this embodiment are also provided with anti-rotation pegs 109. These pegs are received in corresponding slots in the actuating wedge surfaces, and ensure that the slip elements are not able to rotate with respect to the mandrel and the rest of the plug 100. This configuration prevents the mandrel and other components of the plug from rotating with respect to the slip assemblies if the plug is required to be drilled in order to remove it from the wellbore.

Figure 12A:
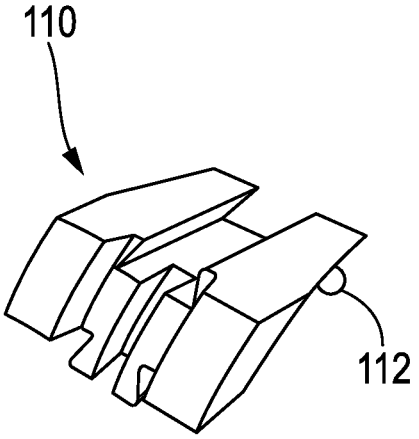
FIGS. 12A and 12B are respectively first and second perspective views of a ring segment.
Figure 12B:
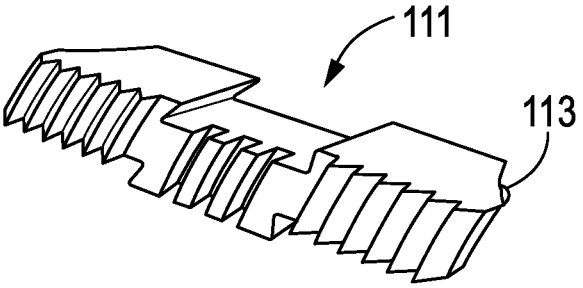

It will be appreciated that alternative configurations may be applied to permanent plug applications, and in particular, that a permanent plug may be configured without slip assemblies being disposed above and below the seal elements. By way of example, FIGS. 12A and 12B are respectively perspective views of an expansion element of an anti-extrusion ring, and a bidirectional slip element, both of which may be used in permanent plug configurations. The expansion element of FIG. 12A is configured to create an anti-extrusion ring structure which functions in the same way as the anti-extrusion ring structure 61 of the plug 50, with the addition of anti-rotation pegs. The slip element of FIG. 12B is similar in form and function to the slip element 77, and is assembled to a bidirectional slip assembly and operates in the same manner as the slip assembly 60 of plug 50, with the addition of anti-rotation pegs.

The foregoing embodiments describe the application of the principles of the present disclosure to wellbore plugs, but it will be apparent from the description that the anti-extrusion ring configurations described with reference to FIGS. 5 to 12 may be applied to tools and devices other than downhole plugs. For example, the system may be used to provide an anti-extrusion ring or back-up ring for a wide range of expanding, radially expanding or swelling elements. For example, the apparatus may be used as an anti-extrusion or back-up ring for compressible, inflatable and/or swellable packer systems. Alternatively, or in addition, the expansion apparatus may provide support or back-up for any suitable flow barrier or seal element in the fluid conduit. This may function to improve the integrity of the fluid barrier or seal, and/or enable a reduction in the axial length of the seal element or flow barrier without compromising its functionality.

Furthermore, the slip assembly applications of the present disclosure as described in the foregoing embodiments may be used to anchor any of a wide range of tools in the wellbore, and are not limited to bridge plug applications. For example, the slip assemblies may be used to anchor drilling, milling or cutting equipment; perforating gun assemblies; or intervention tools deployed by wireline or other flexible conveyance systems.

The embodiments described herein also have benefits in creating a seal and/or filling an annular space, and an example application will be described with reference to FIGS. 13A to 14D, in which the embodiments are applied to a downhole locking tool. A typical locking tool uses one or more radially expanding components deployed on a running tool. The radially expanding components engage with a pre-formed locking profile at a known location in the wellbore completion. A typical locking profile and locking mechanism includes a recess for mechanical engagement by the radially expanding components of the locking tool. A seal bore is typically provided in the profile, and a seal on the locking tool is designed to seal against the seal bore. The present embodiment provides benefits over conventional locking mechanisms as will be apparent from the description below.

Figure 13A:
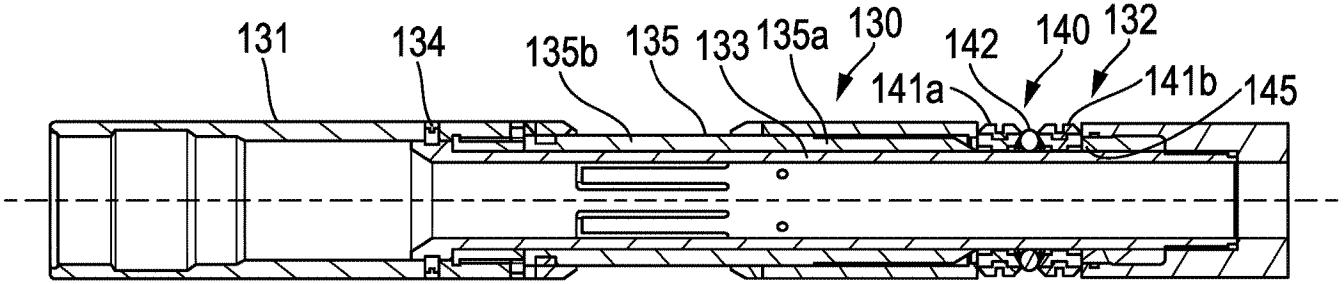
FIGS. 13A through 13D are respectively first sectional, second sectional, isometric, and cross sectional views of a lock apparatus, shown in a run position.
Figure 13B:
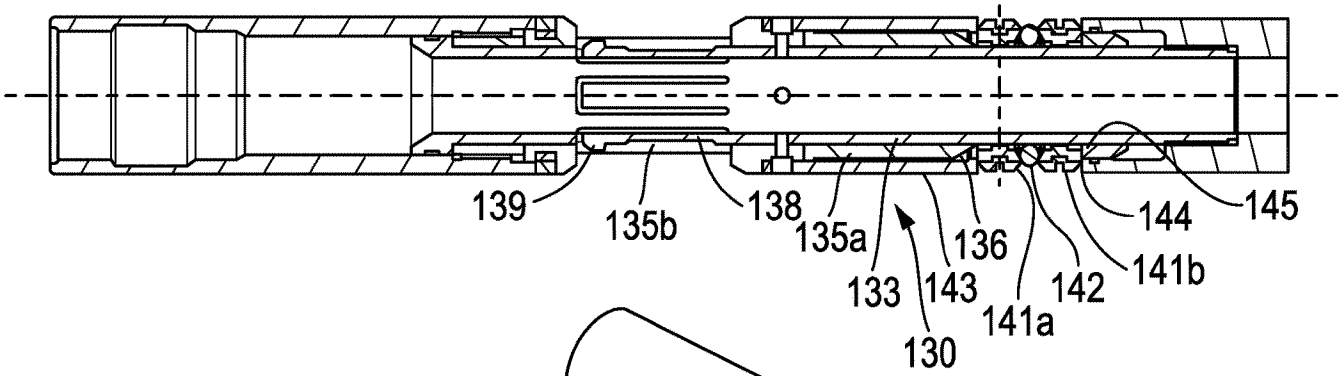
Figure 13C:
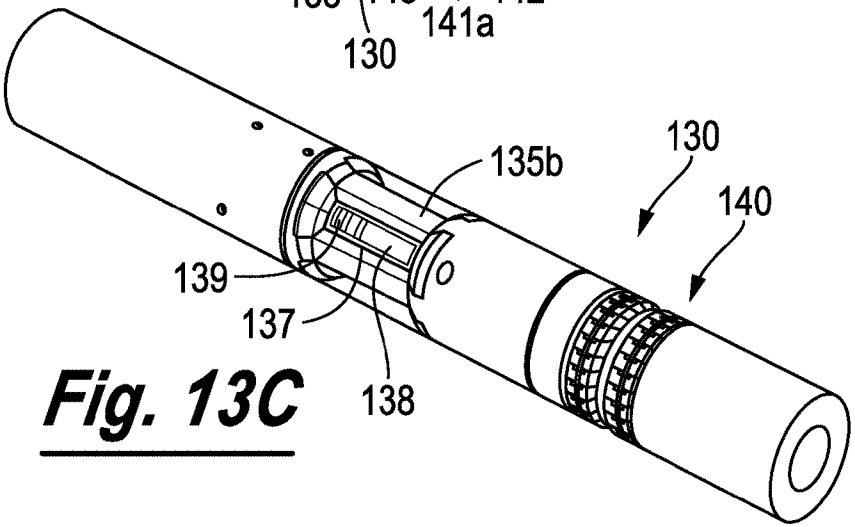
Figure 13D:
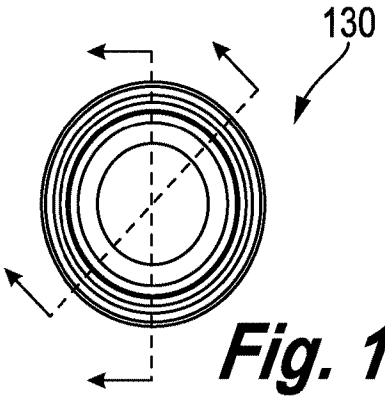
Figure 14A:
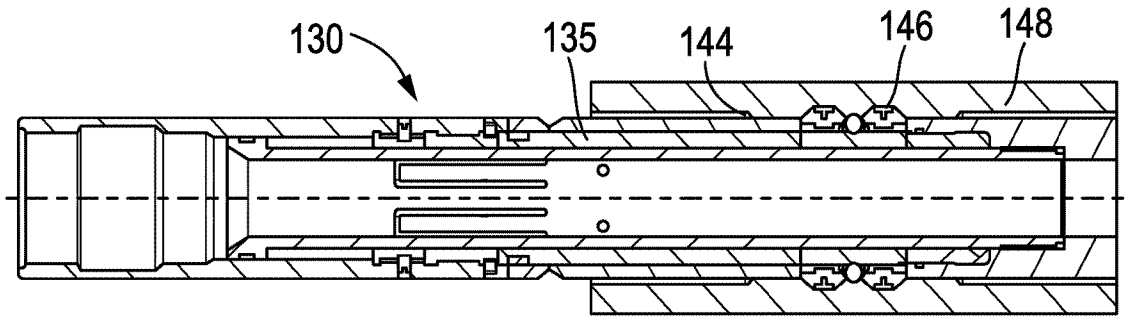
FIGS. 14A through 14D are respectively first sectional, second sectional, isometric, and cross sectional views of the apparatus of FIGS. 13A through 13D, shown in a set position.
Figure 14B:
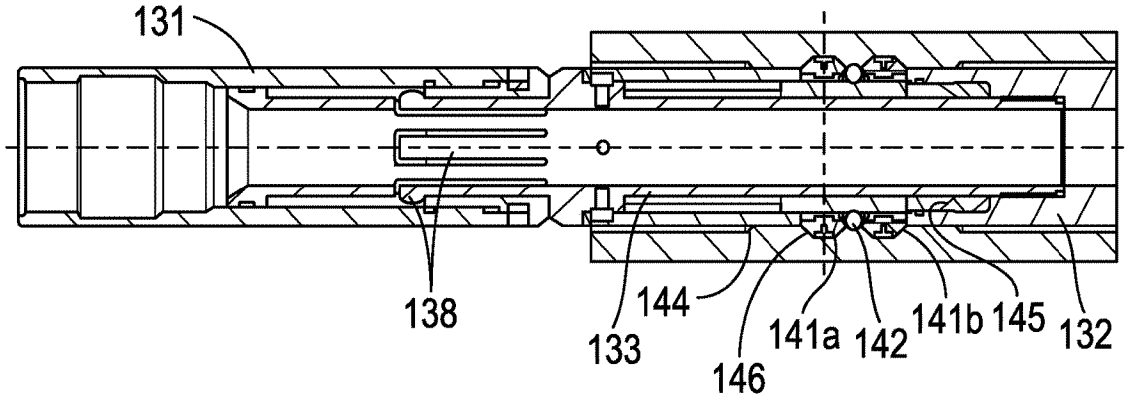
Figure 14C:
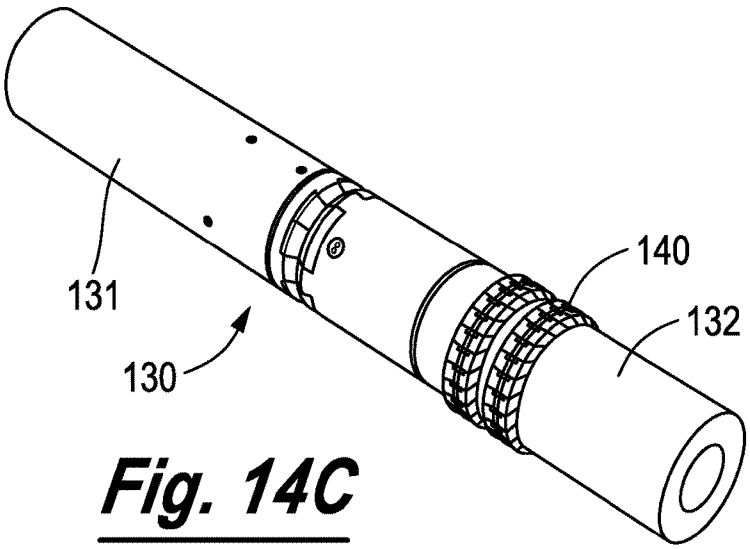
Figure 14D:
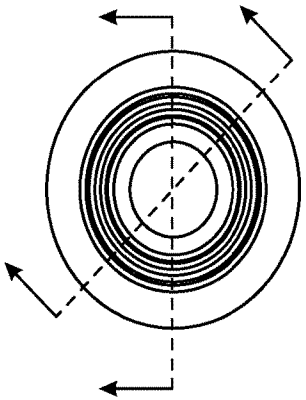

FIGS. 13A and 13B are first and second longitudinal sectional views through a locking tool according to an embodiment of the present disclosure. FIG. 13C is an isometric view of a locking tool, and FIG. 13D is a cross section which shows the position of the longitudinal sections of 13A and 13B. In all of FIGS. 13A to 13D, the locking tool is shown in a run position. FIGS. 14A to 14D are equivalent views of the locking tool in a set position.

The locking tool, generally depicted at 130, comprises an upper housing 131, which provides an upper connecting profile, and a lower housing 132. In the run position, the upper and lower housings 131, 132 are assembled on a mandrel 133 in an axially separated position. The upper housing 131 is secured on the mandrel by a set of shear screws 134.

An actuation sleeve 135 is disposed on the mandrel 133, and connects the upper housing with the lower housing. A lower part 135*a* of the actuation sleeve is cylindrical, and a lower end of the actuation sleeve is provided with a conical wedge profile 136. An upper part 135*b* of the actuation sleeve has part cylindrical sections removed, such that only parts of the actuation sleeve, circumferentially separated around the sleeve, extend to its upper end and engage with the upper housing. Windows 137 formed by removing part sections of the actuation sleeve correspond to the locations of detent fingers 138 of the mandrel 133, and accommodate radially extending formations 139 at the end of the detent fingers.

The locking tool also comprises a locking and sealing assembly, generally shown at 140, located in an annular space between first and second subs of the lower housing. The locking and sealing assembly is formed from two axially separated ring structures 141*a*, 141*b*, each formed from a plurality of elements. Disposed between upper and lower ring structures is an elastomeric seal 142 on a support. Individual elements assembled to form the ring structures are similar to the elements 12 and 63, and their form and function will be understood from FIGS. 1 to 4 and 8 and their accompanying descriptions. In particular, each element comprises a pair of planar contact surfaces which mutually supporting adjacent elements, and the contact surfaces are oriented on tangential planes.

In the run position, the ring structures 141*a*, 141*b* are flush with the immediately adjacent outer diameter of the outer housing. In an alternative configuration, the ring structures may be recessed with respect to the outer housing, such that they have a reduced outer diameter. The outer diameter of the seal element is less than the outer diameter of the ring structures in their retracted position, such that the elastomeric seal element is recessed in the tool.

Operation of the locking tool will now be described with additional reference to FIGS. 14A to 14D. The locking tool 130 is run into the wellbore to a location in the completion which comprises a locking profile, generally shown at 148. The locking and sealing assembly 140 is positioned so that it is aligned with a locking recess 146 in the locking profile. Alignment of the locking and sealing assembly with the locking profile is ensured by the provision of a no-go profile 143 on the lower housing assembly, and a corresponding no-go profile 144 on the completion at a defined axial separation from the locking profile.

With the locking tool in position and the no-go profile engaged, a downward force imparted on the upper housing 131 is transferred to the actuation sleeve 135. The lower housing 132 and mandrel 133 is held up by the no-go, and the shear screws 134 shear, enabling the actuation sleeve to move downwards relative to the lower housing until the wedge profile 136 of the actuation sleeve is brought into contact with the upper ring structure 141*a*. The downward movement of the actuation sleeve imparts an axial force which is transferred through the elastomeric seal element 142 and to the lower ring structure 141*b*, to axially compress the locking and sealing assembly 140 against a shoulder 144 defined by the lowermost housing sub. As described with reference to previous embodiments, the wedge profiles direct a component of the axial force in a radially outward direction, to force the elements of the upper ring structure to a radially outward position. The actuation sleeve passes under the upper ring structure so that it is fully deployed, and subsequently forces the elastomeric seal and its support radially outward. The actuation sleeve continues downward movement to engagement with the lower ring structure, forcing its elements to a radially outward position, and into engagement with the locking profile.

The actuation sleeve 135 continues to move downwards through the housing until it reaches an abutment surface of an o-ring seal protection collar 145 which has a shape corresponding to the wedge profile 136. The o-ring seal protection collar 145 is moved off-seat to complete the sealing mechanism of the lock, with the o-ring sealing on the outer diameter of the actuation sleeve. A continued downward force causes the upper housing to move with respect to the mandrel, until detent fingers 138 on the mandrel engage with a corresponding profile in the upper housing. The detent fingers 138 are configured such that if the lock is not fully set, they will present an obstacle in the bore through the mandrel. This enables verification, for example with a drift tool that the locking mechanism is in a fully set position. Engagement of the detent fingers prevents the upper and lower housings from being separated, which would enable the actuation sleeve to be withdrawn and the locking mechanism to be retracted. The locking mechanism is therefore locked into engagement with the locking profile.

One advantage of the locking mechanism described with respect to FIGS. 13A to 14D is that the locking mechanism is provided with an integrated seal element, and does not require a seal assembly at an axially separated point. This enables a reduction in the length of the tool. The integrated seal is surrounded at its upper and lower edges by the surfaces of the ring structures, which avoid extrusion of the seal.

In addition, each of the ring structures provides a smooth, unbroken circumferential surface which engages the locking recess, providing upper and lower annular surfaces in a plane perpendicular to the longitudinal axis of the bore. This annular surface is smooth and unbroken around the circumference of the ring structures, and therefore the lock is in full abutment with upper and lower shoulders defined in the locking profile. This is in contrast with conventional locking mechanisms which may only have contact with a locking profile at a number of discrete, circumferentially-separated locations around the device. The increased surface contact provided by this embodiment enables a locking mechanism which can support larger axial loads being directed through the lock, and therefore the lock can be rated to a higher maximum working pressure. Alternatively, an equivalent pressure rating can be provided in a lock which has reduced size and/or mass.

Another advantage of this embodiment is that the seal bore (i.e., the part of the completion with which the elastomer creates a seal) can be recessed in the locking profile. In this embodiment, the inner diameter of the locking profile on either side of the lock recess 146 is less than the inner diameter of the seal bore. The benefit of this configuration is that the seal bore is protected from the passage of tools and equipment through the locking profile. This avoids impact with the seal bore which would tend to damage the seal bore, reducing the likelihood of reliably creating a successful seal.

In the foregoing embodiment, the benefits of the principles of the present disclosure to a downhole locking mechanism are described. Similar benefits may be delivered in latching arrangements used in connectors, such as so called "quick connect" mechanisms used for latched connection of tubular components. Such an example application will be described with reference to FIGS. 15A to 16C.

Figure 15A:
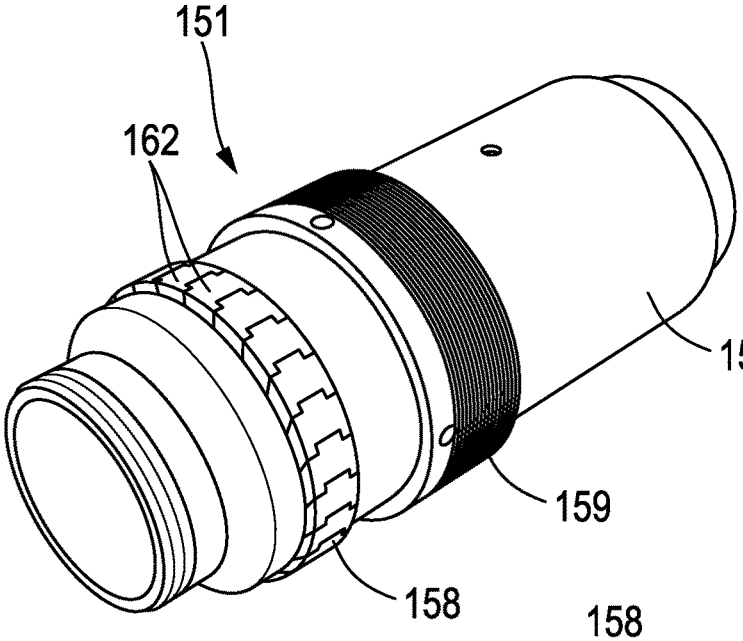
FIGS. 15A through 15D are respectively perspective, perspective cut-away, sectional and cross-sectional views of a quick connect apparatus, shown in a lock out position.
Figure 15D:
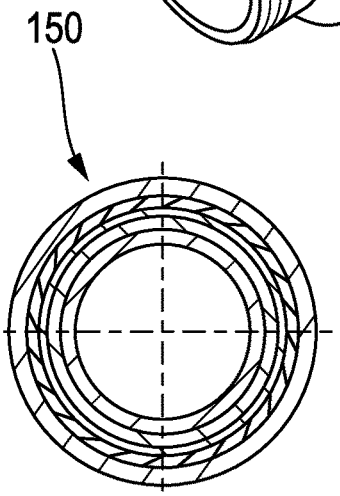
Figure 15B:
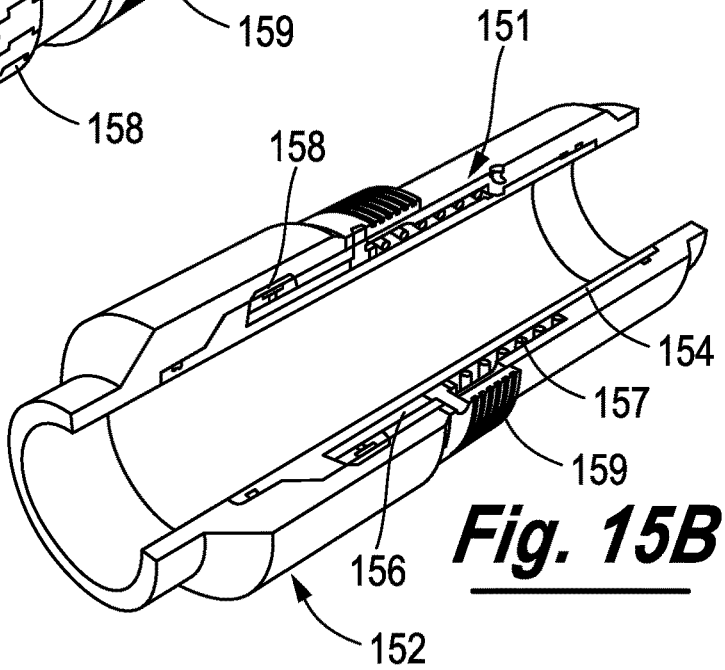
Figure 15C:
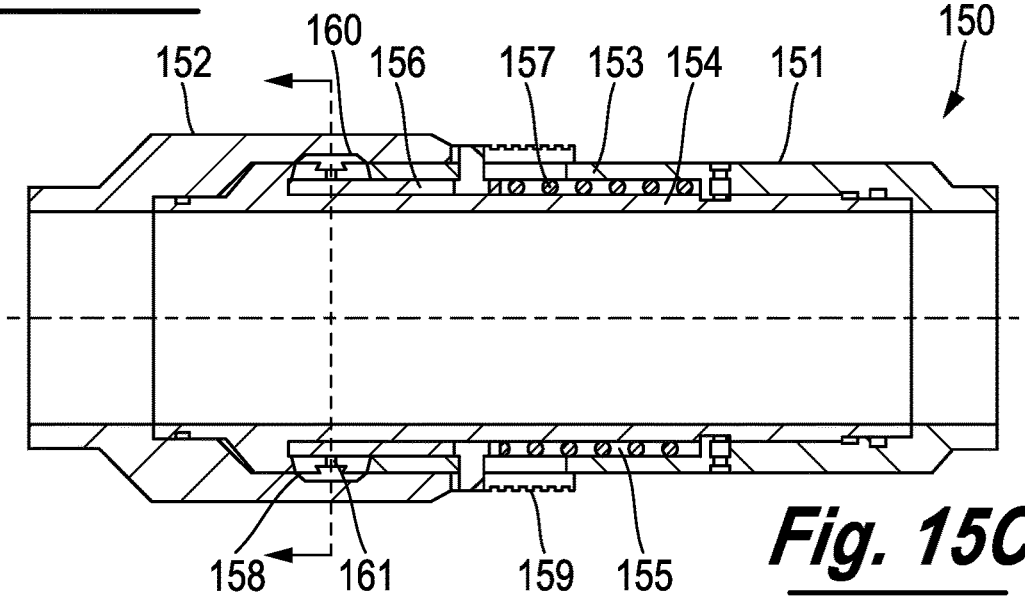
Figure 16A:
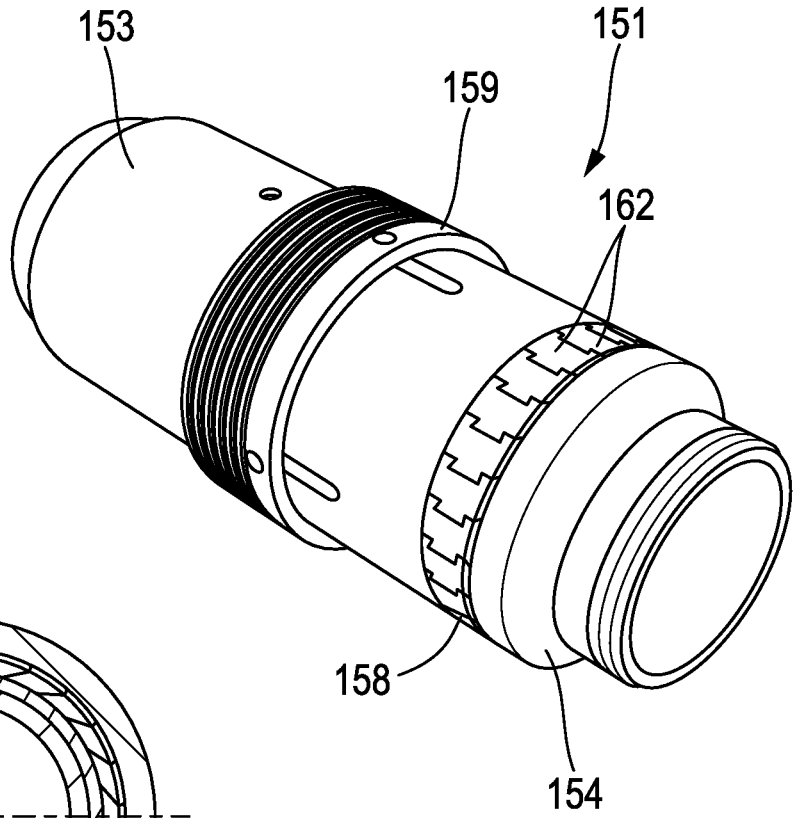
FIGS. 16A through 16C are respectively perspective, sectional and cross-sectional views of the apparatus of FIGS. 15A through 15D, shown in a release position.
Figure 16C:
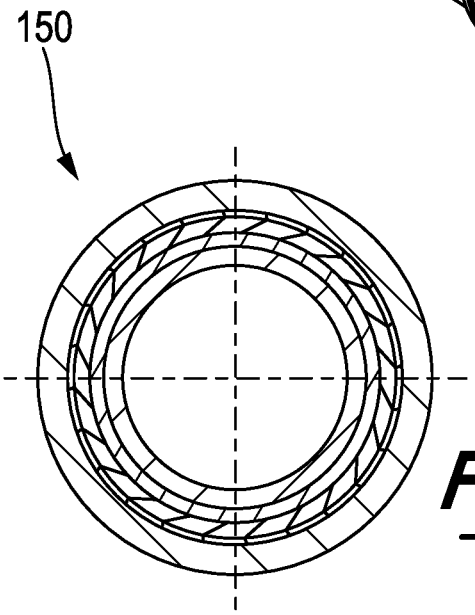
Figure 16B:
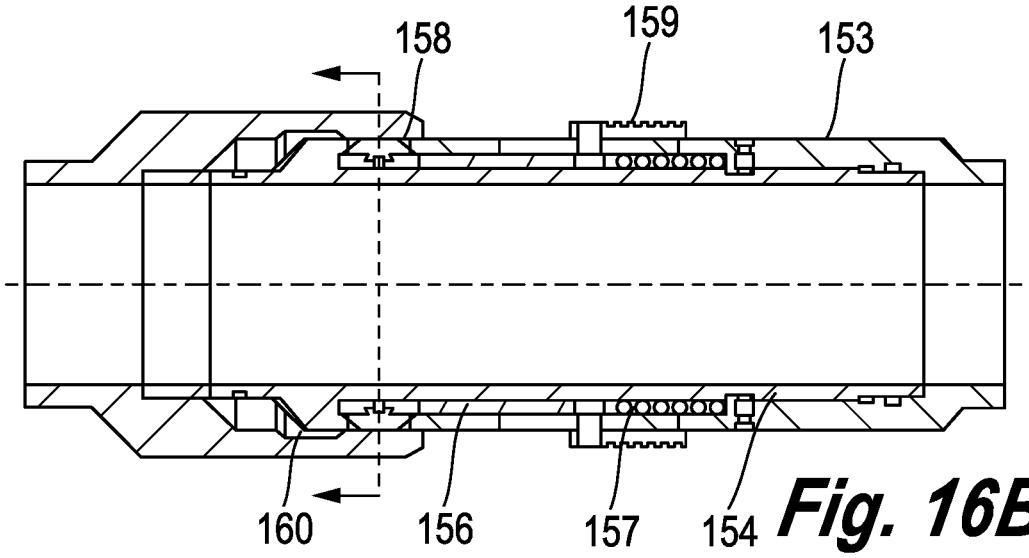

The connection system, generally shown at 150, comprises a male connector 151 and a female connector 152. FIG. 15A is an isometric view of a male connector of a connection system according to an embodiment of the present disclosure, and FIG. 15B to 15D are respectively partially cut away isometric, longitudinal section and cross sectional views of an assembled pair of the male connector and a female connector according to an embodiment of the present disclosure. All of FIGS. 15A to 15D show the apparatus in an expanded condition. FIGS. 16A to 16C are equivalent views which show the connection apparatus in a collapsed release condition.

The male connector 151 comprises an outer housing 153 disposed over an inner mandrel 154 which defines a throughbore through the connector. The female connector 152 comprises a throughbore, which is continuous with the throughbore of the inner mandrel. A first end of the inner mandrel is sized to fit into an opening in the female connector.

The outer housing 153 partially surrounds the mandrel 154, and over a portion of its length has a throughbore formed to an inner diameter larger than the outer diameter of the mandrel, such that an annular space 155 is formed between the inner mandrel and the outer housing when the two are assembled together. The annular space between the outer housing and the inner mandrel accommodates a support sleeve 156 and a biasing means in the form of a coil spring 157. The spring 157 functions to bias the support sleeve to a position in which it is disposed under an expansion apparatus 158 which forms a latching ring for the connection system. An inner surface of the expansion apparatus is supported on the outer surface of the support sleeve. The support sleeve is also mechanically coupled to an external sleeve 159, disposed on the outside of the outer housing by pins extending through axially oriented slots in the outer housing.

The female connector 152 also comprises an annular recess 160 which is sized and shaped to receive the expansion apparatus in a latched position. The annular recess is profiled with chamfered edges, to correspond to the inclined surfaces at the outside of the expansion apparatus 158.

The expansion apparatus 158 of this embodiment is similar to the expansion apparatus described with reference to previous embodiments, and is assembled from multiple elements 162. However, a significant difference is that the expansion apparatus 158 is biased towards an expanded condition to provide a latching ring for the connection system. This is achieved by the provision of grooves on the inner surfaces of the elements which make up the ring structure, to accommodate a circumferential spring element 161. The circumferential spring element 161 supports the elements of the ring in their optimum concentric state, which in this case is their radially expanded position.

The profile of the elements is such that they are wider at their inner surface than their outer surface, and wider than the tapered groove through which the ring structure extends. This prevents the elements of the ring structure from being pushed out of the male connector by the circumferential spring element when the system is disconnected.

A disconnection of the connection system 150 will now be described, with additional reference to FIGS. 16A to 16C. FIGS. 15A to 15D show the default, normally expanded position of the connector system 150 and its expansion apparatus 158. The circumferential spring element of the expansion apparatus biases the elements outward into the position shown at FIG. 15A, and they are radially supported in that position by the support sleeve. The external sleeve 159 allows the support sleeve 156 to be retracted against the biasing force of the spring 157. Withdrawal of the support sleeve 156 from beneath the expansion apparatus 158 enables the ring to be collapsed to a reduced radial position, shown in FIGS. 16A to 16C. The presence of the circumferential spring element 161 retains the elements in an outward expanded condition, but with the support sleeve 156 retracted, an axial force which acts separate the male and female parts of the connector will impart an axial force on the elements of the ring structure, via the chamfered edges of the recess 160. The profile of the recesses and the elements directs a radial force component which tends to cause the elements to collapse against the force of the spring element. The elements are collapsed to a reduced diameter position which allows the male and female connectors to be separated. When the expansion apparatus is clear of the female connector, the force of the spring element will tend to expand the elements to their radially expanded positions. Releasing the external sleeve will position the support sleeve under the ring structure to support it in the expanded condition.

To connect the connectors of the connection system, the external sleeve is retracted to withdraw the support sleeve from beneath the elements. An axial force which inserts the male connector into the female connector causes the elements to be brought into abutment with a shoulder at the opening of the female connector. The inclined surface of the ring element radially collapses the elements against the force of the circumferential spring element, until the ring structure is able to pass through the bore opening to the latching position. When the ring structure is aligned with the recess, the circumferential spring element pushes the elements into the recess. Release of the external sleeve positions the support sleeve beneath the ring element and the connector is latched.

In its latched position and when in operation, a raised internal pressure in the throughbore of the connection system acts to radially compress and clamp the male connector, the support sleeve, and the ring structure together. This resists or prevents retraction of the external sleeve and support sleeve, maintaining the connection in a failsafe latched condition.

A significant advantage of the connection system of this embodiment is that the expansion apparatus forms a solid and smooth ring in its expanded latched position. An arrangement of radially split elements would, when expanded, form a ring with spaces between elements around the sides. In contrast, the provision of a continuous engagement surface which surrounds the expansion ring and provides full annular contact with the recess provides a latch capable of supporting larger axial forces, and therefore the connection system can be rated to a higher maximum working pressure. In addition, the by minimizing or eliminating gaps between elements, the device is less prone to ingress of foreign matter which could impede the collapsing action of the mechanism.

The principles of the connection system of this embodiment may also be applied to subsea connectors such as tie-back connectors. In alternative embodiments, the external sleeve for retracting the support sleeve may be hydraulically actuated, rather than manually as shown in the described embodiments.

The principles of the present disclosure may be extended to multi-stage or telescopic expansion apparatus, which have applications to systems in which an increased expansion ratio is desirable. The following embodiments describe examples of such apparatus.

Figure 17A:
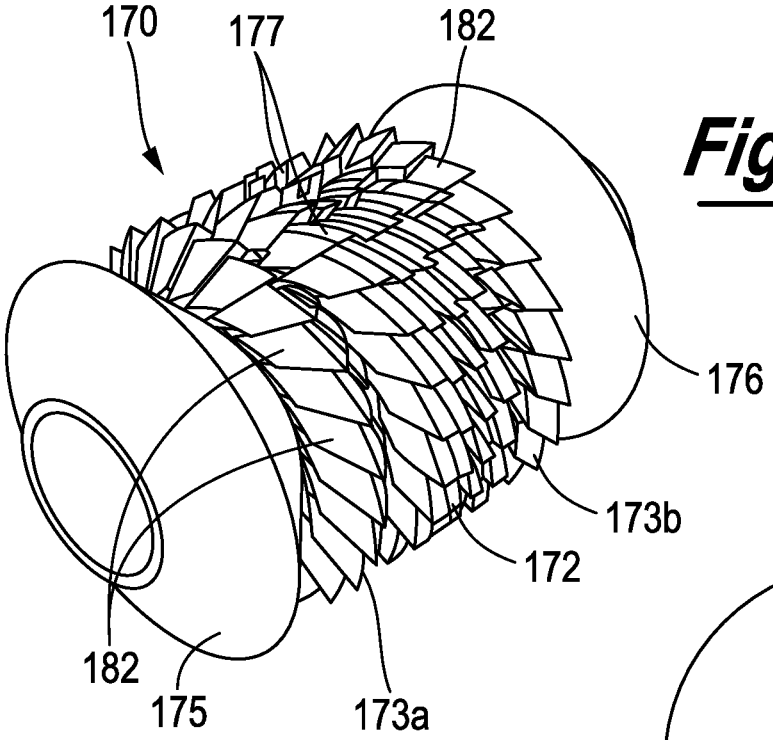
FIGS. 17A through 17C are respectively perspective, sectional and end views of an apparatus, shown in a collapsed condition.
Figure 17C:
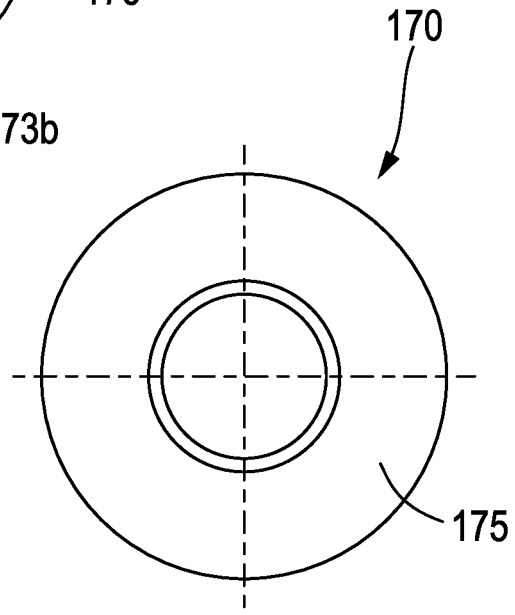
Figure 17B:
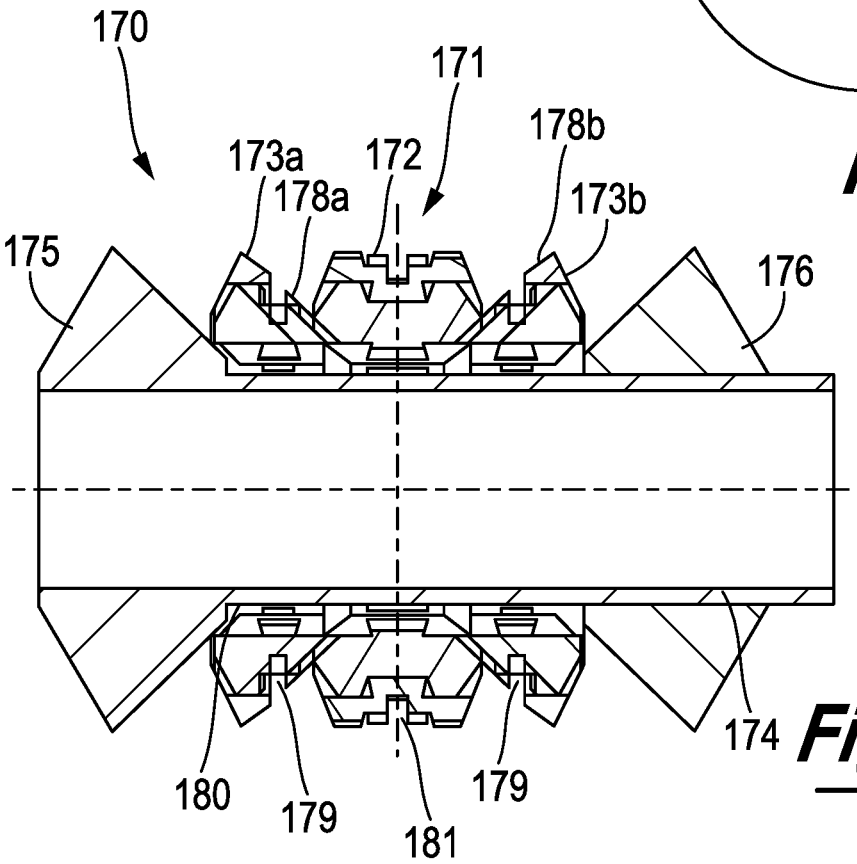
Figure 18A:
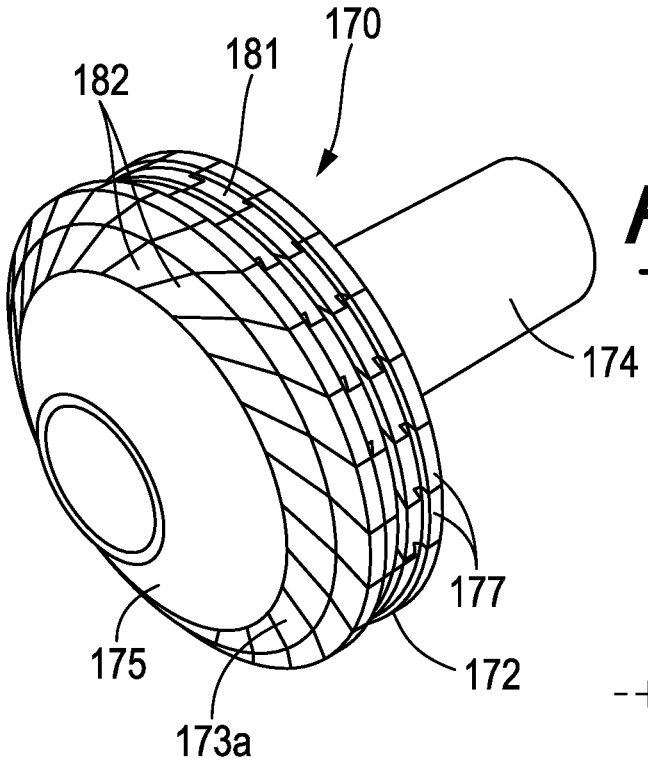
FIGS. 18A through 18C are respectively perspective, sectional and end views of the apparatus of FIGS. 17A through 17C, shown in an expanded condition.
Figure 18C:
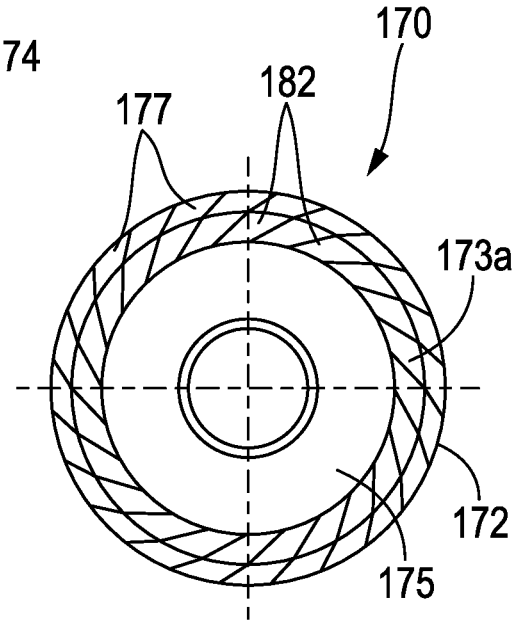

Referring firstly to FIGS. 17A to 18C, there is shown a two-stage expansion apparatus in accordance with an embodiment of the present disclosure. FIGS. 17A to 17C are respectively perspective, longitudinal sectional, and end views of the apparatus in a first, collapsed condition. FIGS. 18A to 18C are equivalent views of the apparatus in an expanded condition. The apparatus, generally depicted at 170, comprises an expansion assembly 171 formed from three ring structures 172, 173*a*, 173*b*, each of which is formed from separate elements in the manner described with reference to FIGS. 1 to 4. The ring structures 172, 173*a*, 173*b* are disposed on a mandrel 174 between a wedge portion 175 which is fixed on a mandrel, and a moveable wedge member 176. A center ring structure 172 is formed from a number of individual center elements 177 assembled together. The center elements 177 are similar to the elements 12 and 77 described with reference to previous embodiments. FIG. 19 is a geometric representation of a center element of the apparatus of FIGS. 17A to 17C, shown from one side, and FIGS. 20A to 20F are respectively first perspective, second perspective, plan, first end, lower, and second end views of a center element 177. The figures show the inner and outer surfaces, first and second contact surfaces, interlocking profiles, and grooves for retaining circumferential springs which are equivalent in form and function to the features of the elements 12 and 77. Biasing means in the form of a circumferential spring retains the center ring structure in its collapsed condition.

Disposed on either side of the center ring structure are first and second outer ring structures 173*a*, 173*b* in the form of wedge ring structures. The wedge ring structures are also assembled from an arrangement of elements which, again, are similar in form and function to the elements 12 and 77. However, instead of providing an outer surface which is substantially parallel to the longitudinal axis of the apparatus, the outer surfaces of the outer elements are inclined to provide respective wedge surfaces 178*a*, 178*b* which face the center ring structure 172.

Figure 21:
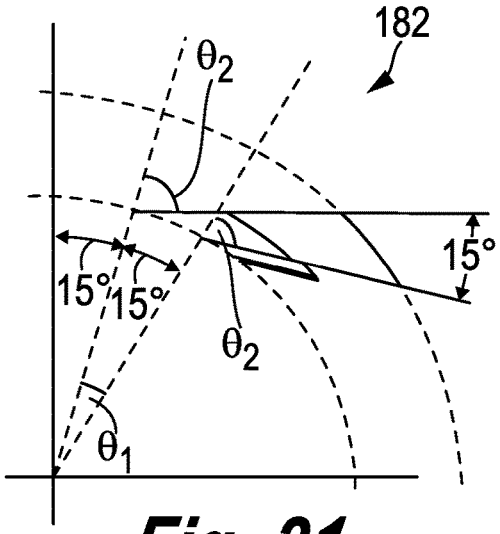
FIG. 21 is a geometric representation of an outer element of the apparatus of FIGS. 17A through 17C, shown from one side.
Figure 22A:
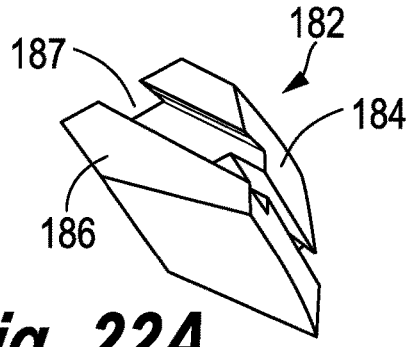
FIG. 22A through 22H are respectively first perspective, second perspective, third perspective, fourth perspective, plan, first end, lower, and second end views of an outer element of the apparatus of FIGS. 17A through 17C.
Figure 22B:
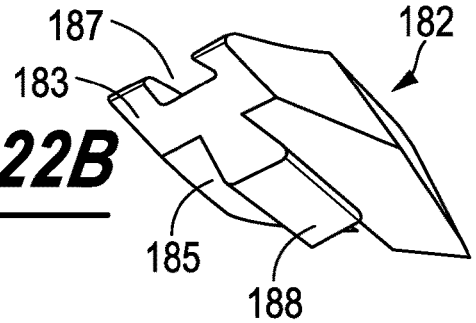
Figure 22C:
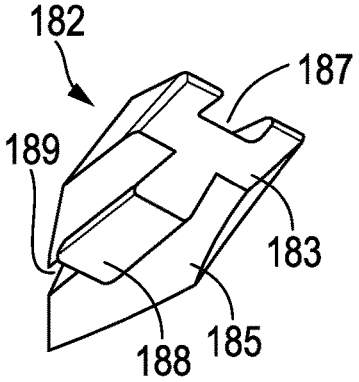
Figure 22D:
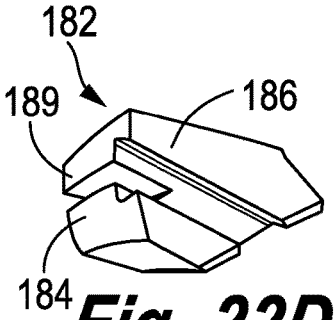
Figure 22E:
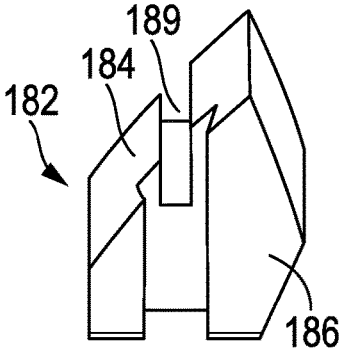
Figure 22F:
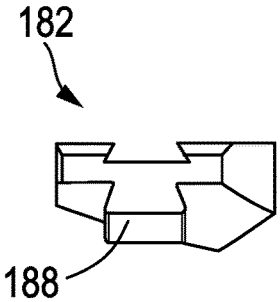
Figure 22G:
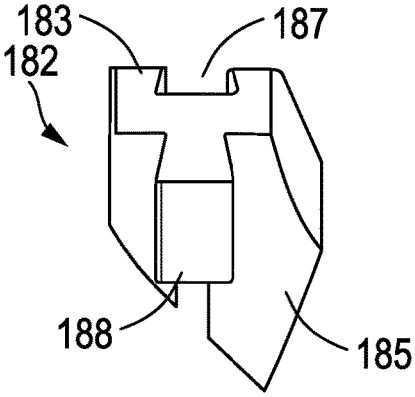
Figure 22H:
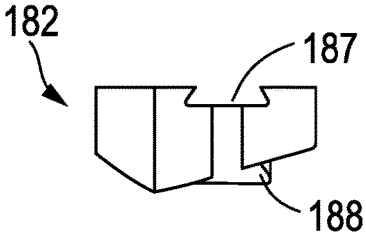

FIG. 21 is a geometric representation of an outer element 182 of the apparatus of FIGS. 17A to 17C, shown from one side, and FIGS. 22A to 22H are respectively first perspective, second perspective, third perspective, fourth perspective, plan, first end, lower, and second end views of an outer element 182. The figures show the inner and outer surfaces 183, 184, first and second contact surfaces 185, 186, interlocking profiles 187, 188, and grooves 189 for retaining circumferential springs which are equivalent in form and function to the features of the elements 12 and 77. In the assembled ring structure, the outer elements and the center elements are nested with one another, and the outer surfaces 184 of the outer elements define respective wedge profiles for corresponding center elements 177 during a first expansion stage as will be described below. Biasing means in the form of a circumferential spring retains the outer rings structure in their collapsed conditions, with the sequencing of the expanding and collapsing movement controlled by the selection of the relative strengths of the biasing means of the center ring and the outer rings.

In a first, collapsed condition, the elements of the center ring structure and the elements of the first and second outer ring structures, have a maximum outer diameter which is less than or equal to the outer diameter of the wedge profile 175 and wedge member 176.

Operation of this embodiment of the apparatus will be described, with additional reference to FIGS. 18A to 18C.

In common with other embodiments, the apparatus is actuated to be radially expanded to a second diameter by an axial actuation force which moves the cone wedge member 176 on the mandrel and relative to the ring structure. The axial actuation force acts through the ring structures 173*a*, 173*b* to impart axial and radial force components onto the elements. Radial expansion of the ring structures 173*a*, 173*b* is resisted by their respective circumferential springs arranged in grooves 179, and the forces are transferred to the center ring structure 172. The elements of center ring experience an axial force from the wedge surfaces 178*a*, 178*b* of the elements of the outer ring structures, which is translated to a radial expansion force on the elements of the center ring structure 172. The radial expansion force overcomes the retaining force of a circumferential spring in the groove 181 (which is selected to be weaker than the retaining forces of the circumferential springs in the outer rings), and the elements slide with respect to one another to expand the center ring structure as the outer ring structures move together.

The pair of outer rings is brought together until the elements of the center ring structure are expanded on the wedge profiles of the outer elements. In this condition, the first expansion stage is complete, but the center ring is not yet expanded to its optimum outer diameter.

The elements of the wedge ring structure 173*a*, 173*b* are symmetrical about a center line of the ring structure, and are configured to be brought into abutment with one another under a central line under the center segments. This design defines an end point of the axial travel of an outer ring structure, and prevents its elements from over-travelling. This abutment point changes the mode of travel of an outer ring from axial displacement (during which it expands an adjacent ring which is disposed towards the center of the apparatus by a wedging action) into a tangential sliding movement of elements within the ring, to cause it to expand radially on the apparatus.

The outer ring structures 173*a* and 173*b* have been brought together into abutment, and further application of an axial actuation force causes the elements of the respective outer ring structures to experience a radial force component from the wedge 175 and the wedge profile 176. The radial force directs the elements of the outer ring structures to slide with respect to one another into radially expanded conditions. The radial movement of the elements of the outer rings is the same as the movement of the elements of the center ring structure and the elements described with reference to previous embodiments: the elements slide with respect to one another in a tangential direction, while remaining in mutually supportive planar contact. As the outer ring structures expand, a radial force is imparted to the elements of the center ring, which continue to slide with respect to one another in a tangential direction to their fully expanded condition.

Figure 18B:
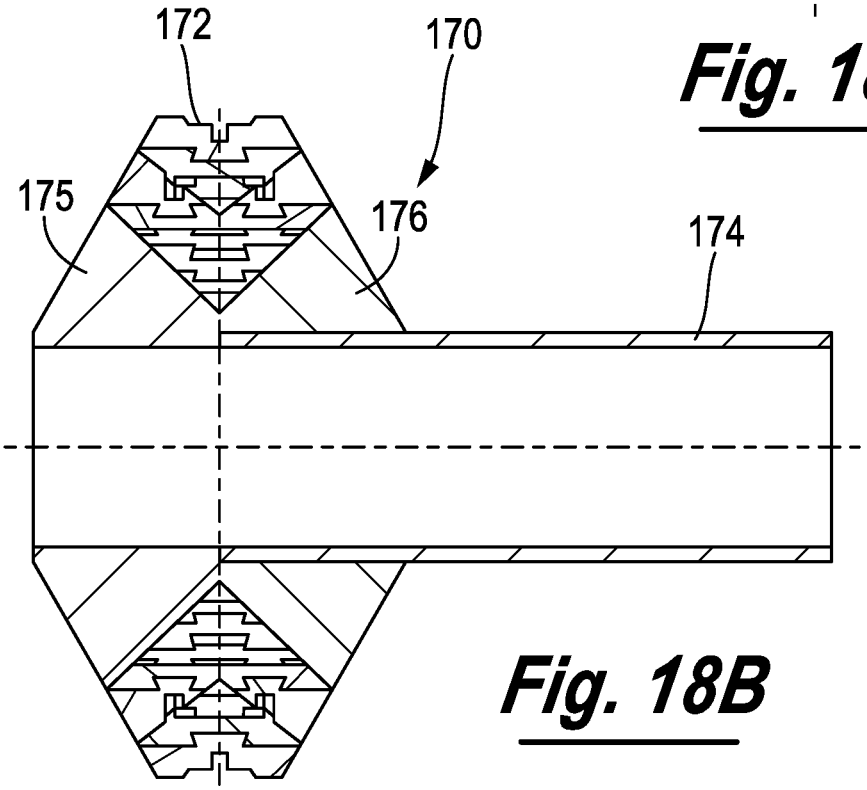
Figure 19:
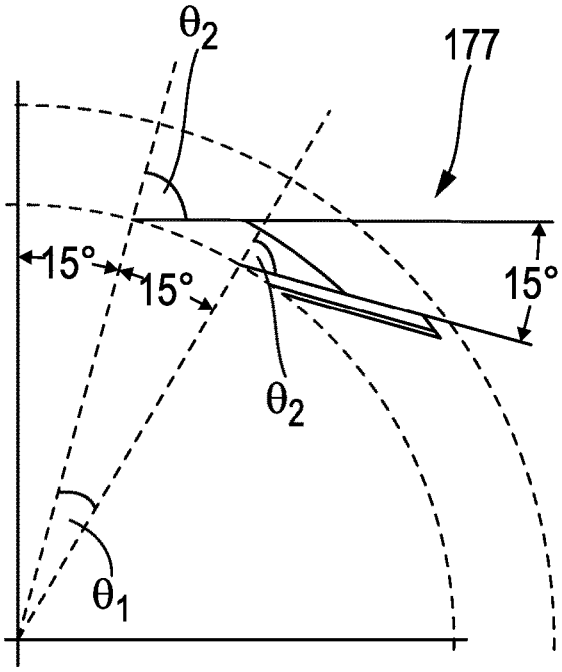
FIG. 19 is a geometric representation of a center element of the apparatus of FIGS. 17A through 17C, shown from one side.
Figure 20A:
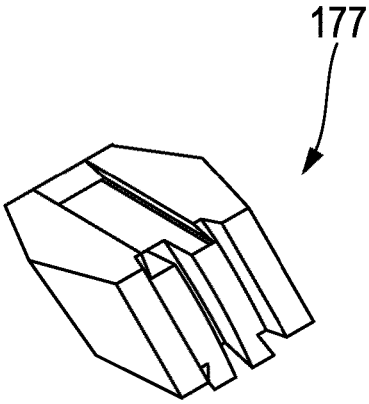
FIGS. 20A through 20F are respectively first perspective, second perspective, plan, first end, lower, and second end views of a center element of the apparatus of FIGS. 17A through 17C.
Figure 20B:
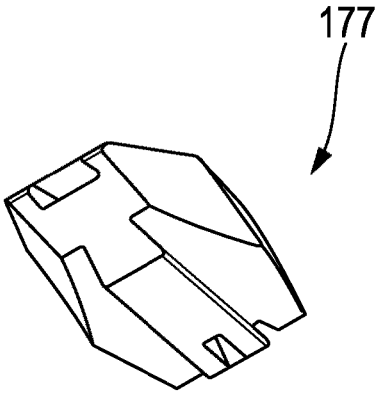
Figure 20C:
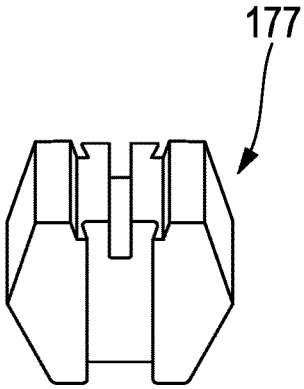
Figure 20D:
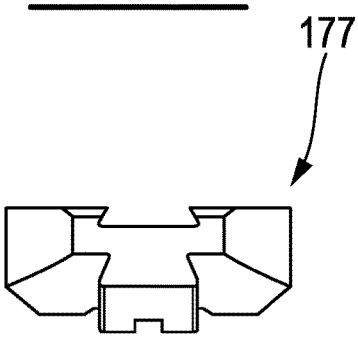
Figure 20E:
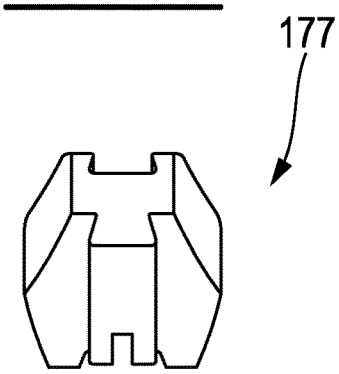
Figure 20F:
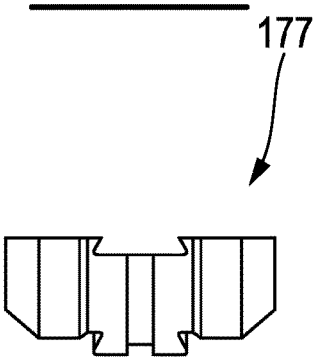

The resulting expanded condition is shown in FIGS. 18A to 18C. The apparatus forms an expanded ring structure which is solid, with no gaps between its elements, and which has a smooth circular outer surface at its full expanded condition. In addition, both of the annular surfaces or flanks of the expanded ring are smooth. The outer diameter of the expanded ring is significantly greater than the outer diameter of the ring structures (and wedges) in their collapsed state, with the increased expansion resulting from the two stage mechanism.

Collapsing of the apparatus to a collapsed condition is achieved by releasing the axial actuation force. The sequence of collapsing is the reverse of the expanding process: the outer ring structures are collapsed first under the higher retaining forces of their respective biasing springs. Collapse of the outer rings also brings the center ring structure from is fully expanded condition to an intermediate condition. Further separation of the wedge profiles collapses the center ring structure under the retaining force of its biasing spring, back to the collapsed position shown in FIGS. 17A and 17B.

Figure 23C:
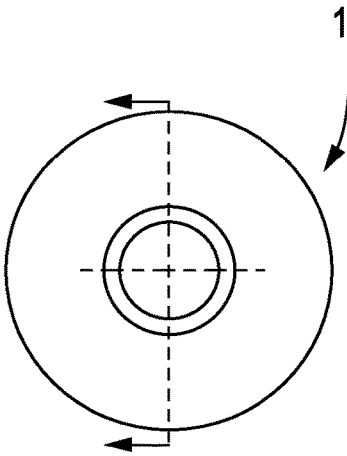
FIGS. 23A through 23C are respectively perspective, sectional and end views of an apparatus, shown in a collapsed condition.
Figure 23A:
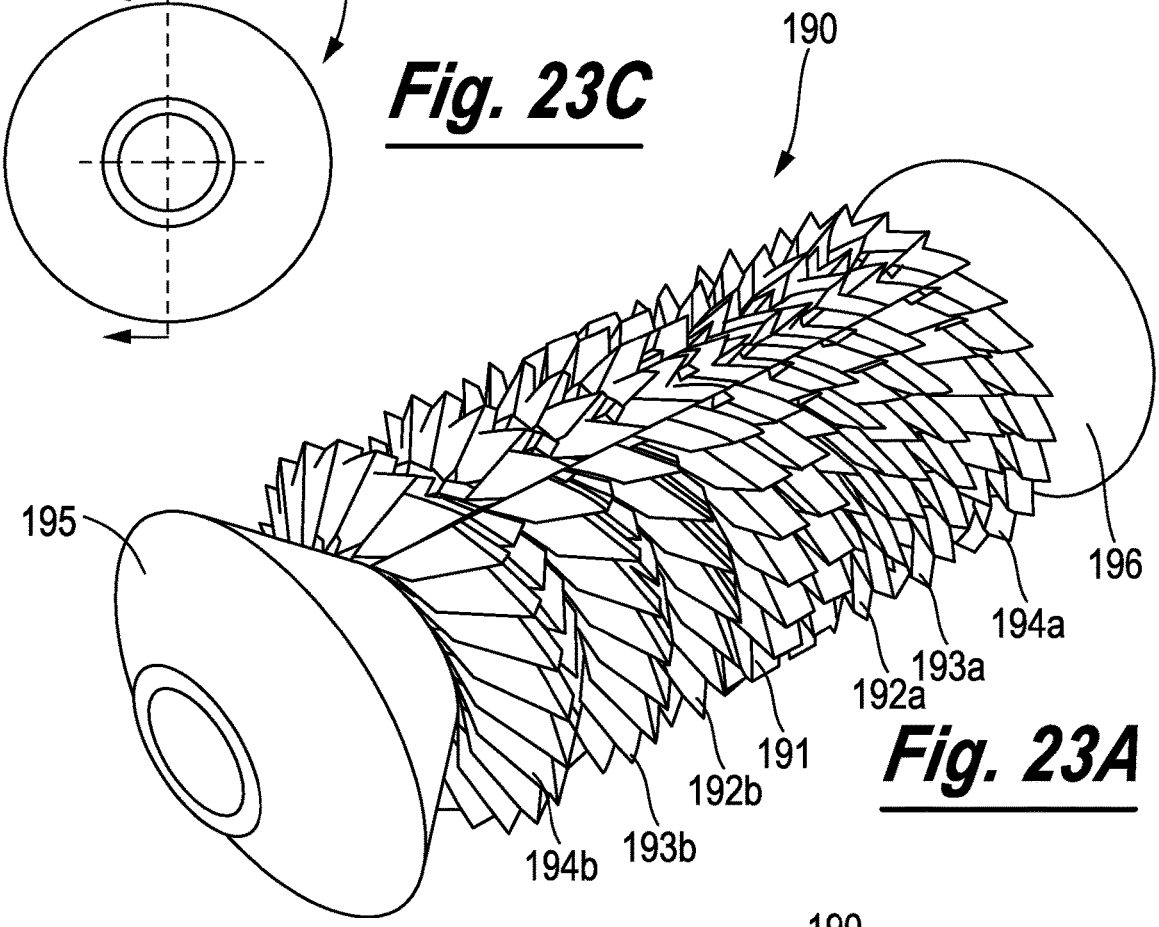
Figure 23B:
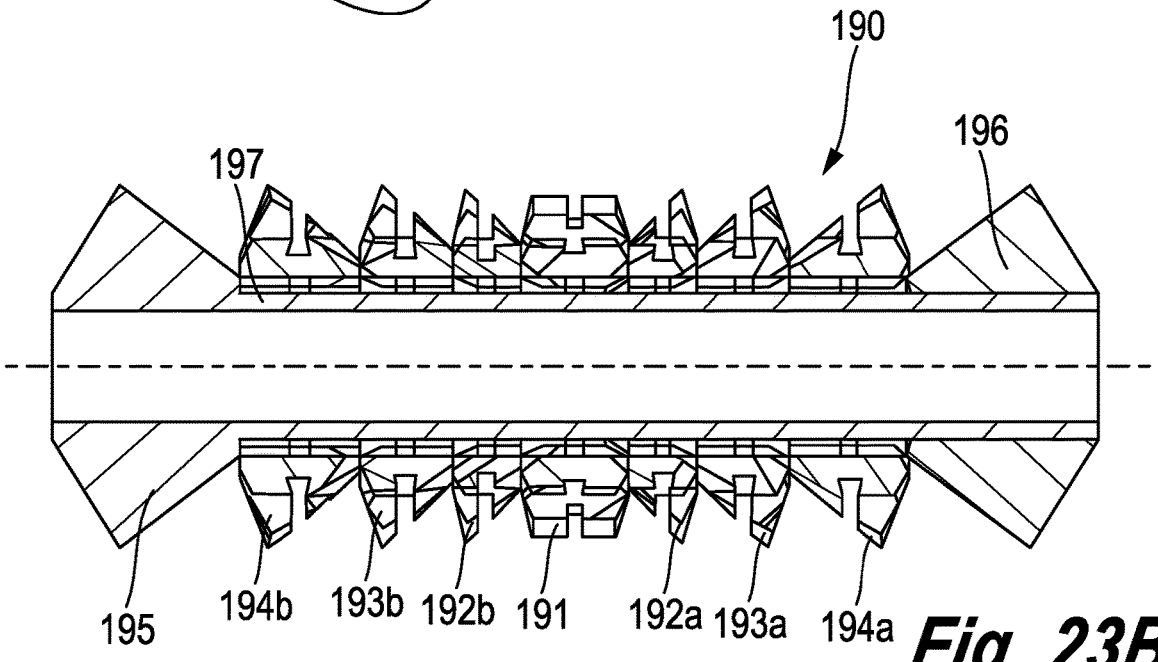

The principles of the two-stage expansion mechanism can be extended to other multi-stage expanding and collapsing apparatus. FIGS. 23A to 24C show such an apparatus, which has a four-stage expansion system. FIGS. 23A to 23C are respectively perspective, longitudinal sectional, and end views of the apparatus in a first, collapsed condition. FIGS. 18A to 18C are equivalent views of the apparatus in an expanded condition. The apparatus, generally shown at 190, is similar to the apparatus 170, and its form and function will be understood from FIGS. 17 and 18 and the accompanying description. However, the apparatus 190 differs in that it comprises a center ring structure 191 formed from individual elements, and three pairs of outer ring structures 192, 193, 194 (each consisting of upper and lower ring structures 192*a*, 192*b*, 193*a*, 193*b*, 194*a*, 194*b*) disposed on a mandrel 197 between wedge 195 and wedge profile 196.

Figure 24A:
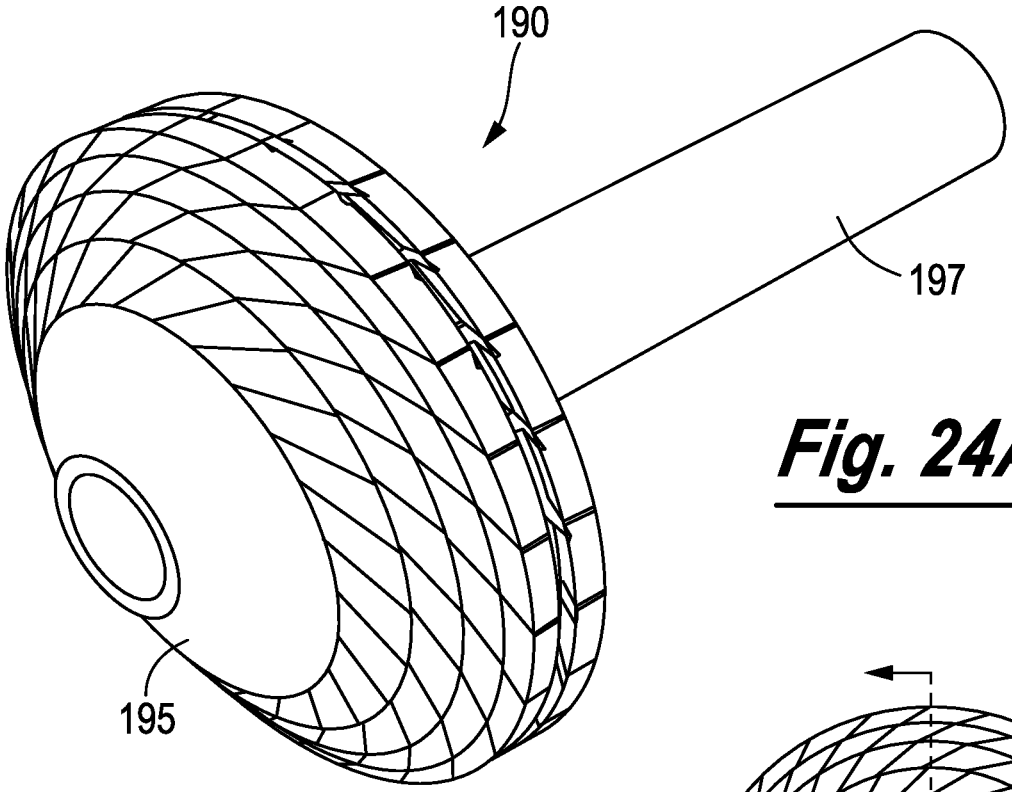
FIGS. 24A through 24C are respectively perspective, sectional and end views of the apparatus of FIGS. 23A through 23C, shown in an expanded condition.
Figure 24C:
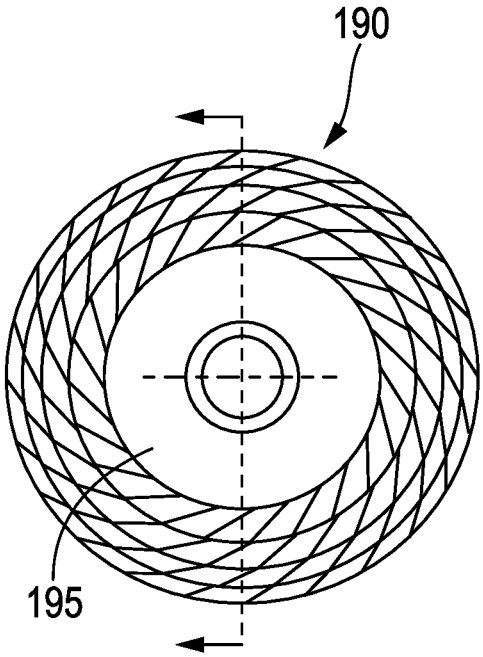
Figure 24B:
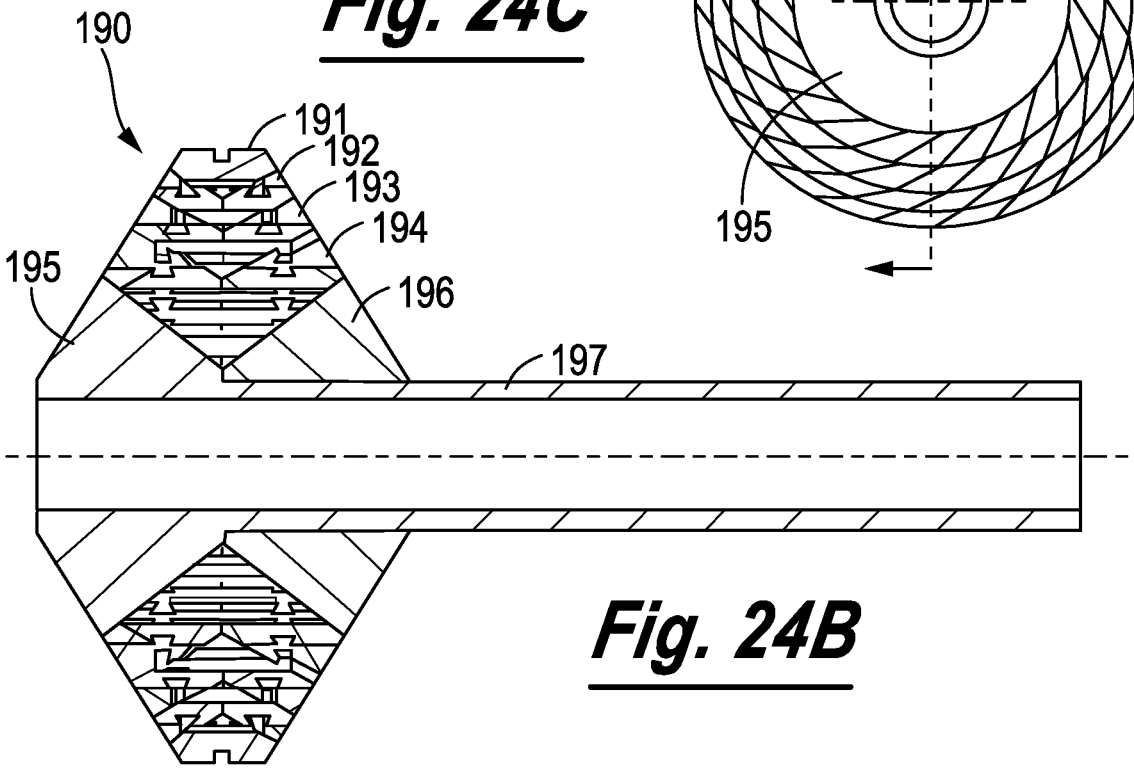

In successive stages of actuation, the center ring structure 191 is deployed to a first intermediate expanded state, and first, second, and third pairs of outer ring structures are deployed to their radially expanded states, from the inside of the apparatus adjacent to the center ring, to the outside. At each stage, the center ring structure is deployed to successive intermediate expanded states, until it is fully expanded as shown in FIGS. 24A to 24C. The outer diameter of the expanded ring is significantly greater than the outer diameter of the ring structures (and wedges) in their collapsed state, with the increased expansion resulting from the four-stage mechanism. Sequencing of the expansion is designed to be from the inside to the outside by selection of biasing springs with successively higher retaining forces (moving from the inside or center of the apparatus to the outermost rings). Collapsing of the apparatus to a collapsed condition is achieved by releasing the axial actuation force, and the sequence of collapsing is the reverse of the expanding process.

Figure 25A:
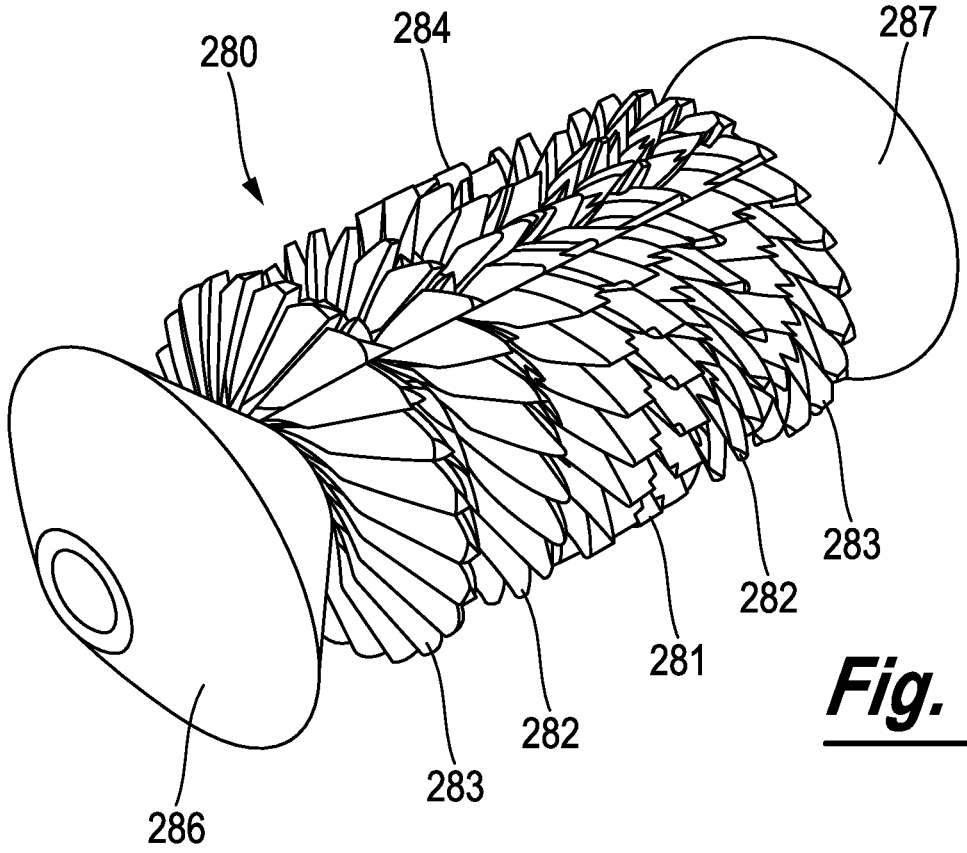
FIGS. 25A and 25B are respectively perspective and sectional views of an apparatus, shown in a collapsed condition.
Figure 25B:
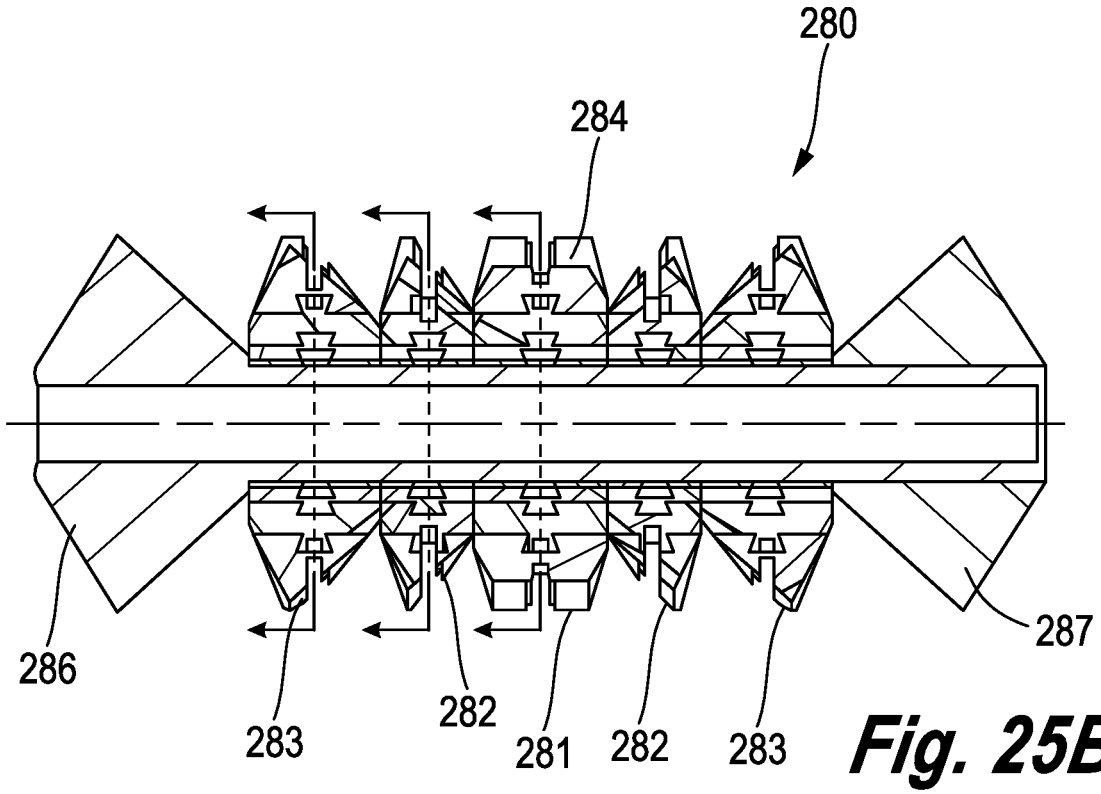
Figure 26A:
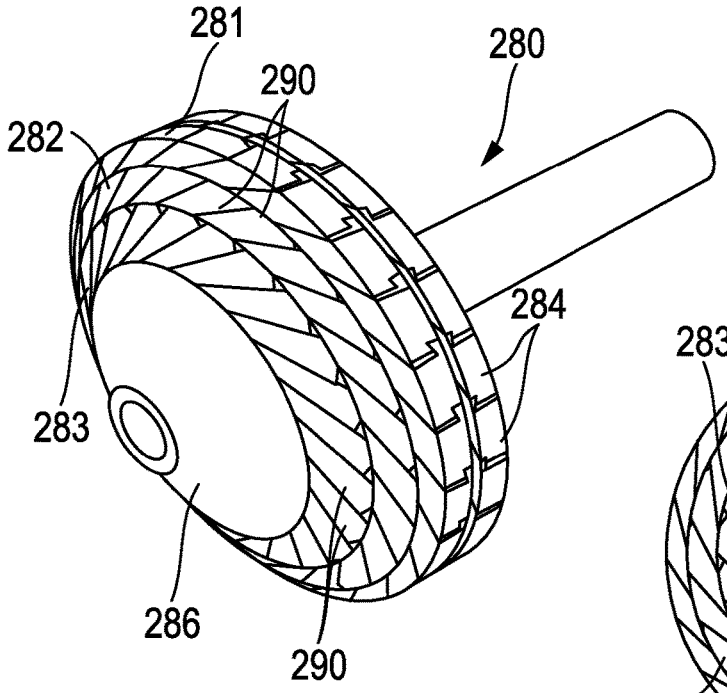
FIGS. 26A through 26D are respectively perspective, first sectional, end, and second sectional views of the apparatus of FIGS. 25A and 25B, shown in an expanded condition.
Figure 26C:
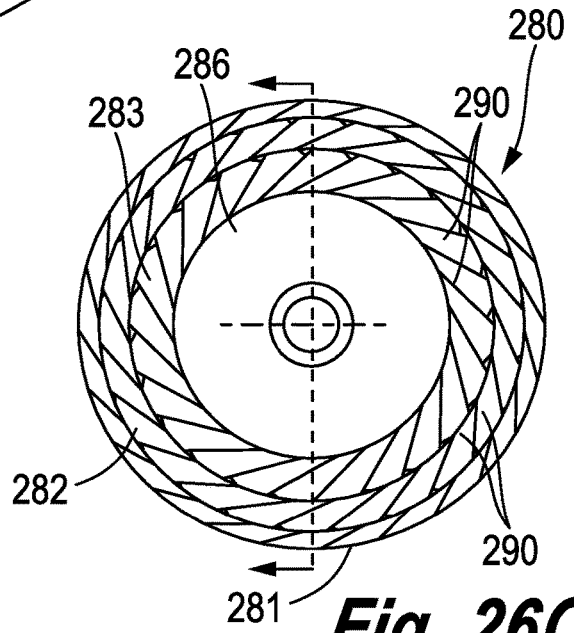
Figure 26B:
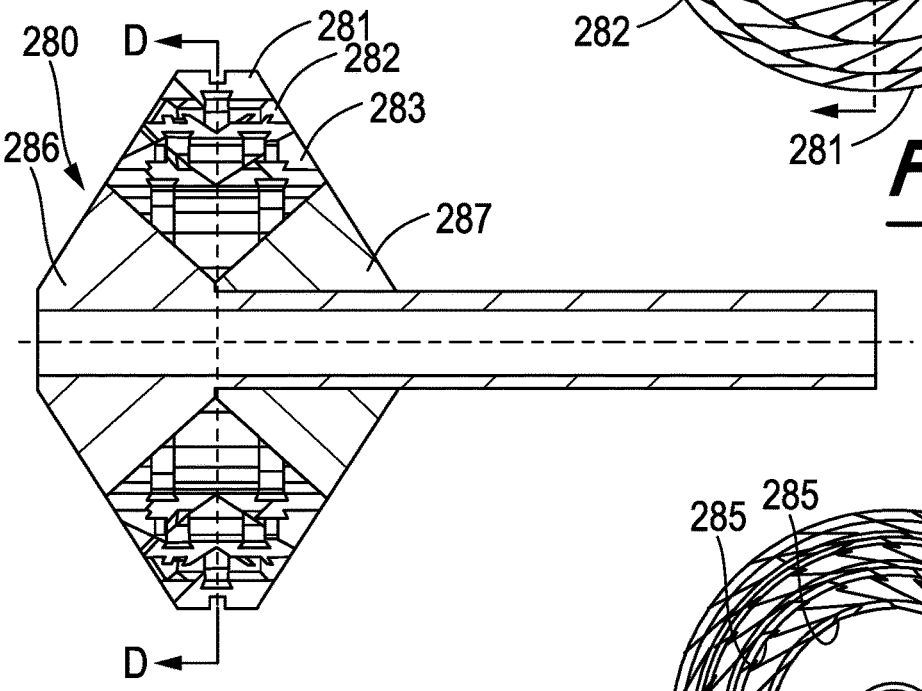
Figure 26D:
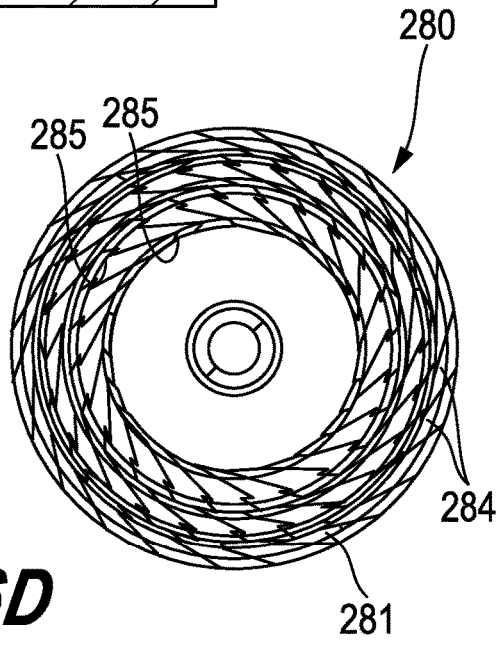

FIGS. 25A to 26D show a multi-stage expanding and collapsing system in accordance with an alternative embodiment of the present disclosure. FIGS. 25A and 25B are respectively perspective and longitudinal sectional views of the apparatus in a first, collapsed condition. FIGS. 26A and 26B are equivalent views of the apparatus in an expanded condition; FIG. 26C is an end view and FIG. 26D is a section through line D-D of FIG. 26B. The apparatus, generally shown at 280, is similar to the apparatus 170 and 190, and its form and function will be understood from FIGS. 17 to 24 and the accompanying description. However, the apparatus 280 differs in that it comprises pairs of ring structures 281, 282, 283 formed from individual elements with geometry different from those of previous embodiments.

Figure 27:
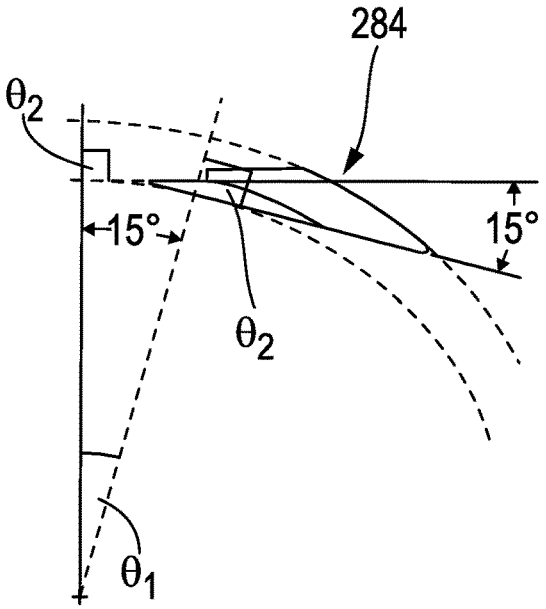
FIG. 27 is a geometric representation of a center element of the apparatus of FIGS. 25A and 25B, shown from one side.
Figure 28A:
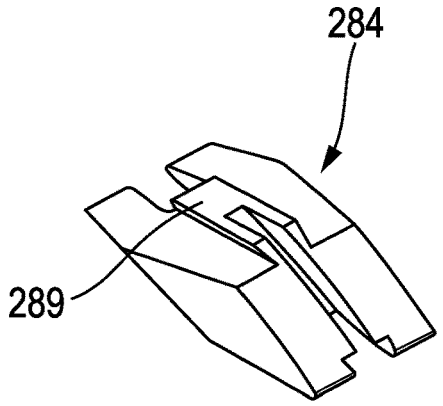
FIGS. 28A through 28F are respectively first through fourth perspective, first end, and second end views of a center element of the apparatus of FIGS. 25A and 25B.
Figure 28B:
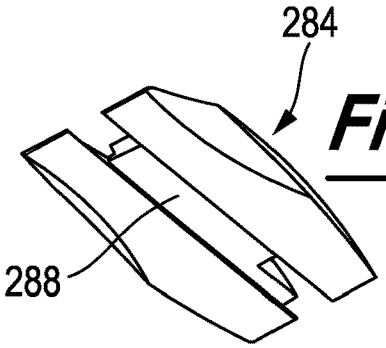
Figure 28C:
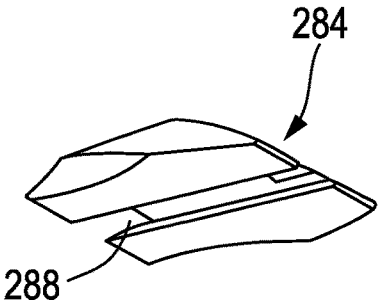
Figure 28D:
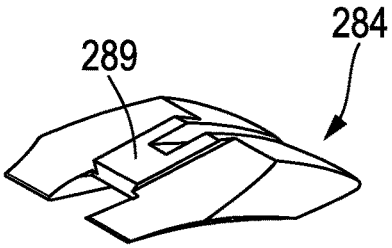
Figure 28E:
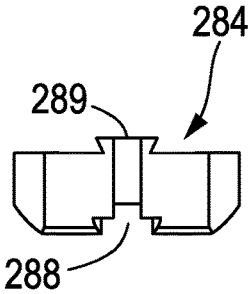
Figure 28F:
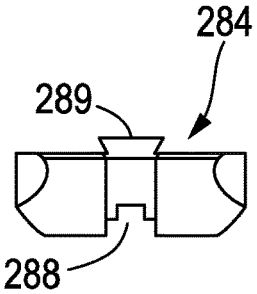

FIG. 27 is a geometric representation of a center element of the apparatus of FIGS. 25A and 25B, shown from one side, and FIGS. 28A to 28F are respectively first perspective, second perspective, plan, first end, lower, and second end views of a center element 284. The figures show the inner and outer surfaces, first and second contact surfaces, interlocking profiles, and grooves for retaining circumferential springs which are equivalent in form and function to the features of the elements 12 and 77.

Each element is effectively a segment of a ring which has its nominal outer diameter at the optimum expansion condition of the ring, but which has been inclined at an angle $\theta_2$ with respect to a radial direction. However, in this embodiment, $\theta_2$ is 90 degrees, and a shallower, finer wedge profile is created by the element. The orientation planes of the contact surfaces are tangential to the circle described by the inner surface of the ring structure in its collapsed condition. This enables optimization of the collapsed volume of the ring structure, by reducing the size of the gaps created at the inner surface of the ring in the collapsed condition and enabling a more compact collapsed condition. These include the introduction of flat sections 285 at the inner surface of the elements (visible in FIG. 26D), which manifest as spaces at the inner diameter of the ring when in an expanded or partially expanded condition. In the construction shown, the profile of the inner surface of the expanded ring is not critical, as the inner diameter of the ring structure is floating, and the true inner diameter is defined by the actuation wedge profiles 286, 287 rather than the inner surface of the ring. The spaces are therefore not detrimental to the operation of the apparatus, and the apparatus benefits from a reduced collapse volume.

The elements 284 also differ from the elements of previous embodiments in that the interlocking profiles formed by grooves and tongues are inverted, such that the groove 288 is in the inner surface of the element, and the tongue 289 is in the outer surface. This increases the engagement length between adjacent elements.

The elements 290 of the ring structures 282 and 283 are similarly formed, with angle $\theta_2$ at 90 degrees, with the orientation planes of their contact surfaces being tangential to the circle described by the inner surface of the ring structure in its collapsed condition.

It should be noted that in other embodiments, different angles $\theta_2$ may be adopted, including those which are in the range of 80 degrees to 90 degrees (most preferably tending towards 90 degrees).

Operation of the expanding and collapsing apparatus is the same as that described with reference to FIGS. 23 and 24, with the center ring structure 281 being deployed to a first intermediate expanded state, and first and second pairs of outer ring structures being deployed to their radially expanded states, in sequence from the inside of the apparatus adjacent to the center ring 281, to the outside. Sequencing of the expansion is designed to be from the inside to the outside by selection of biasing springs with successively higher retaining forces (moving from the inside or center of the apparatus to the outermost rings). Collapsing of the apparatus to a collapsed condition is achieved by releasing the axial actuation force, and the sequence of collapsing is the reverse of the expanding process.

The apparatus 280, by virtue of the compact collapsed inner volumes achievable with the finer wedge profiles, is capable of increased expansion ratios. In this example, the apparatus 280 is configured to have the same expansion ratio as the apparatus 190, with only two pairs of expanding ring structure compared with the three pairs in the apparatus 190. This reduces the axial length of the apparatus and greatly reduces the number of parts required.

The particularly high expansion ratios achieved with the multi-stage expansion embodiments enable application to a range of operations. For example, the apparatus may form part of a mechanically actuated, high expansion, production packer or high expansion annular flow barrier. Particular applications include (but are not limited to) cement stage packers or external casing packers for openhole applications.

The expansion ratios achievable also enable use of the apparatus in through-tubing applications, in which the apparatus is required to pass through a tubing or restriction of a first inner diameter, and by expanded into contact with a tubing of a larger inner diameter at a greater depth in the wellbore. For example, the apparatus may be used in a high expansion retrievable plug, which is capable of passing through a production tubing to set the plug in a larger diameter liner at the tailpipe.

An application of the multi-stage expansion apparatus of FIGS. 17 and 18 to a fluid conduit patch tool and apparatus will now be described with reference to FIGS. 29A to 30B. A typical patching application requires the placement and setting of a tubular section over a damaged part of a fluid conduit (such as a wellbore casing). A patch tool comprises a tubular and a pair of setting mechanisms axially separated positions on the outside of the conduit for securing the tubular to the inside of the fluid conduit. It is desirable for the setting mechanisms to provide an effective flow barrier, but existing patch systems are often deficient in providing a fluid-tight seal with the inner surface of the fluid conduit.

Figure 29A:
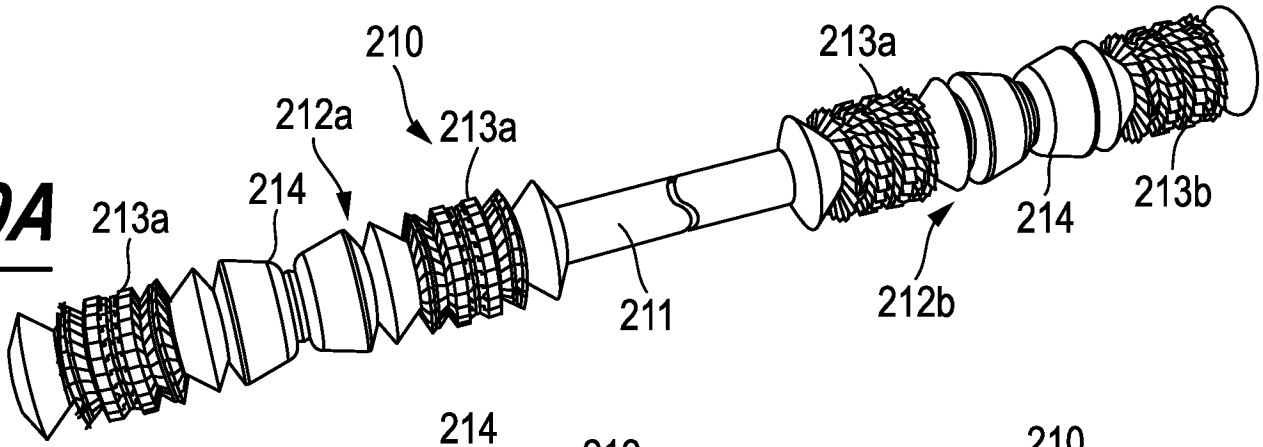
FIGS. 29A and 29B are respectively perspective and sectional views of a patch apparatus, shown in a collapsed condition.
Figure 29B:
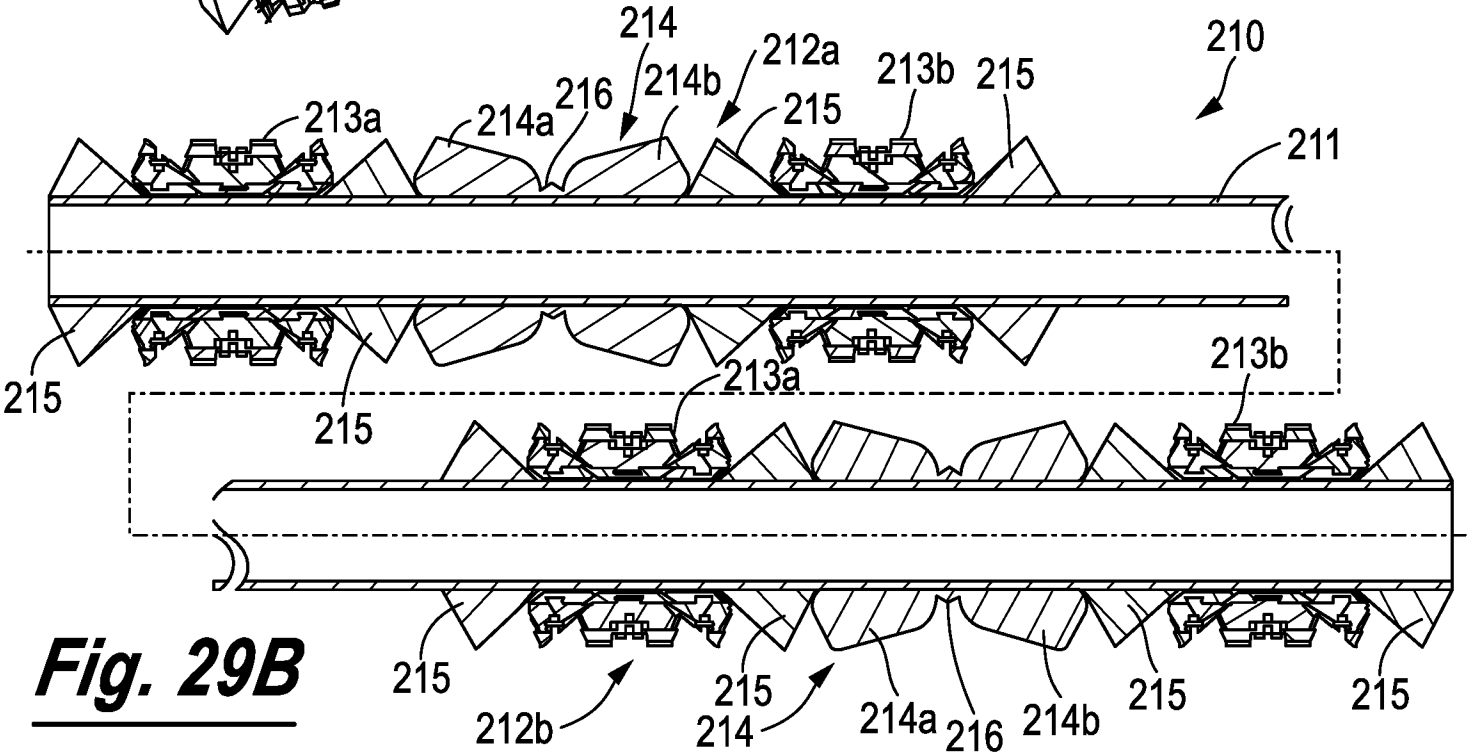
Figure 30A:
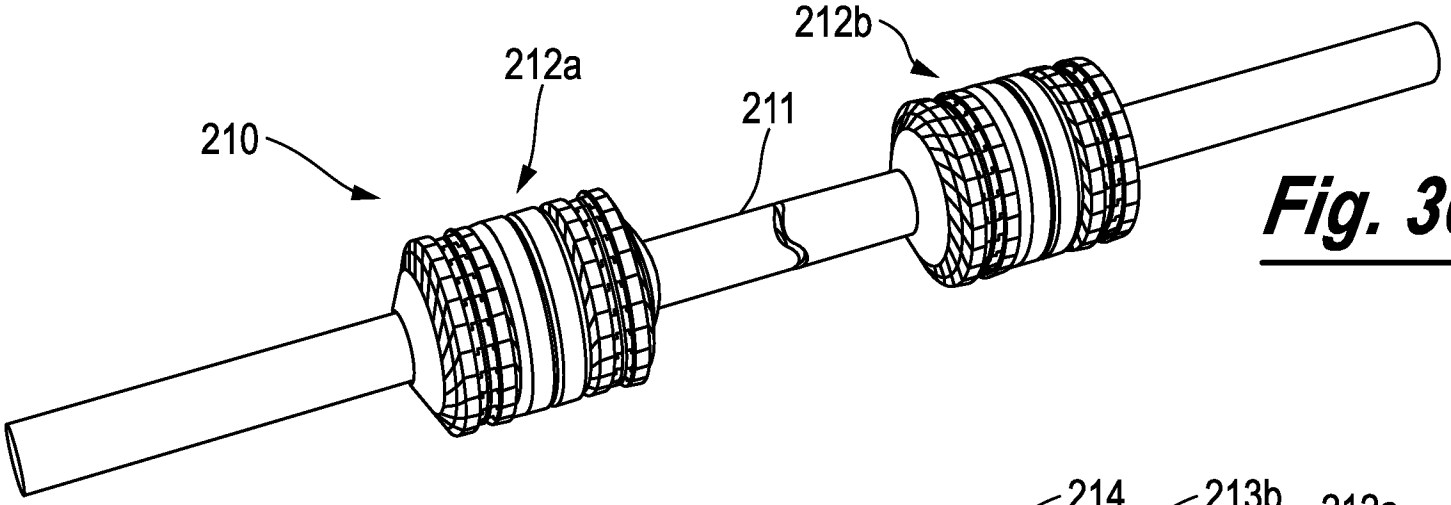
FIGS. 30A and 30B are respectively perspective and sectional views of the apparatus of FIGS. 29A and 29B, shown in an expanded condition.
Figure 30B:
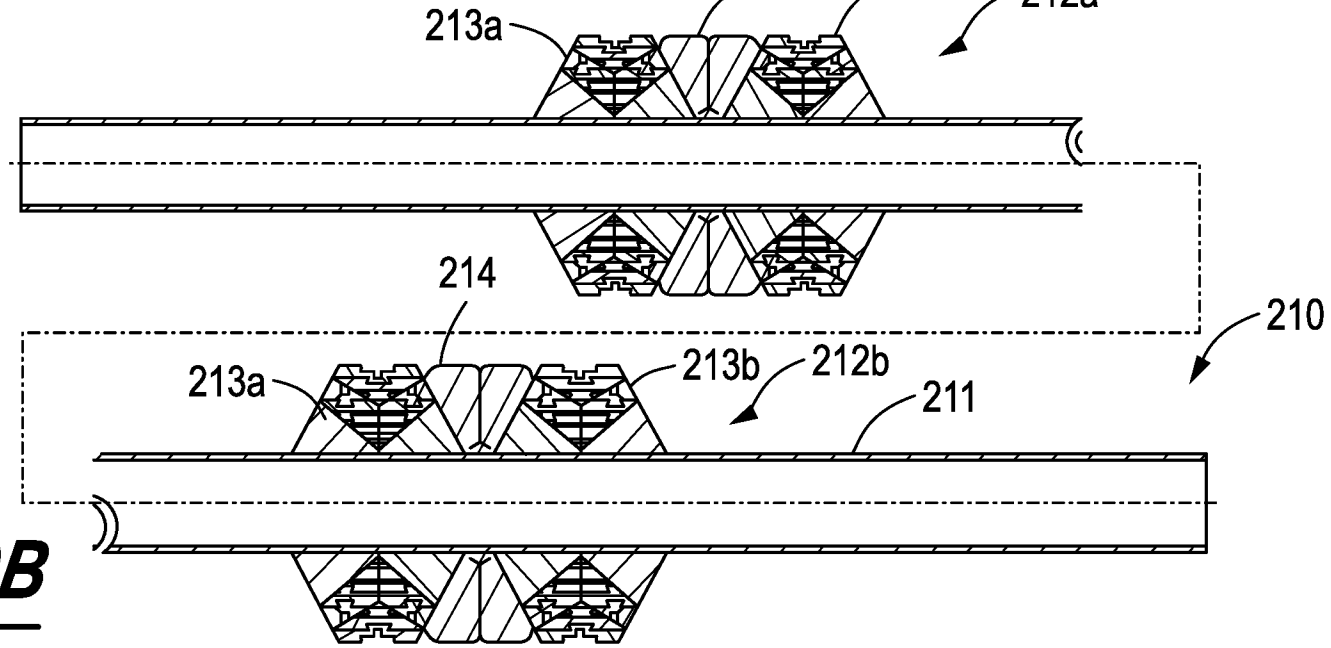

FIGS. 29A and 29B show a high expansion patching tool, generally depicted at 210, from perspective and longitudinal sectional views shown in a collapsed, run position. FIGS. 30A and 30B are equivalent views of the apparatus in an expanded condition.

The patching tool comprises a tubular section 211, and a pair of expansion assemblies 212*a*, 212*b* (together 212) in axially separated positions on the section. The distance between the assemblies 212*a*, 212*b* is selected to span the damaged section of a fluid conduit to be patched. Each of the assemblies 212 comprises a pair of expansion apparatus 213*a*, 213*b*, disposed on either side of an elastomeric seal element 214. The expansion apparatus 213 are similar in form and function to the expansion apparatus 170, and their operation will be described with reference to FIGS. 17 and 18. Each comprises a center ring structure and a pair of outer ring structures. A pair of cone wedge members 215 is provided on either side of the expansion apparatus 213.

The elastomeric seal elements 214 are profiled such that an axially compressive force deforms the elastomeric material, and brings first and second halves 214*a*, 214*b* of the seal element together around a deformation recess 216.

The patch tool is, like other embodiments, configured to be actuated by an axial force. The axial force acts to radially expand the expansion apparatus 213 in the manner described with reference to FIGS. 17 and 18, and into contact with the fluid conduit to be patched. The elastomeric seals are deformed by the axial force via the cone wedges 215, to change shape and fill an enclosed annular space formed between a pair of expansion apparatus 213*a*, 213*b*. The expanded condition is shown in FIGS. 30A and 30B.

The expansion apparatus may provide sufficient frictional force with the inner surface of the conduit being patched to secure the patch tool in the conduit. This may be facilitated by providing engaging profiles on the expansion apparatus (for example, similar to the expansion slips described with reference to FIGS. 9, 11 and 12). Alternatively (or in addition), separate anchor mechanisms may be provided.

The patching tool 210 provides a pair of effective seals which are fully supported by the expansion apparatus, each of which forms a solid anti-extrusion ring.

Figure 31:
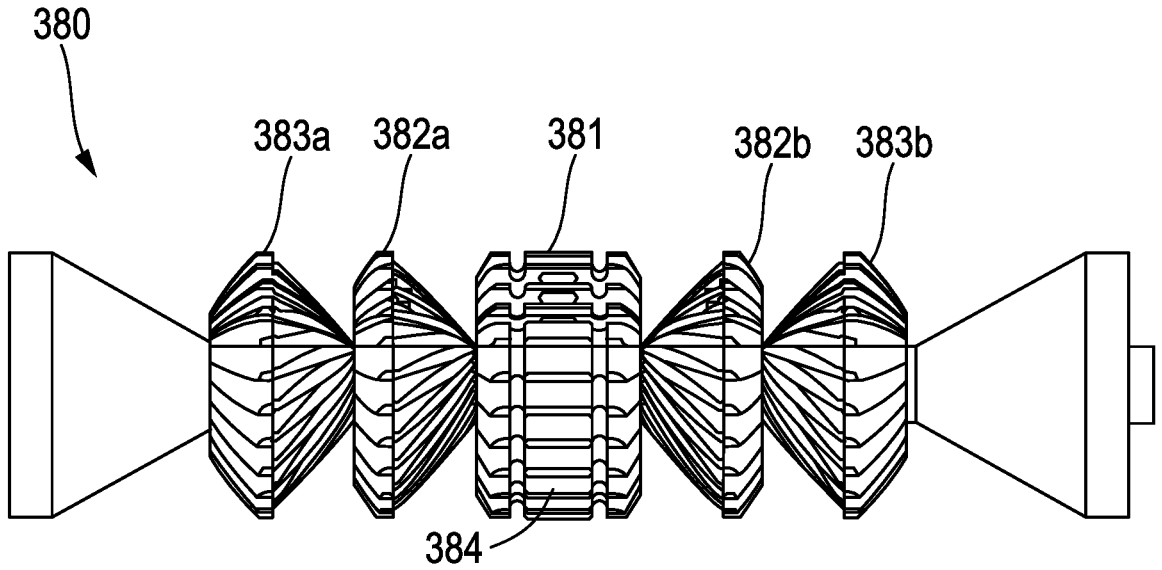
FIG. 31 is a side view of an apparatus in a first, collapsed condition.
Figure 32:
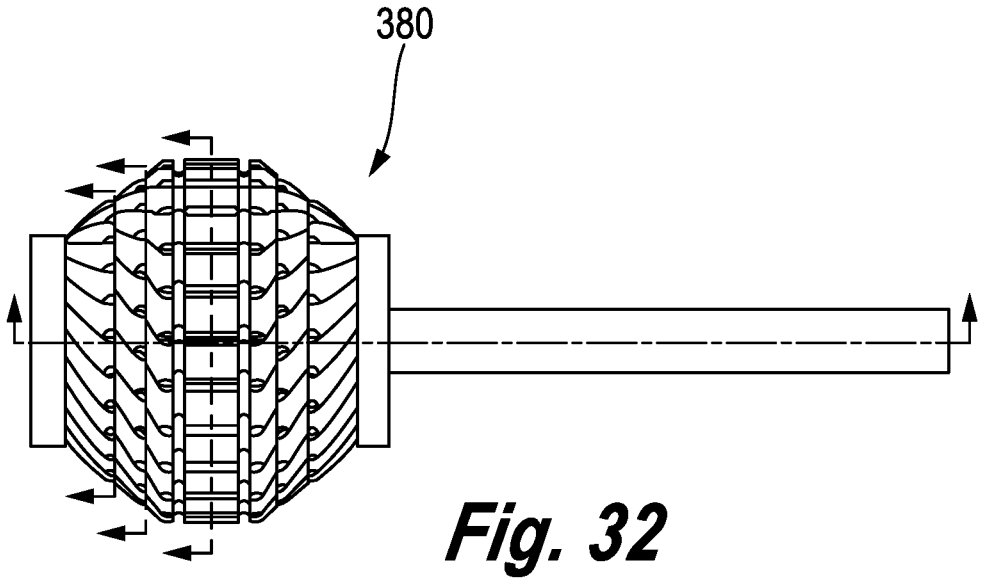
FIG. 32 is a side view of the apparatus of FIG. 31 a second, collapsed condition.
Figure 33A:
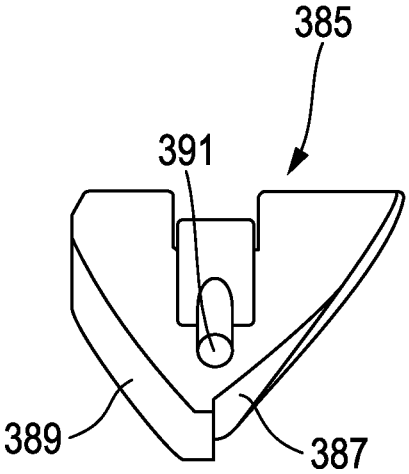
FIGS. 33A and 33B are respectively plan and isometric views of an element of the apparatus of FIGS. 31 and 32.
Figure 33B:
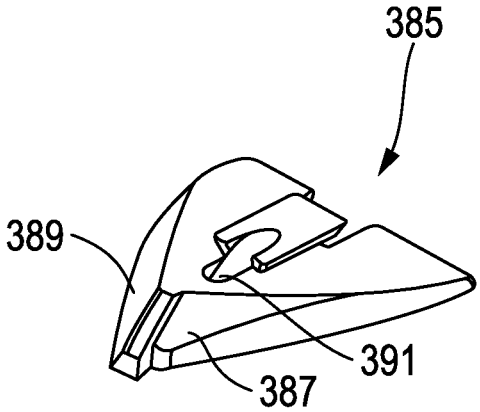
Figure 34A:
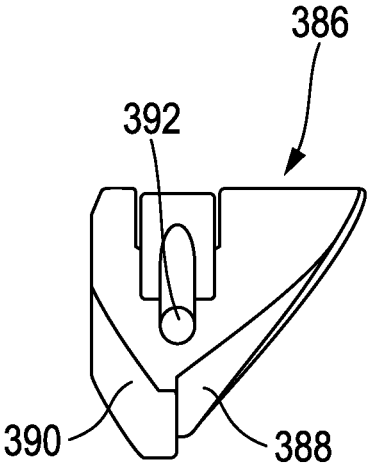
FIGS. 34A and 34B are respectively plan and isometric views of a second element of the apparatus of FIGS. 31 and 32.
Figure 34B:
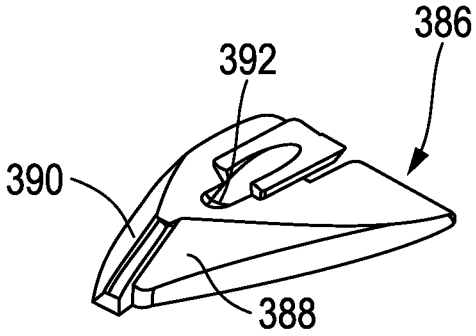

FIGS. 31 to 34B show a multi-stage expanding and collapsing system in accordance with an alternative embodiment of the present disclosure. FIGS. 31 and 32 are respectively side views of the apparatus in a first, collapsed condition and second expanded condition. FIGS. 33A and 33B are respectively plan and isometric views of a first set of elements of the apparatus; FIGS. 34A and 34B are respectively plan and isometric views of a second set of elements of the apparatus. The apparatus, generally shown at 380, is similar to the apparatus 170, 190, and 280, with a central ring structure 381 formed from an assembly of elements 384, and two pairs of ring structures 382*a*, 382*b* (together 382), 383*a* and 383*b* (together 383). The form and function of the apparatus will be understood from FIGS. 17 to 26 and the accompanying description. However, the apparatus 380 differs in that it comprises pairs of ring structures 382, 383 formed from individual elements with geometry different from those of previous embodiments.

FIGS. 33A and 33B are respectively plan and isometric views of an element 385, from which the outer ring structures 383*a*, 383*b* are assembled. FIGS. 34A and 35B are respectively plan and isometric views of an element 386, from which the intermediate ring structures 382*a*, 382*b* are assembled. The figures show the outer surfaces, first contact surfaces, and interlocking tongues. The external profiles of the elements 385, 386 are modified by provision of additional chamfers 387, 388. These chamfers modify the external profile of the elements, so that when assembled into a ring, the inward facing flank (i.e., the flank facing the center ring) has an at least partially smoothed conical surface. This facilitates the deployment of the apparatus; the smoother conical surface improves the sliding action of the elements the center ring 381 on the conical profiles of the rings 382*a*, 382*b* as the elements are brought together to expand the center ring. Similarly, the smoothed inward facing flank of the rings 383*a*, 383*b* facilitate the sliding of the elements 382*a* of the rings 382*a*, 383*b* during their expansion. The smoothed cones assist a supporting ring in punching under the adjacent ring with a smooth action, The outer surfaces 389, 390 of the elements 385, 386 are profiled such that the ring structures 382, 383 define smooth conical surfaces on their outward facing flanks when in their expanded condition. These conical surfaces combine in the assembled, expanded apparatus, to provide a substantially or fully smooth surface which is suitable for abutment with and/or support of an adjacent element such as an elastomer.

The elements 385, 386 also differ from the elements of previous embodiments in that the biasing means in the form of garter springs are not mounted in external grooves. Instead, apertures 391, 392 are provided in the elements for receiving the garter springs (or an alternative biasing means). The garter spring may be threaded through each segment and then joined to make a continuous loop upon assembly. By providing the biasing means in-board of the external surface, it may be better protected from damage. In addition, the external profile of the elements is simplified and is more supportive of adjacent elements. This configuration also facilitates location of the biasing means directly over the dovetail feature, so that the biasing force acts centrally to avoid canting and jamming.

It will be appreciated that "single stage" expansion apparatus, for example as described with reference to FIGS. 1 to 4, may be used in a patching tool and method of use. Indeed, in some applications this may desirable, as the resulting patched tubular can have an inner diameter close to the inner diameter of the fluid conduit that has been patched, mitigating the reduction to bore size. However, the patching tool 170 has the advantage of high expansion for a slim outer diameter profile, which enables the tool to be run through a restriction in the fluid conduit, to patch a damaged part of the conduit which has a larger inner diameter than the restriction. For example, the patching tool could be run through a part of the fluid conduit that has already been patched, either by conventional means or by a patching tool based on a single-stage expansion apparatus. Higher expansion ratio patching tools could be used, based on expansion apparatus having three or more stage deployment.

In the foregoing embodiments, where the expanding and collapsing apparatus is used to create a seal, the seal is typically disposed between two expanding ring structures. In alternative embodiments (not illustrated), an expanding ring structure can be used to provide a seal, or at least a restrictive flow barrier directly. To facilitate this, the elements which are assembled together to create the ring structures may be formed from a metal or a metal alloy which is fully or partially coated or covered with a polymeric, elastomeric or rubber material. An example of such a material is a silicone polymer coating. In one embodiment, all surfaces of the elements may be coated, for example by a dipping or spraying process, and the mutually supportive arrangement of the elements keeps them in compression in their operating condition. This enables the ring structures themselves to function as flow barriers, and in some applications, the seal created is sufficient to seal against differential pressures to create a seal.

Alternatively, or in addition, the elements themselves may be formed from a compressible and/or resilient material, such as an elastomer, rubber or polymer.

In a further alternative embodiment (not illustrated) the characteristics of the expanding/collapsing apparatus are exploited to provide a substrate which supports a seal or other deformable element. As described herein, the expanded ring structures provide a smooth circular cylindrical surface at their optimum expanded conditions. This facilitates their application as a functional endo-skeleton for a surrounding sheath. In one example application, a deformable elastomeric sheath is provided over an expanding ring structure 10, as described with reference to FIGS. 1 to 4. When in its collapsed condition, the sheath is supported by the collapsed ring structures. The ring structure are deployed in the manner described with reference to FIGS. 1 and 2, against the retaining force of the circumferential spring element and any additional retaining force provided by the sheath, and the sheath is deformed to expand with the ring structure into contact with the surrounding surface. The sheath is sandwiched between the smooth outer surface of the ring structure and the surrounding surface to create a seal.

Although the example above is described with reference to a single-stage expanding apparatus, it will be appreciated that a multistage expanding apparatus (for example the apparatus 170) could be used. In addition, the expanding apparatus may be used as an endo-skeleton to provide structural support for components other than deformable sheaths, including tubulars, expanding sleeves, locking formations and other components in fluid conduits or wellbores.

Additional applications of the principles of the present disclosure include variable diameter tools. Examples will be described with reference to FIGS. 35A to 39B.

Figure 35A:
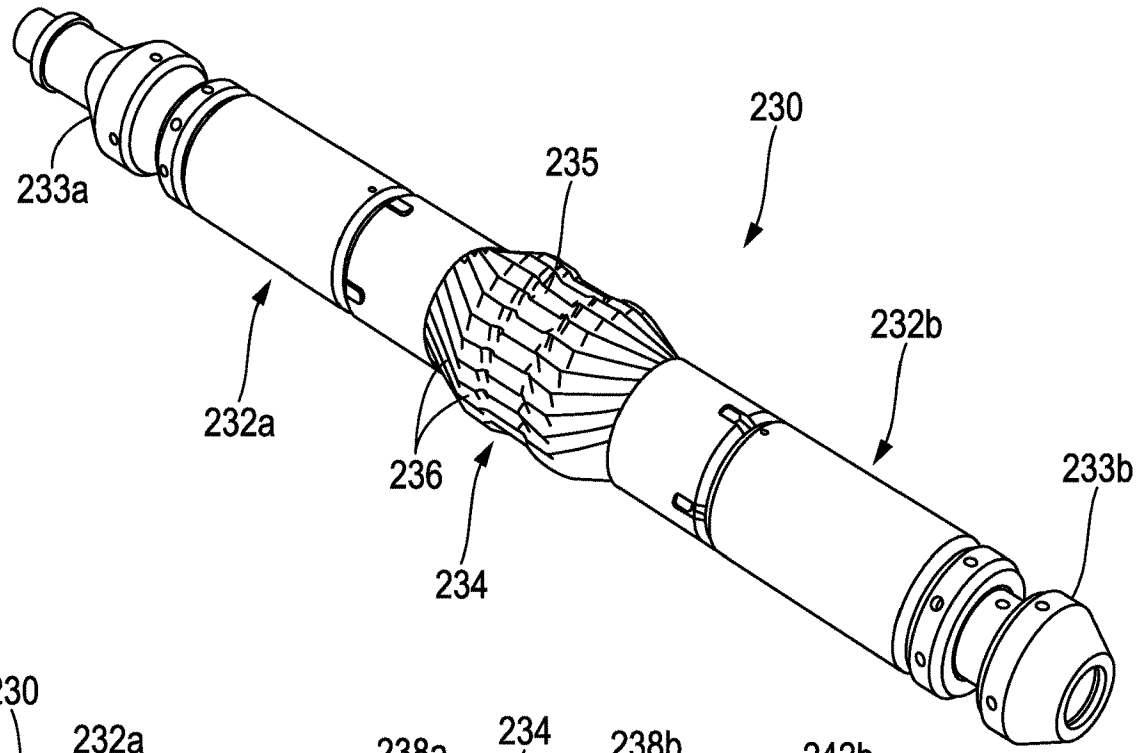
FIGS. 35A and 35B are respectively isometric and sectional views of a drift tool, shown in a run position.
Figure 35B:
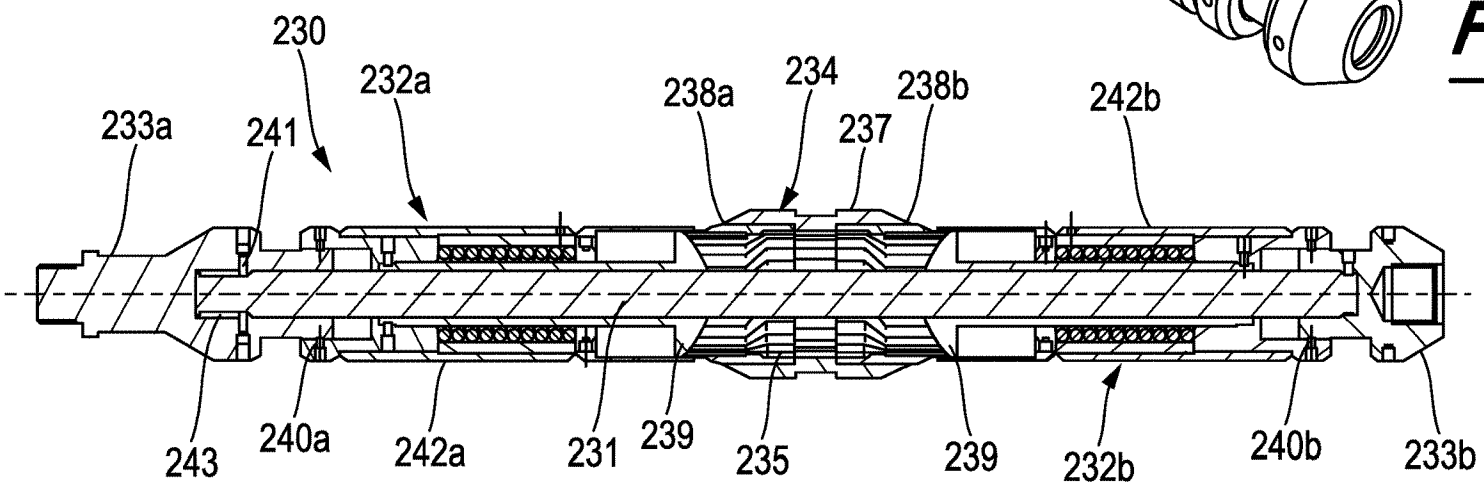
Figure 36A:
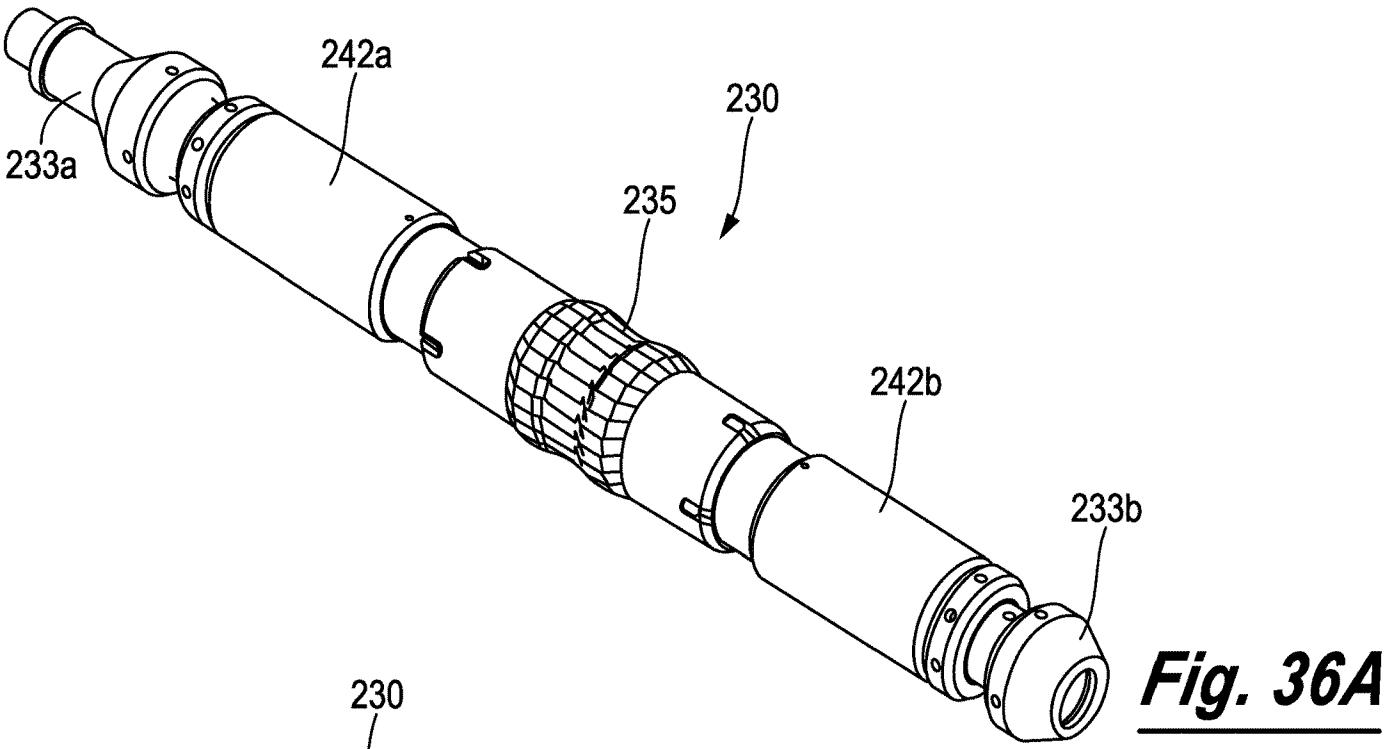
FIGS. 36A and 36B are respectively isometric and sectional views of the apparatus of FIGS. 35A and 35B, shown in an alternative run position.
Figure 36B:
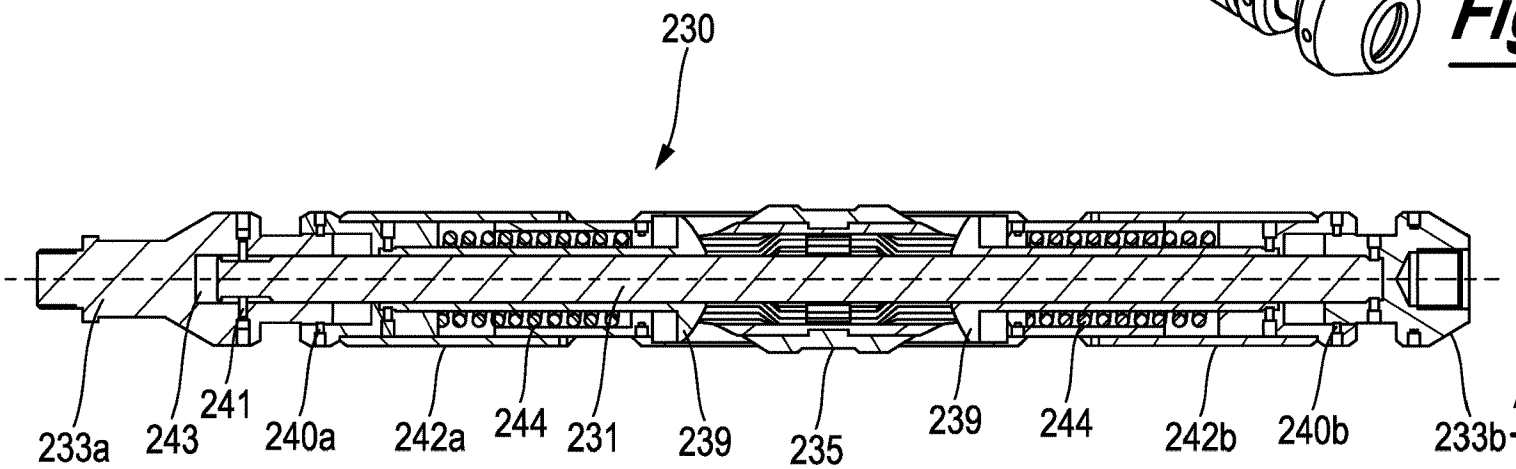
Figure 37A:
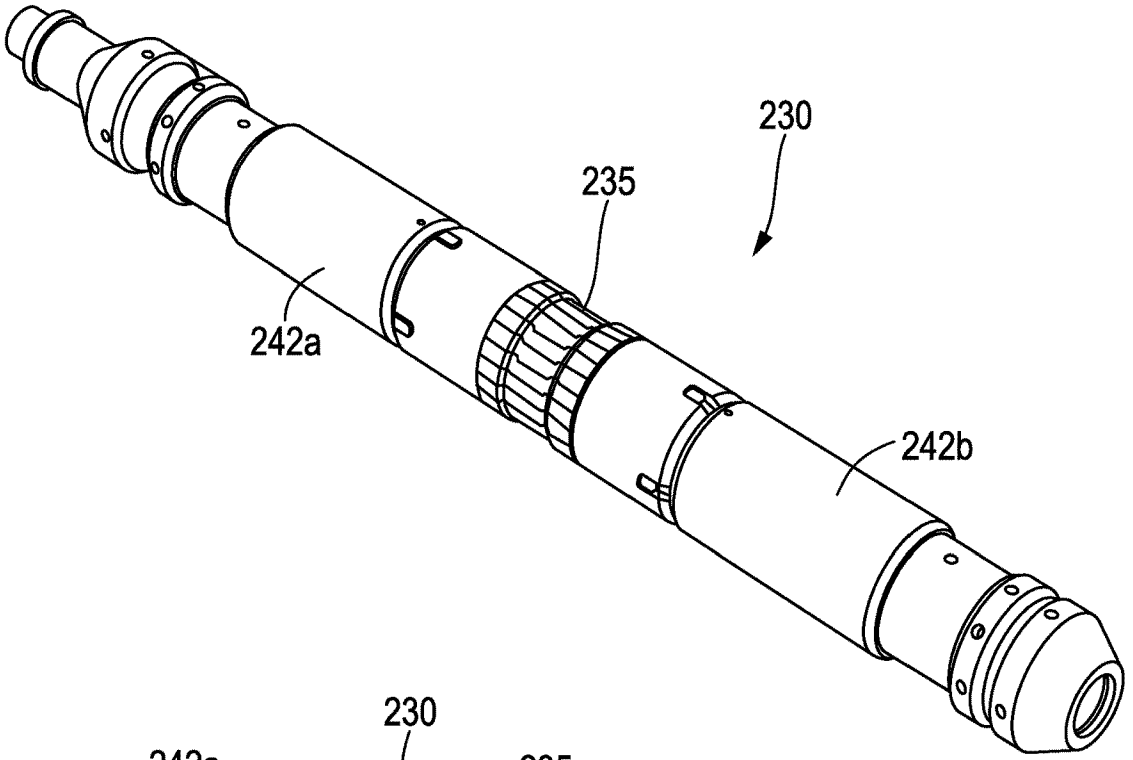
FIGS. 37A and 37B are respectively isometric and sectional views of the apparatus of FIGS. 35A and 35B, shown in a collapsed position.
Figure 37B:
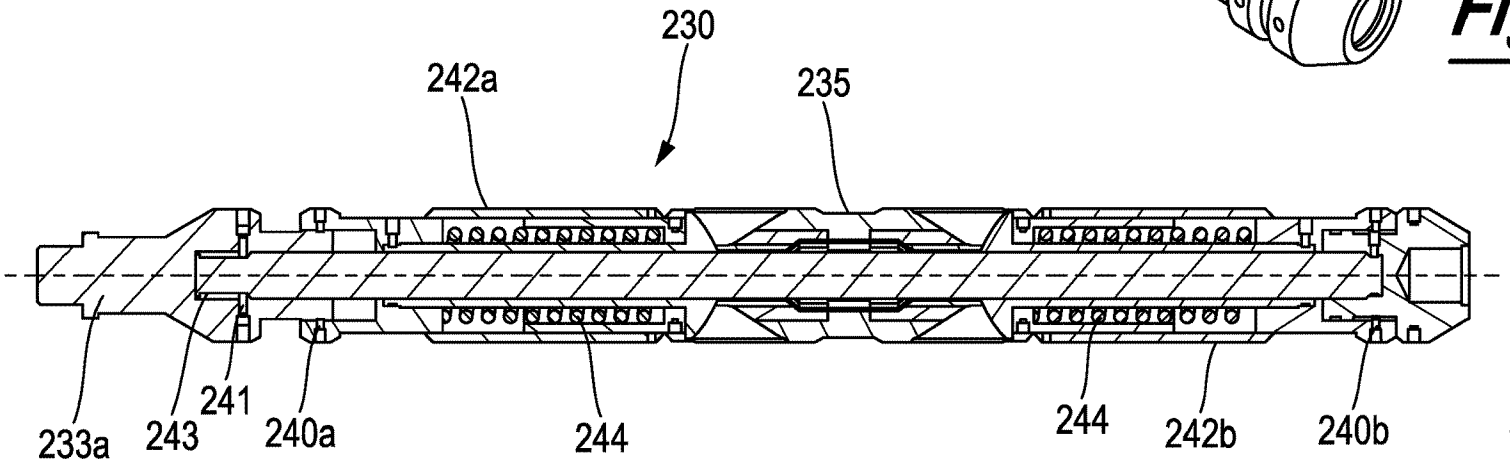

FIGS. 35A and 35B are respectively perspective and longitudinal sectional views of a variable diameter drift tool according to an embodiment of the present disclosure, shown in a first run position. FIGS. 36A and 36B, are equivalent views of the drift tool in an alternative run position, and FIGS. 37A and 37B are equivalent views of the drift tool in a collapsed position.

The drift tool, generally depicted at 230, comprises a central core 231, upper and lower housings 232*a*, 232*b*, and upper and lower connectors 233*a*, 234*a* for connecting the tool to a tool string or other conveyance. Disposed between the upper and lower housings is an expanding and collapsing apparatus 234, which provides the variable diameter functionality of the tool. The expanding and collapsing apparatus 234 comprises a ring structure 235 assembled from a plurality of elements 236. The elements 236 are similar to the elements 12 and 77 of previous embodiments, and their assembly and expanding and collapsing functionality will be understood from FIGS. 1 to 4 and the accompanying text.

The elements 236 differ from the elements previously described in their outer profile. The elements are not, in this embodiment, designed to create a smooth outer ring surface, but instead are designed to present a fluted surface at their optimal and intermediate expanded positions. This is to permit fluid to pass the tool as it is being run in a wellbore in an expanded condition. In addition, the ring structure 235 defines a central portion 237, in which the ring surface is substantially parallel to the longitudinal axis of the tool, and upper and lower tapered portions 238*a*, 238*b*. The tapered portions facilitate the passage of the tool in the wellbore without being hung up on minor restrictions on the bore.

The upper and lower housings 232*a*, 232*b* define cone wedge profiles 239 which impart radial force components on the elements 236 from an axial actuation force during expansion of the ring structure 235. Upper and lower shear screws 240*a*, 240*b* secure the upper and lower housings to the core 231 via the connectors 233*a*, 233*b*.

The position and separation of the cone wedges 239 on the core 231 determines the expanded position of the ring structure 235 and the outer diameter of the tool. This can be adjusted by setting the position of the upper connector 233 a with respect to the core 231 by means of locking screws or pins 241. Locking collars 242*a*, 242*b* are able to lock the position of the housing in the desired condition with respect to the ring structure.

In the position shown in FIGS. 35A and 35B, the core 231 is fully retracted into a bore 243 in the upper connector, which draws the upper and lower housings together and brings the wedge profiles 239 together. An axial force is imparted on the wedges 239 which is directed radially to the elements of the ring structure 235 to expand the ring structure to its maximum outer diameter.

In the position shown in FIGS. 36A and 36B, the core 231 is only partially retracted into the bore 243 in the upper connector, which partially lengthens the tool and enables the wedges 239 to be partially separated. This enables the elements of the ring structure 235 to partially collapse to an intermediate outer diameter under the force of a circumferential retaining spring (not shown). An axial force from coil springs 244 in the housings extends the housings to partially cover the tapered portions of the ring structure. Locking collars 242*a*, 242*b* are repositioned to lock position of the housing in the desired condition with respect to the ring structure.

It will be appreciated that in certain embodiments, the position of the core with respect to the upper connector may be adjusted continuously or to a number of discrete positions, to provide a continuously variable diameter, or a number of discrete diameters. The tool 230 is designed to be retrieved to surface to be adjusted, but other embodiments may comprise mechanisms for automated and/or remote adjustment of the core position and the outer diameter. Such variants may include an electric motor which actuates rotation of a threaded connection to change the relative position of the wedges and the diameter of the ring structure.

FIGS. 37A and 37B show the tool 230 in a collapsed condition, in which the ring structure is fully collapsed to be flush with the principle outer diameter of the tool housings. This collapsed position is actuated by a jar up force on the tool string. The jarring force acts through the core and shears through the lower shear screws 240*b*, disconnecting the lower housing from the lower connector. This enables downward movement of the lower housing with respect to the lower connector, and separates the wedges 239 to collapse the ring structure.

A jar-down collapse condition (not shown) can alternatively be created by imparting a jar down force on the tool. The downward force shears the upper shear screws 240*a*, disconnecting the upper housing from the upper connector. This enables upward movement of the upper housing with respect to the upper connector, and separates the wedges 239 to collapse the ring structure.

The tool 230 is configured as a drift tool, which is run to verify or investigate the drift diameter of a wellbore. The tool may also be configured as a centralizing tool, which has variable diameter to set variable stand-off of a tool string.

Figure 38A:
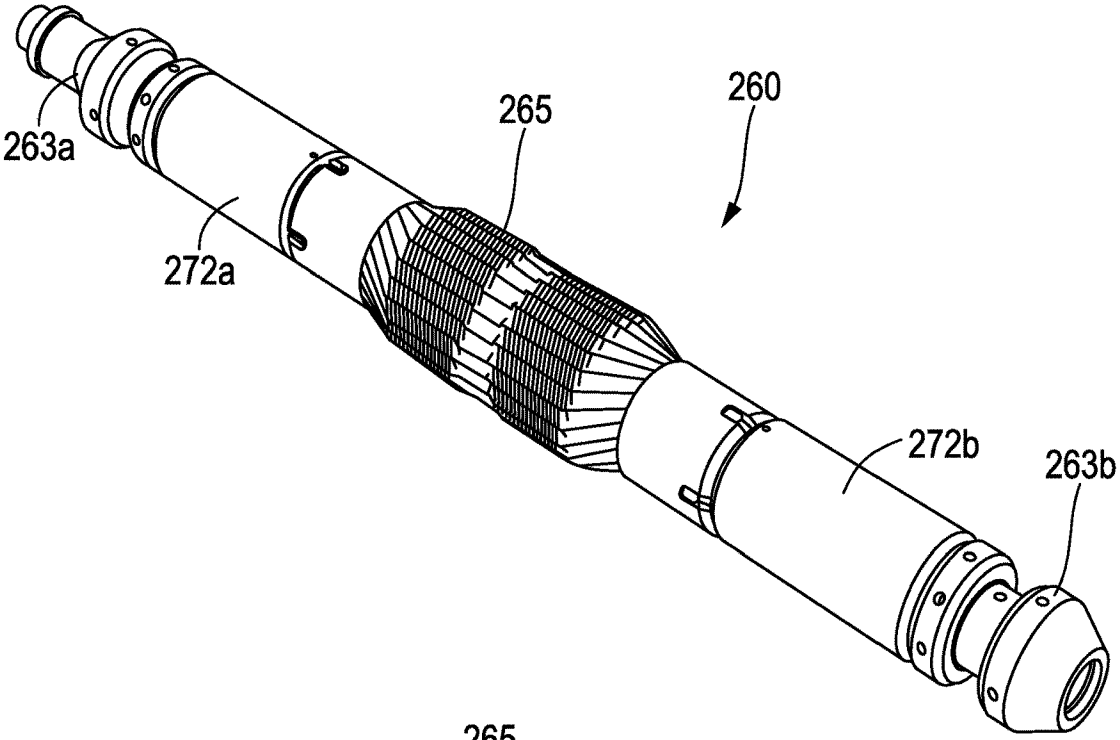
FIGS. 38A and 38B are respectively isometric and sectional views of a broaching tool apparatus, shown in a run position.
Figure 38B:
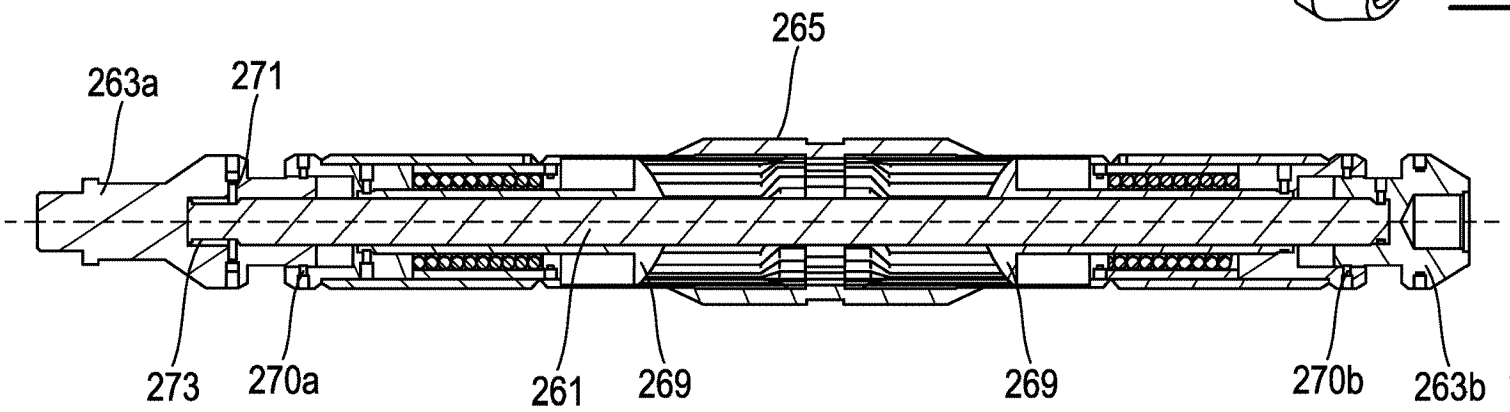
Figure 39A:
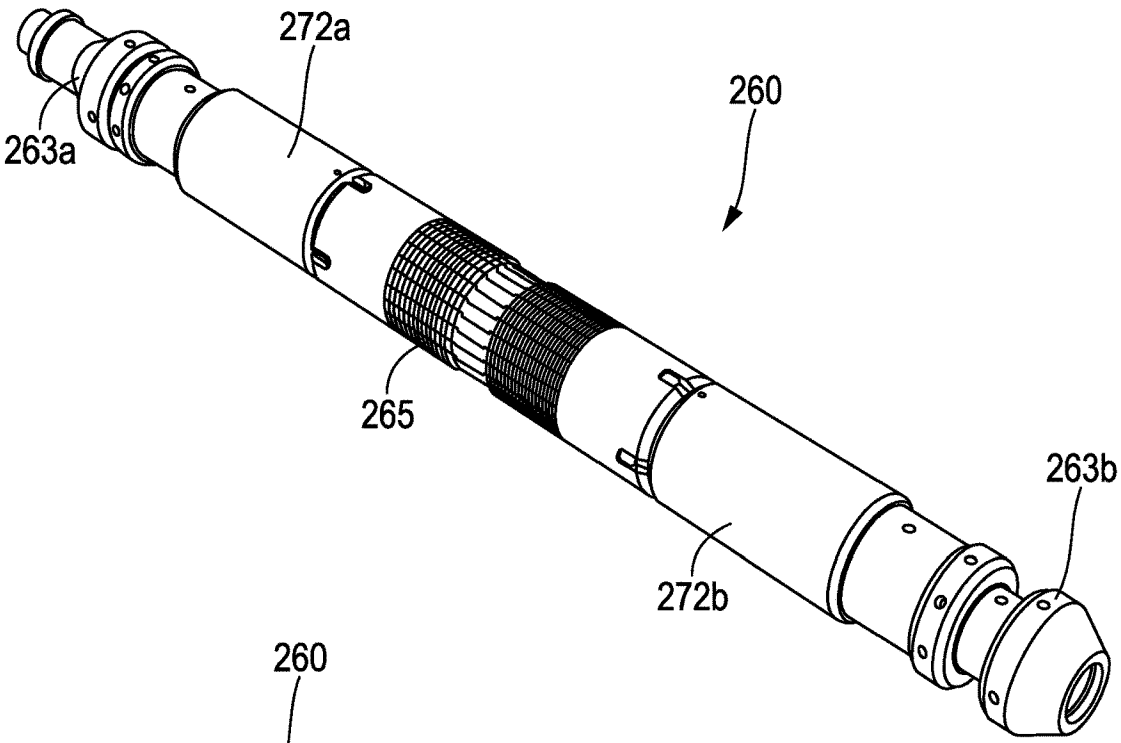
FIGS. 39A and 39B are respectively isometric and sectional views of the apparatus of FIGS. 38A and 38B, shown in a collapsed position.
Figure 39B:
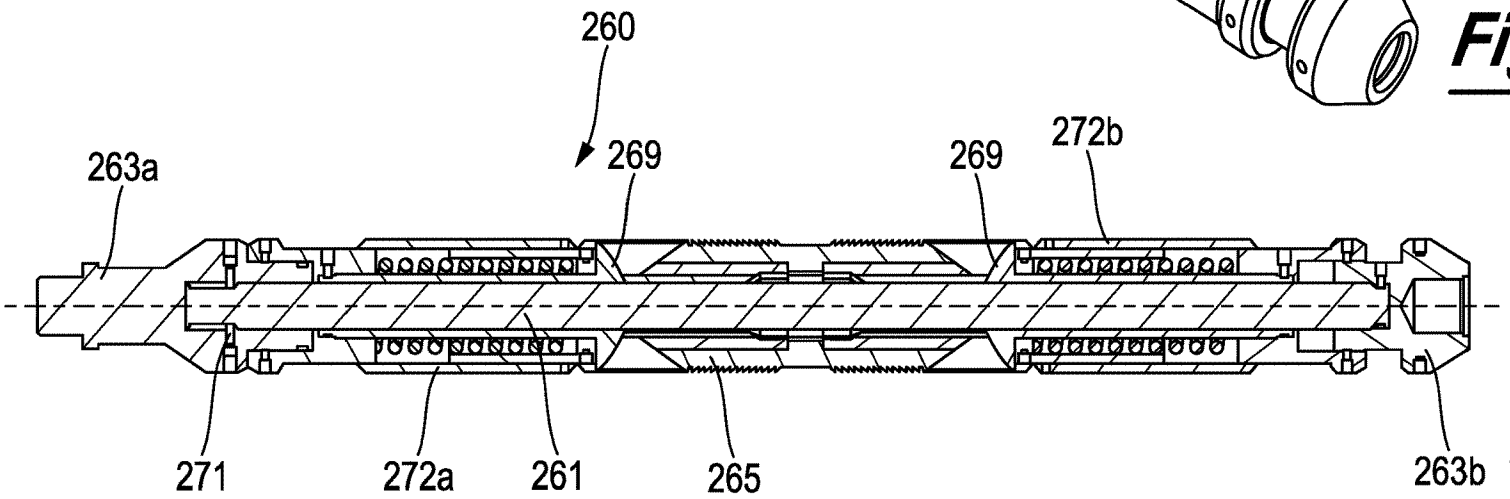

A further variation is described with reference to FIGS. 38A to 39B. FIGS. 38A and 38B are respectively perspective and longitudinal sectional views of a variable diameter wellbore broaching tool, generally depicted at 260, according to an embodiment of the present disclosure, shown in a first run position. FIGS. 39A and 39B, are equivalent views of the tool in a collapsed position.

The wellbore broaching tool 260 is similar to the drift tool 230, with like components indicated by like reference numerals incremented by 30. In this embodiment, the outer surfaces of the elements 266 which make up the ring structure are provided with abrasive cutting formations or teeth, which are designed to remove material from the inner surface of a wellbore.

The position and separation of the cone wedges 269 on the core 261 determines the expanded position of the ring structure 265 and the outer diameter of the tool. This can be adjusted by setting the position of the upper connector 263*a* with respect to the core 261 by means of locking screws or pins 261. Locking collars 262*a*, 262*b* are able to lock the position of the housing in the desired condition with respect to the ring structure.

In common with the previous embodiment, the position of the core with respect to the upper connector may be adjusted continuously or to a number of discrete positions, to provide a continuously variable diameter, or a number of discrete diameters. The tool 260 is designed to be retrieved to surface to be adjusted, but other embodiments may comprise mechanisms for automated and/or remote adjustment of the core position and the outer diameter.

A further application of the embodiments described herein is to a variable diameter centralizing and/or stabilizing tool, which may be used in a variety of downhole applications with non-sealing devices. These include, but are not limited to, drilling, milling and cutting devices. The tool may be similar to the drift tool 230 and the broaching tool 260, with the outer surface of the elements designed to contact and engage with a borehole wall at a location axially displaced from (for example) a drill bit, milling head, or cutting tool. The tool may be provided with a bearing assembly to facilitate rotation of a mandrel with respect to the expanding ring structure, or to permit rotation of a drilling, milling or cutting tool. The diameter of the tool can be controlled to provide a centralizing and/or stabilizing engagement force to support the wellbore operation. The embodiments described herein can be used in a similar manner to stabilize, center, or anchor a range of non-sealing devices or tools.

As described above, in certain embodiments, an expanding and collapsing apparatus and a separate slip/anchor assembly may be disposed at different axial positions along a downhole tool. As described in greater detail below, other embodiments may address seal resilience and manufacturing cost issues. In particular, an alternative method for preventing seal extrusion under pressure was developed (e.g., to keep costs to a minimum) wherein a press-fit seal no longer incorporates a metal cap. Such embodiments described below effectively split a sealing device 380 into two equal uphole and downhole portions and each of these uphole and downhole portions of the sealing device 380 are placed on uphole and downhole ends of a slip/anchor assembly 384. As described in greater detail below, both the sealing devices and the slip/anchor assemblies include expanding/collapsing elements similar to those described above with reference to FIGS. 1A through 39B.

Figure 40:
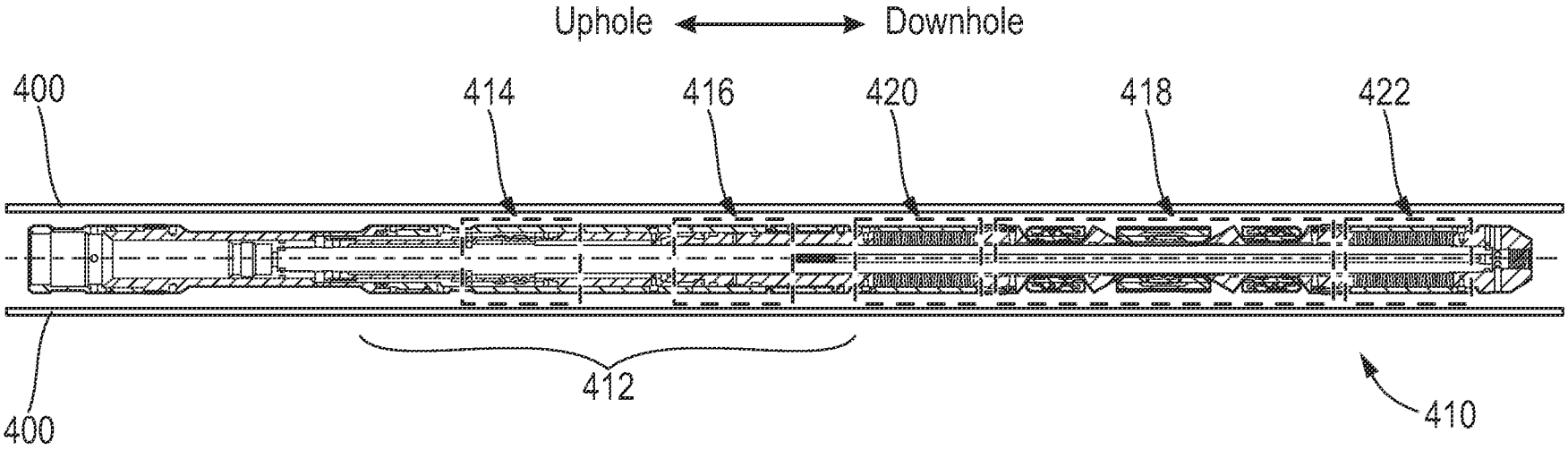
FIG. 40 illustrates a downhole tool having a combined seal and anchor assembly, in accordance with embodiments of the present disclosure.

FIG. 40 illustrates a downhole tool 410 (e.g., plug) having a load retention/equalization mechanism 412 (e.g., having a load retention mechanism 414 positioned uphole from an equalizing assembly 416), a combined seal and anchor assembly 418, and upper and lower seal energizing spring assemblies 420, 422, as described in greater detail herein. As described in greater detail herein, by "bookending" a sealing device against opposite sides of slip/anchor assemblies, the central slip/anchor assemblies become an extrusion barrier for an elastomer seal component under pressure. The slip/anchor assemblies may then provide a dual function as both plug anchor and seal extrusion barrier. There are significant advantages to this "bookend" seal/slip/seal arrangement (e.g., the combined seal and anchor assembly 418). For example, on a conventional retrievable bridge plug, the elastomer seal normally resides above (e.g., uphole from) the slips (e.g., to prevent debris from falling into the slips, jamming and preventing recovery), which means that when pressure is applied from below (e.g., downhole from) the plug, the elastomer forms a piston that is pumped away from the slips, and stretches the inner core of the plug chassis. Hence, it is almost always the tensile strength of the plug inner mandrel that determines the pressure rating of such conventional bridge plug. However, the "bookend seal" arrangement described herein (e.g., the combined seal and anchor assembly 418) guarantees that whichever axial direction differential pressure is applied from, the resultant load is immediately transferred into the slips and then into a wellbore casing 400. By transferring pressure loads directly to the wellbore casing 400 in both directions, the strength of the plug inner mandrel no longer limits the pressure rating of the plug, and potentially far greater pressure ratings and/or cost savings on plug chassis materials may be achieved as a result.

Historically, retrievable bridge plug manufacturers may not have entertained the idea of placing a second seal below the slips in order to gain this benefit due to the risk of then having two elastomer elements that do not collapse to their original size upon recovery, and doubling the amount of force required to pull them through tight restrictions. However, the embodiments described herein (e.g., the combined seal and anchor assembly 418) utilize the enhanced recoverability of the various expanding and collapsing apparatus described herein to allow the benefits of a bookend seal/slip/seal configuration (e.g., of the combined seal and anchor assembly 418) without the conventional drawbacks. The combined seal and anchor assembly 418 also offers relatively robust gas-tight seal performance at conventional setting loads, with minimal redress costs.

The combined seal and anchor assembly 418 described herein may be used as part of a downhole tool 410 in a BHA of wireline or slickline. In general, the combined seal and anchor assembly 418 forms the sealing and anchoring elements of a retrievable bridge plug, and may be used primarily in production environments. In certain embodiments, it may be deployed on wireline runs and may be the target of retrieval operations on either slickline or wireline. In addition, in certain embodiments, the combined seal and anchor assembly 418 may be incorporated into a medium expansion retrievable bridge plug. As opposed to a downhole tool that uses separate slip/anchor assemblies positioned at a downhole isolated location from a sealing device, the combined seal and anchor assembly 418 of the downhole tool 410 combines sealing elements with a set of slips/anchors into one symmetrical assembly. This configuration reacts to the direction of applied pressure in exactly the same way regardless of the direction, either uphole from the combined seal and anchor assembly 418 or downhole from the combined seal and anchor assembly 418.

Figure 41A:
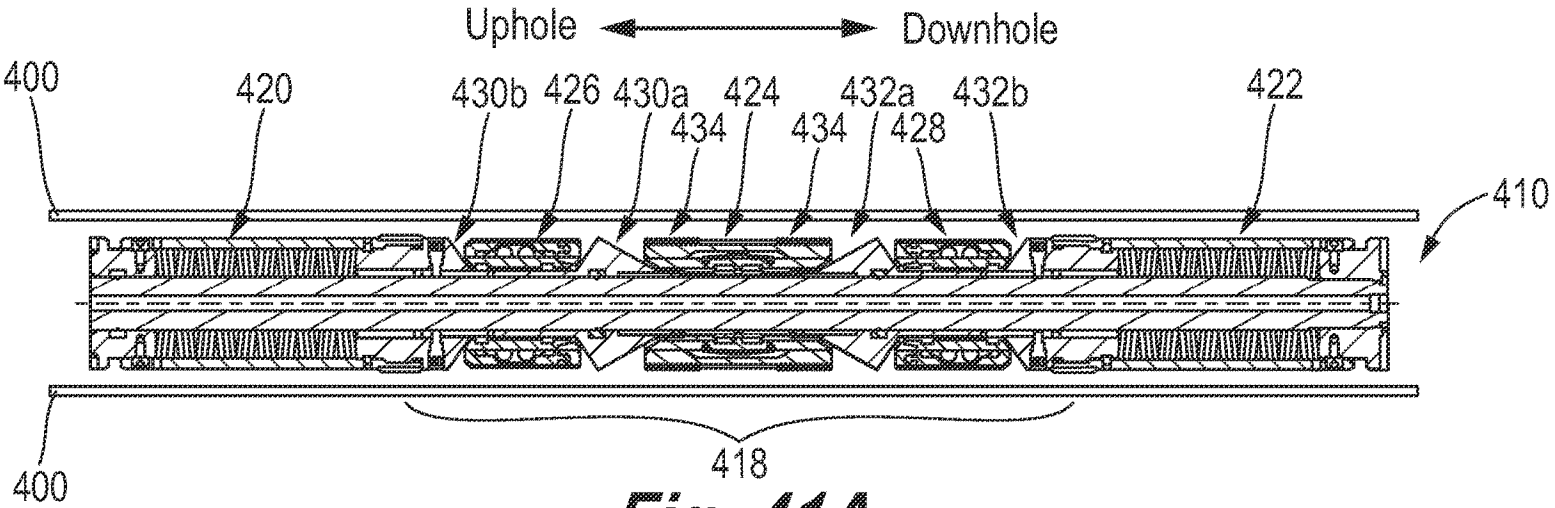
FIGS. 41A and 41B are cross-sectional cutaway views of a portion of a downhole tool of FIG. 40, illustrating a combined seal and anchor assembly in a collapsed condition and an expanded (e.g., set) position, respectively, in accordance with embodiments of the present disclosure.
Figure 41B:
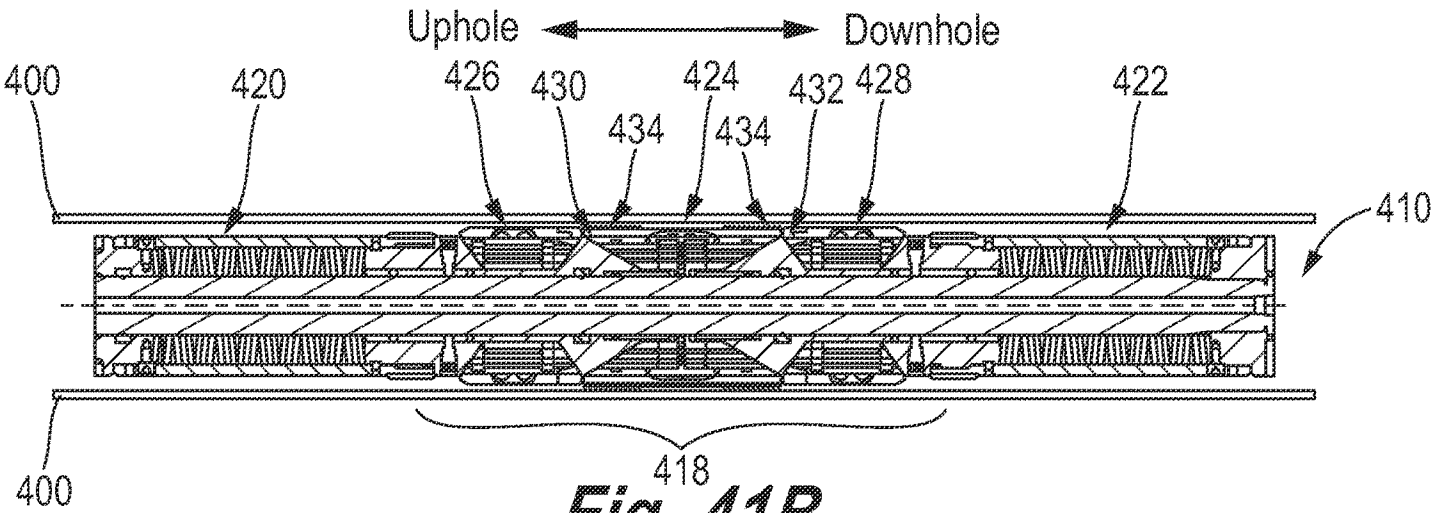
Figure 42A:
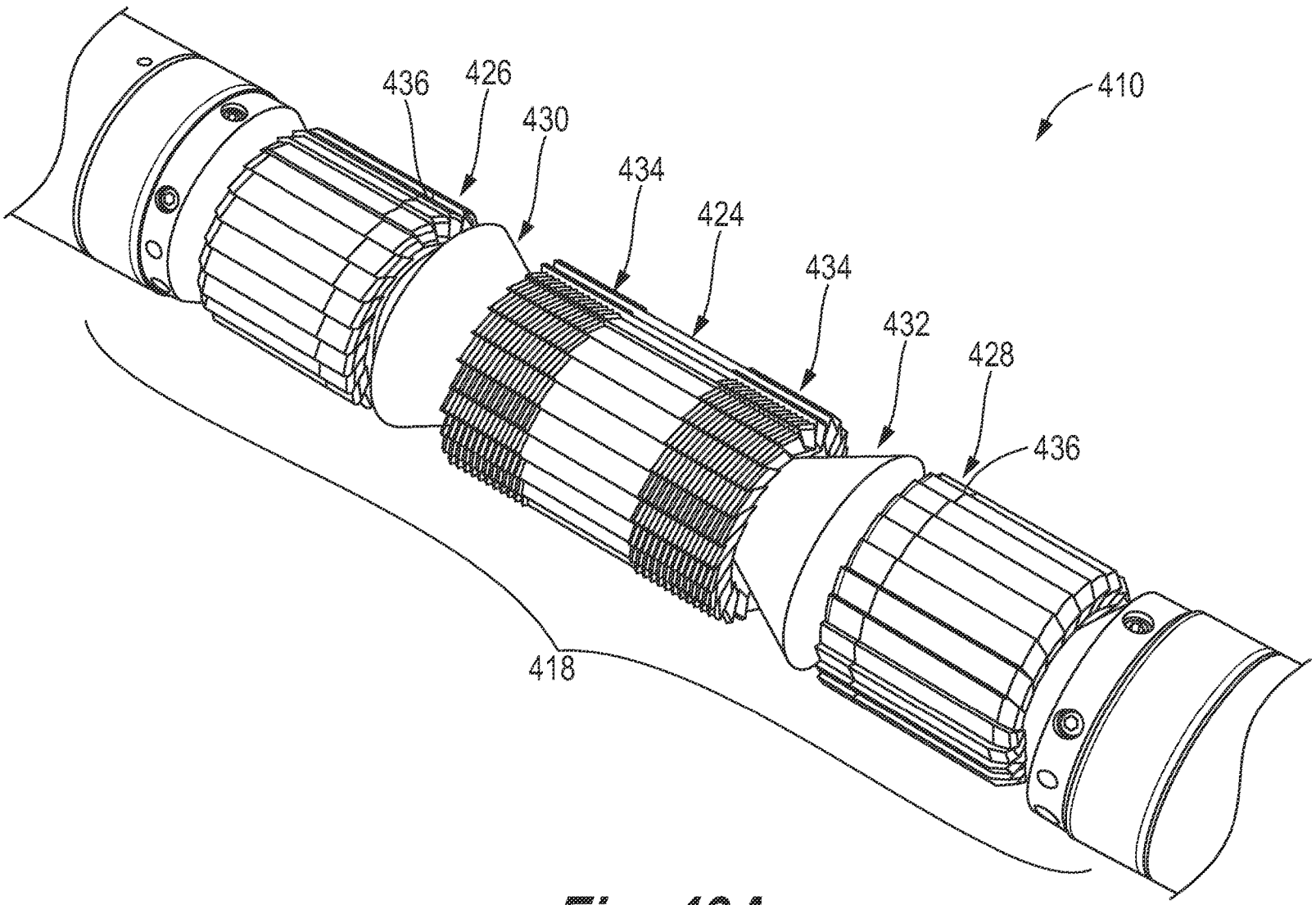
FIGS. 42A and 42B are perspective views of a portion of the downhole tool of FIG. 40, illustrating the combined seal and anchor assembly in a collapsed condition and an expanded (e.g., set) position, respectively, in accordance with embodiments of the present disclosure.
Figure 42B:
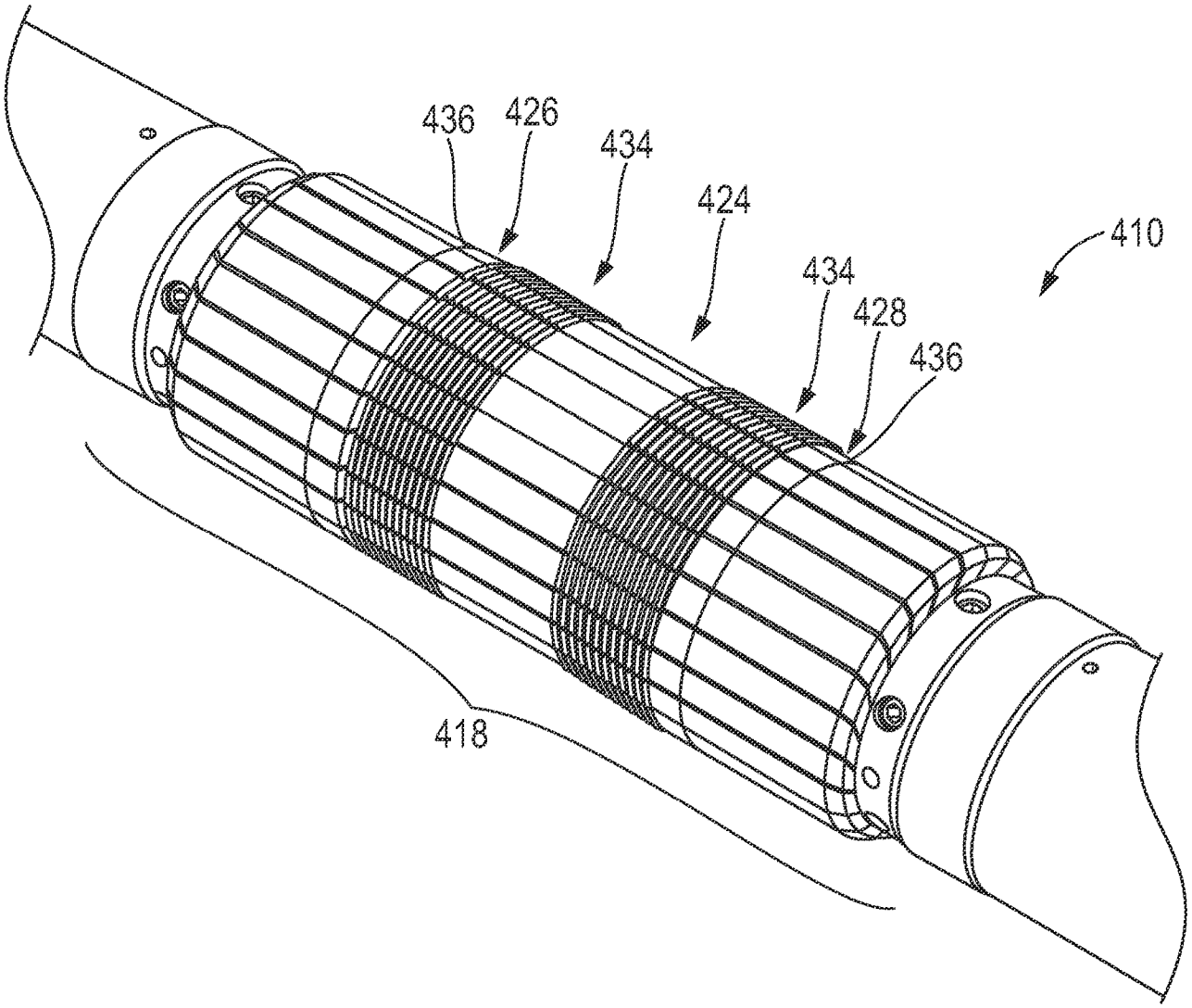

FIGS. 41A and 41B are cross-sectional cutaway views of a portion of the downhole tool 410 of FIG. 40, illustrating the combined seal and anchor assembly 418 in a collapsed condition and an expanded (e.g., set) position, respectively. In addition, FIGS. 42A and 42B are perspective views of a portion of the downhole tool 410 of FIG. 40, illustrating the combined seal and anchor assembly 418 in a collapsed condition and an expanded (e.g., set) position, respectively. As illustrated in FIGS. 41A through 42B, in certain embodiments, the combined seal and anchor assembly 418 may be positioned between an upper seal energizing spring assembly 420 and a lower seal energizing spring assembly 422, which may be used to apply axial forces to energize the combined seal and anchor assembly 418, as described in greater detail herein. In addition, as also illustrated in FIGS. 41A through 42B, in certain embodiments, the combined seal and anchor assembly 418 may contain a central slips cartridge 424 that is bookended by an upper seal cartridge 426 and a lower seal cartridge 428, as described in greater detail herein. Due at least in part on the bookended layout of the seal cartridges 426, 428, regardless of the direction of pressure (e.g., from uphole or from downhole), the sealing provided by the seal cartridges 426, 428 works in exactly the same manner.

In certain embodiments, the combined seal and anchor assembly 418 may be deployed by compression of the external components of the retrievable bridge plug in relation to the inner mandrel, much like the action of a pop-rivet. As described in greater detail herein, as upper and lower support cone assemblies 430, 432 of the combined seal and anchor assembly 418 move towards each other, the combined seal and anchor assembly 418 may be expanded and compressed against the wellbore casing 400. In particular, as illustrated in FIGS. 41A through 42B, in certain embodiments, a first support cone 430*a* of the upper support cone assembly 430 may be positioned axially (e.g., longitudinally) between the upper seal cartridge 426 and the central slips cartridge 424 and a first support cone 432*a* of the lower support cone assembly 432 may be positioned axially (e.g., longitudinally) between the lower seal cartridge 428 and the central slips cartridge 424 such that, as the upper and lower seal cartridges 426, 428 move axially toward each other, they both expand radially themselves as well as urge the first support cones 430*a*, 432*a* of the upper and lower support cone assemblies 430, 432 axially against the central slips cartridge 424, thereby also causing the central slips cartridge 424 to expand radially, as described in greater detail herein. In addition, in certain embodiments, teeth 434 on the outer surface of the central slips cartridge 424 are configured to grip the inner diameter of the wellbore casing 400 to form an anchor, and the bookend seal cartridges 426, 428 are compressed against the ends of the central slips cartridge 424 to form a seal, as described in greater detail herein.

In certain embodiments, the downhole tool 410 may be operated using the following exemplary sequence: (1) the downhole tool 410 may be run into a wellbore as part of a retrievable plug (e.g., on wireline, in certain embodiments; (2) at a desired depth within the wellbore, as the downhole tool 410 begins to set, the upper and lower seal cartridges 426, 428 are forced axially toward the central slips cartridge 424, thereby driving the first support cones 430*a*, 432*a* of the upper and lower support cone assemblies 430, 432 underneath the upper and lower seal cartridges 426, 428 and the central slips cartridge 424 to force elements of the upper and lower seal cartridges 426, 428 and the central slips cartridge 424 radially outwards; (3) the teeth 434 of the central slips cartridge 424 compress against the inner diameter of the wellbore casing 400, thereby producing an anchor for the downhole tool 410; (4) seal elastomer elements 436 compress against the inner diameter of the wellbore casing 400, axial ends of the upper and lower seal cartridges 426, 428 and the central slips cartridge 424, and the upper and lower support cone assemblies 430, 432, thereby forming a seal between the downhole tool 410 and the wellbore casing 400; (5) the downhole tool 410 is set; and (6) the axial load generated by well pressure from either direction (e.g., either uphole from the combined seal and anchor assembly 418 or downhole from the combined seal and anchor assembly 418) is immediately transferred into the central slips cartridge 424 and then directly into the wellbore casing 400.

The downhole tool 410 described herein includes certain components that function together to enable the functionality of the downhole tool 410, namely: (1) slip elements of the central slips cartridge 424, (2) seal body elements of the upper and lower seal cartridges 426, 428, (3) seal elements of the upper and lower seal cartridges 426, 428, (4) the upper and lower support cone assemblies 430, 432, and (5) the upper and lower seal energizing spring assemblies 420, 422, each of which will be described in further detail below.

Figure 43B:
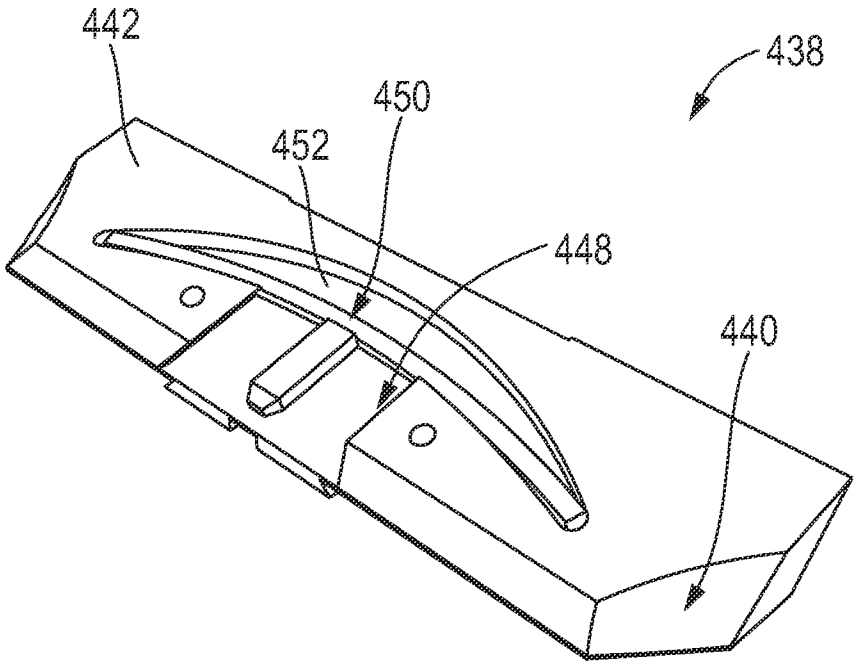
FIGS. 43A and 43B are top and bottom perspective views, respectively, of slip elements of a central slips cartridge, in accordance with embodiments of the present disclosure.
Figure 43A:
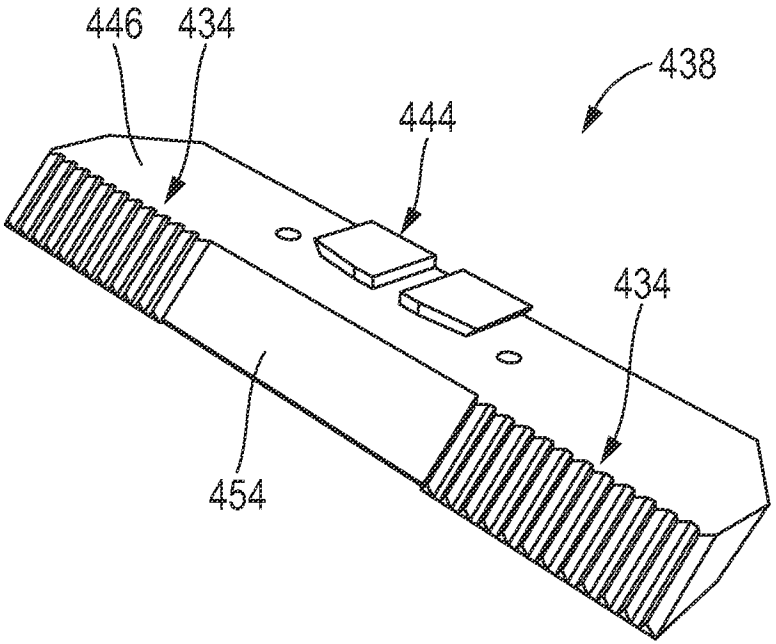
Figure 44B:
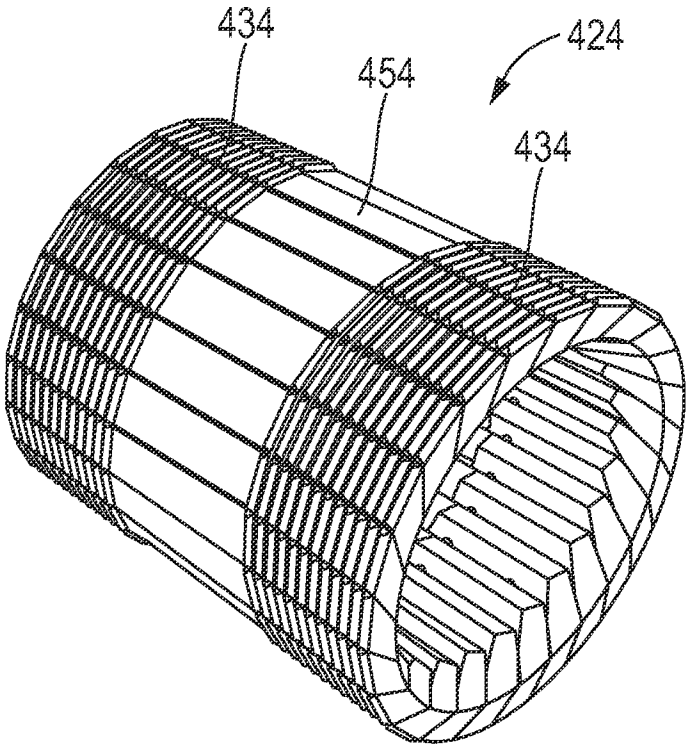
FIGS. 44A and 44B are perspective views of the slip elements of the central slips cartridge in a collapsed condition and an expanded (e.g., set) condition, respectively, in accordance with embodiments of the present disclosure.
Figure 44A:
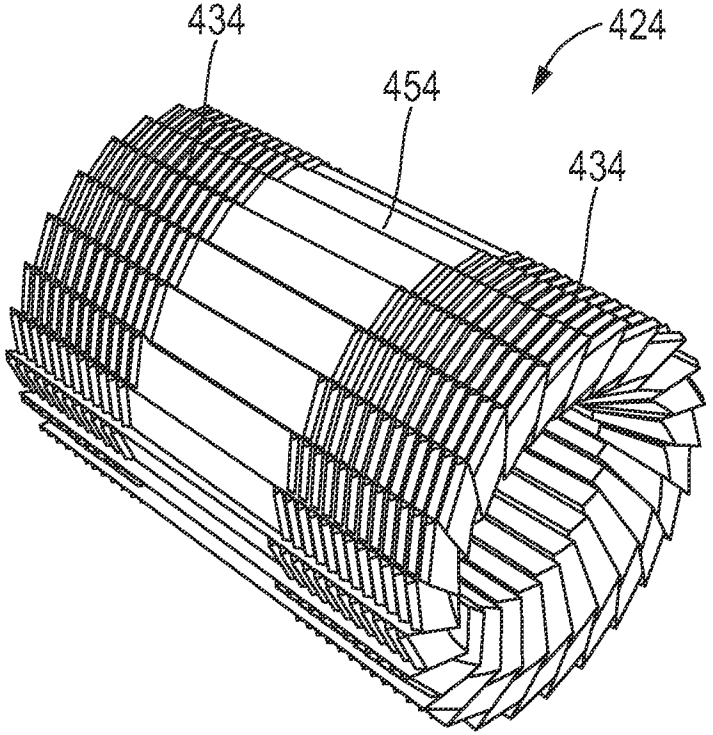

For example, FIGS. 43A and 43B are top and bottom perspective views, respectively, of the slip elements 438 of the central slips cartridge 424, and FIGS. 44A and 44B are perspective views of the slip elements 438 of the central slips cartridge 424 in a collapsed condition and an expanded (e.g., set) condition, respectively, illustrating how adjacent slip elements 438 interact with each other. In general, when the support cone assemblies 430, 432) transfer an axial force and a radial force to the slip elements 438 (e.g., due to the wedging effect of the first support cones 430*a*, 432*a* of the support cone assemblies 430, 432 moving underneath the slip elements 438), the slip elements 438 move radially outward and slide circumferentially relative to each other such that the slip elements 438 form a relatively constant outer diameter (e.g., +/−5%, +/−4%, +/−3%, +/−2%, +/−1%, +/−0.5%, or even closer, at any circumferential location) when in the expanded (e.g., set) condition (e.g., as illustrated in FIG. 44B), as described in greater detail herein. As described in greater detail herein, in certain embodiments, the slip elements 438 may be comprised of a metal or a metal alloy that is coated with a polymeric, elastomeric or rubber material.

As illustrated most clearly in FIG. 43B, in certain embodiments, the slip elements 438 may include a tapered (e.g., angled) axial end portion 440 at each axial end of the slip elements 438, which abut the first support cones 430*a*, 432*a* of the support cone assemblies 430, 432 such that the axial and radial forces are transferred from the support cone assemblies 430, 432 to the tapered axial end portions 440 of the slip elements 438, as described in greater detail herein. In particular, as illustrated, the tapered axial end portions 440 of the slip elements 438 are angled more toward an inner surface 442 of the slip elements 438 to facilitate the transfer of the axial and radial forces described herein.

As illustrated in FIGS. 43A and 43B, to aid in ensuring that adjacent slip elements 438 remain fixed axially relative to each other, in certain embodiments, each of the slip elements 438 may include one or more dovetail projections 444 disposed on an outer surface 446 of the slip element 438 and one or more dovetail recesses 448 disposed on the inner surface 442 of the slip element 438, such that mating dovetail projections 444 and dovetail recesses 448 of adjacent slip elements 438 interact with each other to ensure that the slip elements 438 remain axially aligned while the slip elements 438 slide circumferentially relative to each other.

In addition, as illustrated in FIG. 43B, in certain embodiments, the slip elements 438 may include a return bias beam spring 450 disposed within a spring mounting cavity 452 that extends into (e.g., is internal to) the respective slip element 438 on the inner surface 442 of the respective slip element 438. In general, the return bias beam spring 450 may act opposite to the circumferential movement of adjacent slip elements 438 to provide a return bias force. As illustrated, in certain embodiments, the spring mounting cavity 452 may be curved such that the return bias beam spring 450 may be capable of deforming circumferentially within the spring mounting cavity 452 while axial ends of the return bias beam spring 450 remain relatively fixed at axial ends of the spring mounting cavity 452. In addition, the spring mounting cavity 452 also functions as a hard stop for the dovetails formed by mating dovetail projections 444 and dovetail recesses 448 of adjacent slip elements 438 to act as a travel limiter to prevent the slip elements 438 from over-expanding. In general, internal spring mounting is beneficial as it protects the return bias beam spring 450 from damage when running in the hole and also prevents ingress of debris and dirt. In addition, the central slips cartridge 424 presents a relatively smooth external profile.

However, although illustrated in FIGS. 43A and 43B as having the dovetail projections 444 disposed on outer surfaces 446 of the slip elements 438 and having the dovetail recesses 448 disposed on inner surfaces 442 of the slip elements 438, in other embodiments, the dovetail projections 444 may instead be disposed on the inner surfaces 442 of the slip elements 438 and the dovetail recesses 448 may instead be disposed on the inner surfaces 442 of the slip elements 438. Similarly, in certain embodiments, instead of being disposed on the inner surfaces 442 of the slip elements 438, the spring mounting cavities 452 and associated return bias beam springs 450 may instead by disposed on the outer surfaces 446 of the slip elements 438.

In addition, the teeth 434 disposed on the outer surfaces 446 of the slip elements 438 generally axially align with each other such that the teeth 434 form a relatively constant contact surface when in the expanded (e.g., set) condition, for example, as illustrated in FIG. 44B. In addition, as described in greater detail herein, the sets of teeth 434 may be disposed near both axial ends of the slip elements 438 with the axially upper (e.g., uphole) set of teeth 434 separated from the axially lower (e.g., downhole) set of teeth 434 by a relatively smooth portion 454 of the outer surfaces 446 of the slip elements 438. In other embodiments, the slip elements 438 may include any number of sets of teeth 434 disposed on the outer surfaces 446 of the slip elements 438 in any configuration.

Figure 45A:
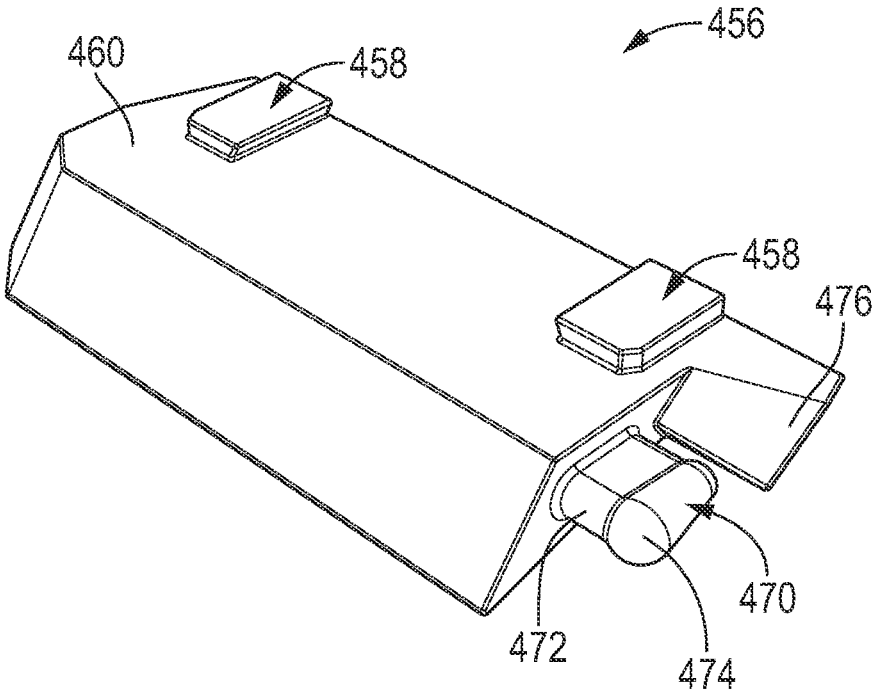
FIGS. 45A and 45B are top and bottom perspective views, respectively, of seal body elements of upper and lower seal cartridges, in accordance with embodiments of the present disclosure.
Figure 45B:
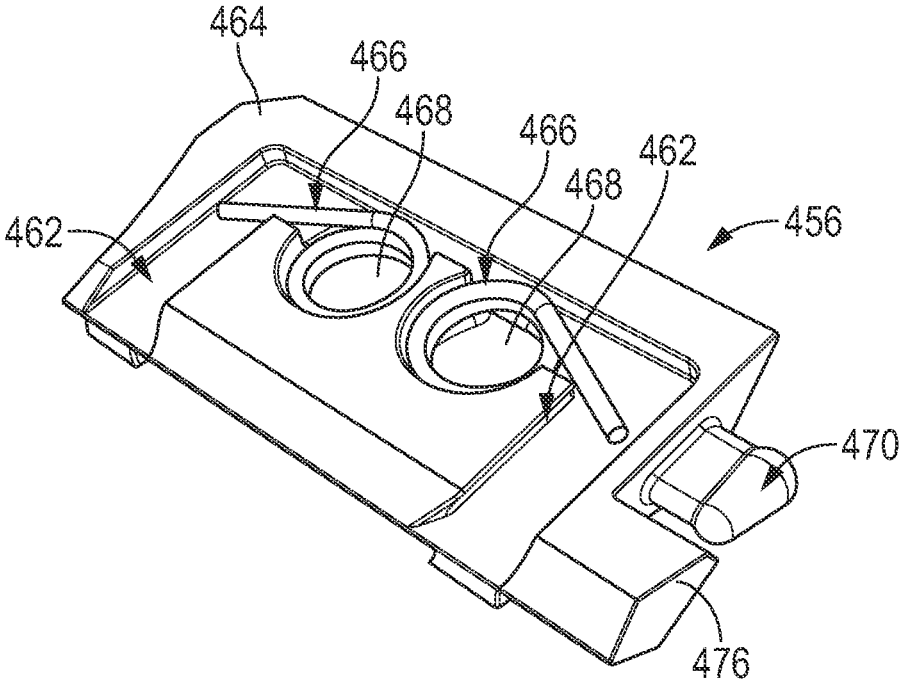
Figure 46B:
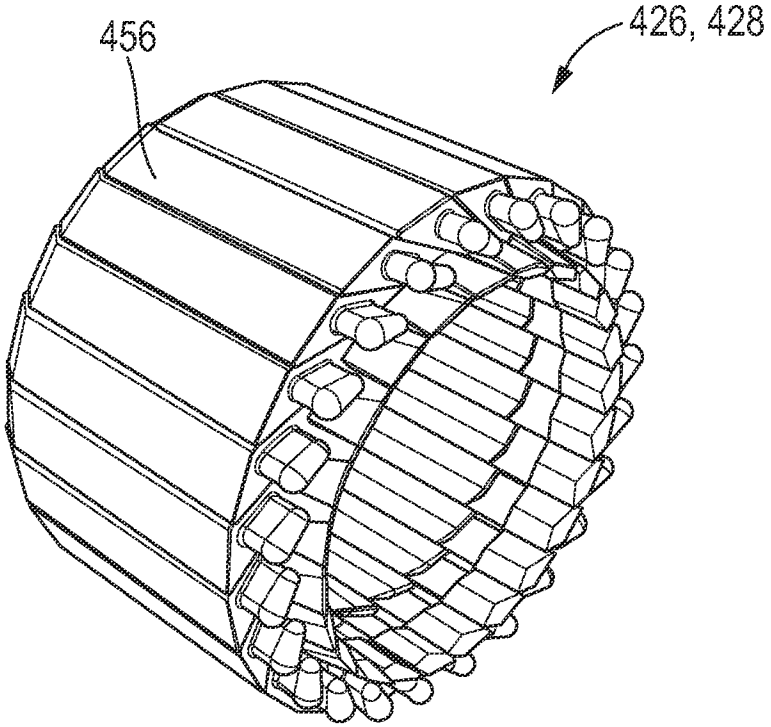
FIGS. 46A and 46B are perspective views of the seal body elements of the upper and lower seal cartridges in a collapsed condition and an expanded (e.g., set) condition, respectively, in accordance with embodiments of the present disclosure.
Figure 46A:
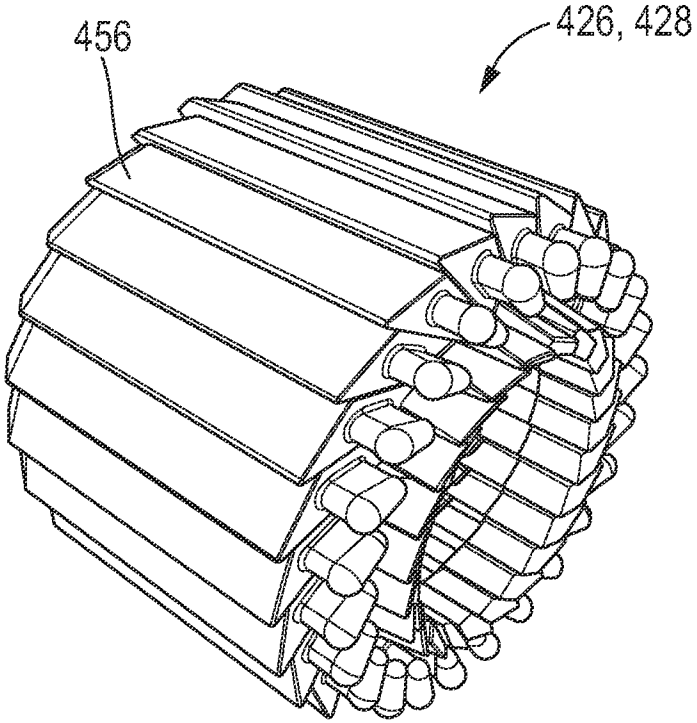

FIGS. 45A and 45B are top and bottom perspective views, respectively, of the seal body elements 456 of the upper and lower seal cartridges 426, 428, and FIGS. 46A and 46B are perspective views of the seal body elements 456 of the upper and lower seal cartridges 426, 428 in a collapsed condition and an expanded (e.g., set) condition, respectively, illustrating how adjacent seal body elements 456 interact with each other. It will be appreciated that the seal body elements 456 of the upper and lower seal cartridges 426, 428 may be substantially similar to each other, only being mirror images of each other from an axial standpoint, in certain embodiments. In general, when the upper and lower seal cartridges 426, 428 move axially toward the central slips cartridge 424, interaction with the first support cones 430*a*, 432*a* of the support cone assemblies 430, 432 may cause the seal body elements 456 to move radially outward and slide circumferentially relative to each other (e.g., due to the wedging effect of the first support cones 430*a*, 432*a* of the support cone assemblies 430, 432 moving underneath the seal body elements 456) such that the seal body elements 456 form a relatively constant outer diameter (e.g., +/−5%, +/−4%, +/−3%, +/−2%, +/−1%, +/−0.5%, or even closer, at any circumferential location) when in the expanded (e.g., set) condition (e.g., as illustrated in FIG. 46B), as described in greater detail herein. As described in greater detail herein, in certain embodiments, the seal body elements 456 may be comprised of a metal or a metal alloy that is coated with a polymeric, elastomeric or rubber material.

As illustrated in FIGS. 45A and 45B, similar to the slip elements 438, to aid in ensuring that adjacent seal body elements 456 remain fixed axially relative to each other, in certain embodiments, each of the seal body elements 456 may include one or more dovetail projections 458 disposed on an outer surface 460 of the seal body element 456 and one or more dovetail recesses 462 disposed on an inner surface 464 of the seal body element 456, such that mating dovetail projections 458 and dovetail recesses 462 of adjacent seal body elements 456 interact with each other to ensure that the seal body elements 456 remain axially aligned while the seal body elements 456 slide circumferentially relative to each other.

In addition, as illustrated in FIG. 45B, in certain embodiments, the seal body elements 456 may include one or more return bias torsion springs 466 disposed within respective spring mounting cavities 468 that extend into (e.g., are internal to) the respective seal body element 456 on the inner surface 464 of the respective seal body element 456. In general, the return bias torsion springs 466 may act opposite to the circumferential movement of adjacent seal body elements 456 to provide a return bias force. As illustrated, in certain embodiments, the spring mounting cavities 468 may be generally circular such that the respective return bias torsion springs 466 may be capable of deforming within the spring mounting cavities 468 while ends of the return bias torsion springs 466 are circumferentially acted upon by the dovetail projections 458. In addition, the spring mounting cavities 468 also function as hard stops for the dovetails formed by mating dovetail projections 458 and dovetail recesses 462 of adjacent seal body elements 456 to act as a travel limiter to prevent the seal body elements 456 from over-expanding. In general, internal spring mounting is beneficial as it protects the return bias torsion springs 466 from damage when running in the hole and also prevents ingress of debris and dirt. In addition, the seal cartridges 426, 428 present relatively smooth external profiles.

However, although illustrated in FIGS. 45A and 45B as having the dovetail projections 458 disposed on outer surfaces 460 of the seal body elements 456 and having the dovetail recesses 462 disposed on inner surfaces 464 of the seal body elements 456, in other embodiments, the dovetail projections 458 may instead be disposed on the inner surfaces 464 of the seal body elements 456 and the dovetail recesses 462 may instead be disposed on the inner surfaces 464 of the seal body elements 456. Similarly, in certain embodiments, instead of being disposed on the inner surfaces 464 of the seal body elements 456, the spring mounting cavities 468 and associated return bias torsion springs 466 may instead by disposed on the outer surfaces 460 of the seal body elements 456.

In addition, as illustrated in FIGS. 45A and 45B, in certain embodiments, the seal body elements 456 may include one or more seal element mounting mechanisms 470 (e.g., spigots) disposed at one axial end of the respective seal body element 456 and configured to hold a respective seal element in place relative to the respective seal body element 456. In particular, in certain embodiments, the one or more seal element mounting mechanisms 470 may include a neck 472 that extends axially from the respective seal body element 456, and a knob end 474 around which the elastomer material of the respective seal element may snap, holding the seal element in place both axially with respect to the seal body element 456 but also rotationally with respect to the seal body element 456 such that the seal element remains relatively fixed at the axial end of the seal body element 456. In particular, as illustrated in FIGS. 45A and 45B, in certain embodiments, both the neck 472 and the knob end 474 of the seal element mounting mechanisms 470 may have a generally elongated (or otherwise non-circular) cross-sectional shape that may be inserted into a similarly shaped opening (e.g., socket) of the respective seal element to prevent rotation of the respective seal element with respect to the respective seal body element 456, as described in greater detail herein. In addition, in certain embodiments, the seal body elements 456 may also include a separate tab 476 that extends from the axial end of the respective seal body element 456, which is configured to support an underside of the respective seal element to further prevent rotation of the respective seal body element 456 as well as prevent extrusion under compression, as also described in greater detail herein.

Figure 47B:
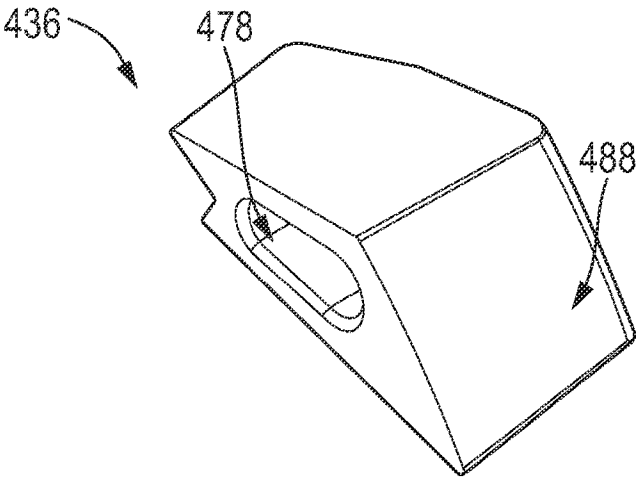
FIGS. 47A, 47B, and 47C are a distal perspective view, a proximal perspective view, and a transparent proximal view of an exemplary seal element, in accordance with embodiments of the present disclosure.
Figure 47C:
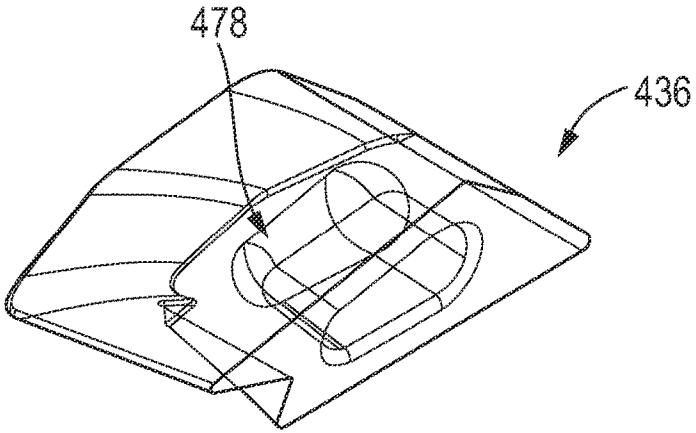
Figure 47A:
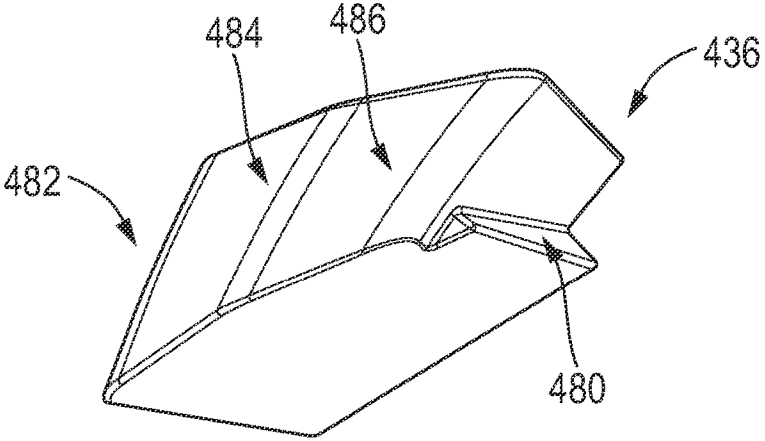
Figure 48B:
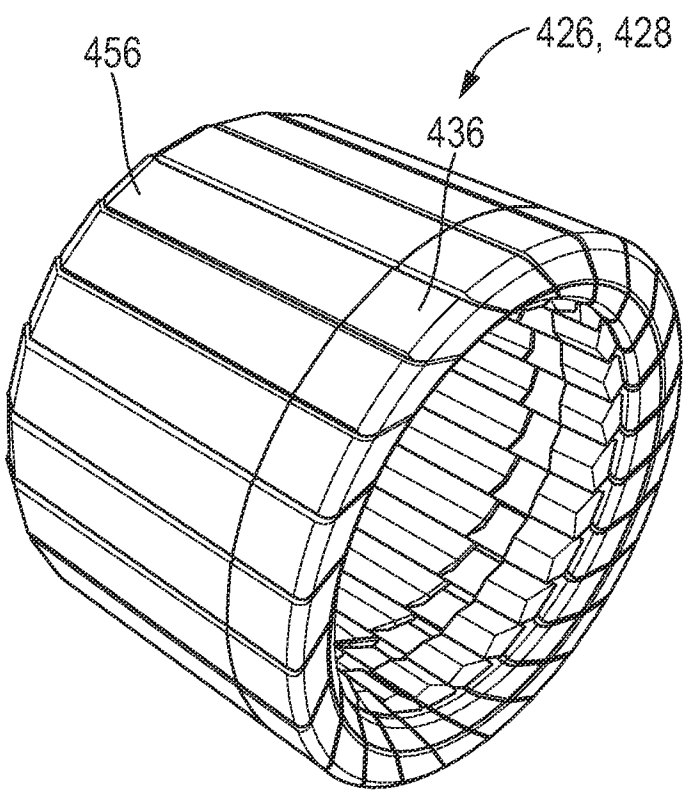
FIGS. 48A and 48B are perspective views of the seal body elements and associated seal elements of the upper and lower seal cartridges in a collapsed condition and an expanded (e.g., set) condition, respectively, in accordance with embodiments of the present disclosure.
Figure 48A:
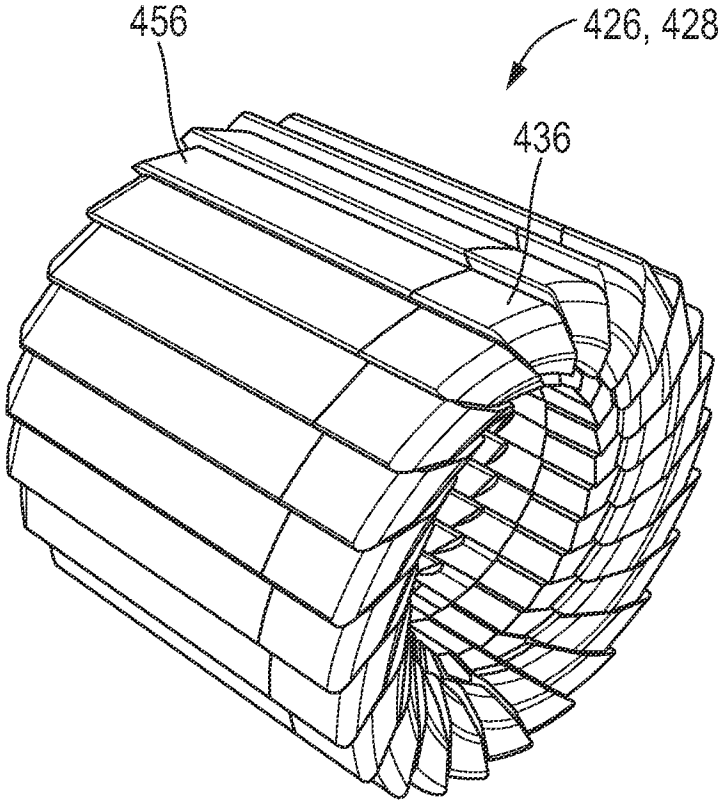

FIGS. 47A, 47B, and 47C are a distal perspective view, a proximal perspective view, and a transparent proximal view of an exemplary seal element 436, and FIGS. 48A and 48B are perspective views of the seal body elements 456 and associated seal elements 436 of the upper and lower seal cartridges 426, 428 in a collapsed condition and an expanded (e.g., set) condition, respectively, illustrating how adjacent seal body elements 456 and associated seal elements 436 interact with each other. An advantage of having the seal elements 436 removably mountable to the seal body elements 456 is that the seal elements 436 is that they may be set at the worksite. In addition, the fact that the seal elements 436 are replaceable at the worksite enables less downtime when having to service the downhole tool 410. In addition, because the seal elements 436 are so readily removable and replaceable enables using seal elements 436 that are differently shaped, for example, when a particular parameter of the wellbore is encountered, as well as enabling substitution of the same seal element 436 in a different material.

As illustrated most clearly in FIG. 47B, in certain embodiments, the seal elements 436 may include one or more seal element mounting openings 478 (e.g., sockets) into which the seal element mounting mechanisms 470 of the respective seal body elements 456 may be inserted to hold the respective seal body elements 456 in place relative to the respective seal elements 436. As described above with respect to the seal element mounting mechanisms 470, in certain embodiments, the seal elements 436 may have a generally elongated (or otherwise non-circular) cross-sectional shape that may receive similarly shaped seal element mounting mechanisms 470 to prevent rotation of the respective seal element 436 with respect to the respective seal body element 456. In addition, in certain embodiments, the seal elements 436 may include an anti-rotation tab 480, which may interact with the mating tab 476 that extends from the respective seal body element 456 to further prevent rotation of the respective seal element 436 with respect to the respective seal body element 456.

In addition, as illustrated in FIG. 47A, in certain embodiments, a distal face 482 of the seal elements 436 may include two face portions: (1) a slip contact face portion 484 configured to contact an adjacent surface of a respective slip element 438 of the central slips cartridge 424, and (2) a cone contact face portion 486 configured to contact an adjacent surface of an adjacent support cone assembly 430, 432, as described in greater detail herein. As illustrated, the two contact face portions 484, 486 of the distal face 482 will be specifically contoured to accommodate for the specific contact and rotational angles of the components of the combined seal and anchor assembly 418. In addition, as illustrated in FIG. 47B, in certain embodiments, a lateral face 488 of the seal elements 436 may be configured to contact the wellbore casing 400 (not shown). The lateral faces 488 of the seal elements 436 will be specifically contoured to accommodate for the specific contact and rotational angles of the components of the combined seal and anchor assembly 418.

As described in greater detail herein, in certain embodiments, the seal elements 436 may be comprised of a compliant or elastomeric material such as an elastomer, polymer, or rubber to suit different temperature, pressure, and chemical resistance requirements. The seal elements 436 may be specifically designed for economical injection molding in large quantities in any suitable elastomeric seal material. In addition, the seal elements 436 incorporate a recessed profile (e.g., including the seal element mounting openings 478) to produce a positive "snap on" relationship to the metal seal body elements 456 (e.g., including the seal element mounting mechanisms 470), which also ensures that the elastomeric material is trapped and cannot be easily removed once the seal elements 436 have been assembled into the respective seal cartridge 426, 428. In addition to the elongated recessed profile (e.g., including the seal element mounting openings 478), the seal elements 436 may also include the additional anti-rotation tabs 480, which locates against the metal seal body elements 456 to prevent rotation.

Figure 49A:
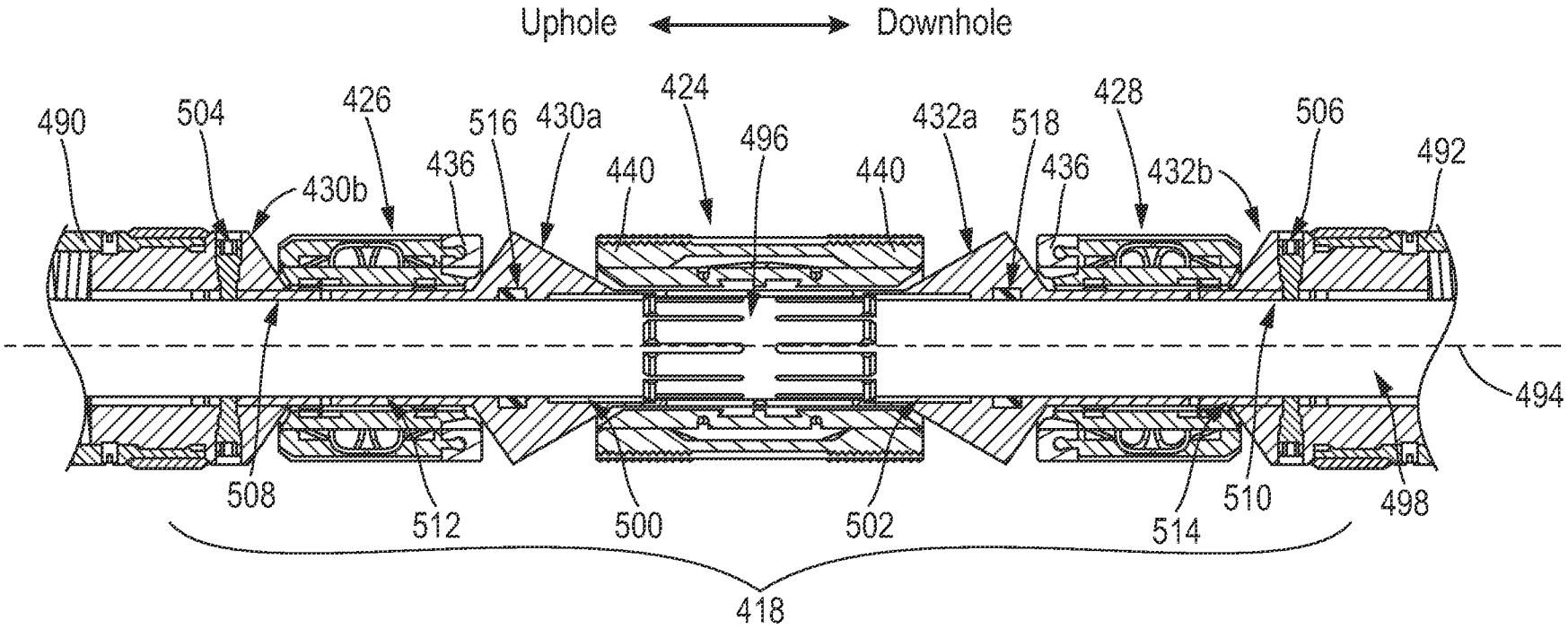
FIGS. 49A and 49B are cross-sectional cutaway views of the combined seal and anchor assembly in a collapsed condition and an expanded (e.g., set) position, respectively, in accordance with embodiments of the present disclosure.
Figure 49B:
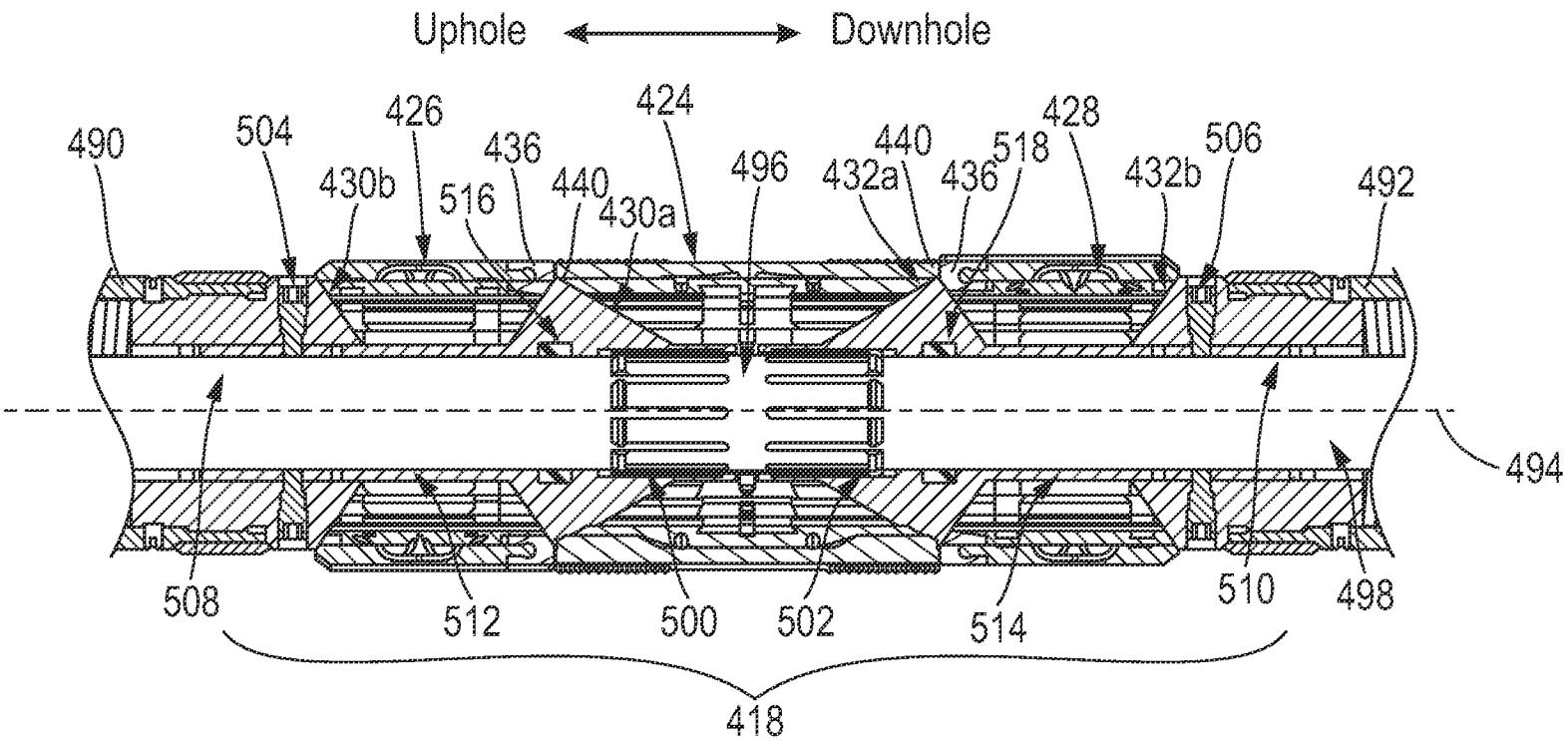

FIGS. 49A and 49B are cross-sectional cutaway views of the combined seal and anchor assembly 418 in a collapsed condition and an expanded (e.g., set) position, respectively, illustrating how the upper and lower support cone assemblies 430, 432 interact with the other components of the combined seal and anchor assembly 418. As illustrated in FIGS. 49A and 49B, in certain embodiments, the upper and lower support cone assemblies 430, 432 may each include a first support cone 430*a*, 432*a* configured to be disposed axially (e.g., longitudinally) between the central slips cartridge 424 and an adjacent seal cartridge 426, 428, and a second support cone 430*b*, 432*b* configured to be disposed axially (e.g., longitudinally) between the adjacent seal cartridge 426, 428 and an adjacent spring cover sleeve 490, 492 of a respective seal energizing spring assemblies 420, 422. As described in greater detail herein, the pressure (e.g., whether from uphole and/or from downhole of the downhole tool 410) pushes at the axial points at which the seal cartridges 426, 428 abut the central slips cartridge 424. In addition, all of the load is transferred to the wellbore casing 400 (not shown) and not to the inner mandrel 498 at all. Specifically, the inner mandrel 498 only experiences the setting force in tension.

In addition, as opposed to other embodiments, the elastomer that is being used (e.g., the seal elements 436) is not stretched during expansion, but simply moved as it is expanded. In particular, a feature of the embodiments of the combined seal and anchor assembly 418 described herein is that while the seal is being expanded, the elastomer is inert (e.g., in a zero stress condition) until it hits the wellbore casing 400 (not shown), at which point material stress is generated almost entirely in compression. In general, hoop stresses cannot be generated in a circular seal that has been sliced into a plurality of seal elements 436 (e.g., up to 24 seal elements 436, in certain embodiments). Limiting the seal to a compression stress-only application also makes finite element analysis (FEA) modelling a far simpler process during the design stage. As used herein, the terms "almost entirely in compression", "only in compression", "compression stress-only", and so forth, may be used to mean that compression stresses applied to the seal elements 436 during expansion of the combined seal and anchor assembly 418 into the seal elements 436 contacting the wellbore casing 400 (not shown) are at least 95%, at least 96%, at least 97%, at least 98%, at least 99%, at least 99.5%, or an even greater percentage, of the total stresses applied to the seal elements 436, as opposed to other types of stresses, due to the unique design of the combined seal and anchor assembly 418 described in greater detail herein.

In contrast, in conventional elastomer seals (e.g., "bung" seals), the elastomer sees a complex mix of compression and hoop (tensile) stress as it is compressed outwards to the casing, and then additional compression stress is subsequently applied once it hits the casing inner diameter. Ultimately, such conventional elastomer seals are relatively difficult to design properly, and it is this relatively high level of stress (in particular, the internal shear stresses generated when something is in both tensile and compression) that leads to the conventional elastomer seals not returning to their original shapes, leading to well-documented recovery issues as the plug is retrieved through tight restrictions.

In more detail, the elimination of competing tensile forces in the elastomer means that the elastomer is not subject to the normal expansion constraints affecting conventional seals that are due to the stress buildup in the elastomer. Rather, the elastomer is only constrained by the physical geometry of the expanding structure and its ability to form a substantially circular seal and extrusion barrier. In contrast, in a typical bung seal, for example, the competing elastomer design requirements of higher performance (e.g., pressure and temperature), higher expansion, chemical compatibility, and residual elasticity (e.g., for recovery) mean that the design is always a compromise between these requirements. As a result, conventional bung seal designs tend to either have limited technical specifications and/or be prone to recovery problems due to elastomer failure or non-retraction when those technical limits are challenged. The embodiments described herein eliminate this source of design compromise, and allow the performance, expansion, chemical compatibility, and retraction force to all be optimized substantially independently.

Again, an advantage of the embodiments of the combined seal and anchor assembly 418 described herein is that it separates out the two discrete functions that are provided by the elastomer material in a conventional elastomer seals: the sealing capability (e.g., resisting compressive stress) is provided by the array of seal elements 436, but the bias towards its collapsed state is provided by an entirely separate mechanical component with greater reliability—the array of internal return bias torsion springs 466, for example. As such, the recoverability of the downhole tools 410 described herein will be far better than conventional downhole tools.

In addition, the upper support cone assembly 430 may include a first support cone 430*a* configured to be disposed axially (e.g., longitudinally) between the central slips cartridge 424 and the upper seal cartridge 426, and a second support cone 430*b* configured to be disposed axially (e.g., longitudinally) between the upper seal cartridge 426 and an upper spring cover sleeve 490 of the upper seal energizing spring assembly 420. Similarly, the lower support cone assembly 432 may include a first support cone 432*a* configured to be disposed axially (e.g., longitudinally) between the central slips cartridge 424 and the lower seal cartridge 428, and a second support cone 432*b* configured to be disposed axially (e.g., longitudinally) between the lower seal cartridge 428 and a lower spring cover sleeve 492 of the lower seal energizing spring assembly 422.

As such, the first support cones 430*a*, 432*a* both have two angled support cone surfaces (e.g., one configured to interact with the central slips cartridge 424 and the other configured to interact with the adjacent seal cartridge 426, 428), whereas the second support cones 430*b*, 432*b* both have only one angled support cone surface (e.g., to interact with the adjacent seal cartridge 426, 428). In certain embodiments, the first support cone surfaces of the first support cones 430*a*, 432*a* (e.g., that interact with the central slips cartridge 424) may be angled at an angle of approximately 30 degrees, between approximately 25 degrees and approximately 35 degrees, or between approximately 20 degrees and approximately 40 degrees, relative to a central longitudinal axis 494 of the combined seal and anchor assembly 418. In addition, in certain embodiments, the second support cone surfaces of the first support cones 430*a*, 432*a* (e.g., that interact with the adjacent seal cartridge 426, 428) may be angled at an angle of approximately 55 degrees, between approximately 50 degrees and approximately 60 degrees, or between approximately 45 degrees and approximately 65 degrees, relative to the central longitudinal axis 494 of the combined seal and anchor assembly 418. In addition, in certain embodiments, the lone support cone surfaces of the second support cones 430*b*, 432*b* (e.g., that interact with the adjacent seal cartridge 426, 428) may be angled at an angle of approximately 55 degrees, between approximately 50 degrees and approximately 60 degrees, or between approximately 45 degrees and approximately 65 degrees, relative to the central longitudinal axis 494 of the combined seal and anchor assembly 418.

As also illustrated in FIGS. 49A and 49B, in certain embodiments, the telescoping upper and lower support cone assemblies 430, 432 may be mechanically linked via a central collet and sliding pin arrangement to ensure that the central slips cartridge 424 and the seal cartridges 426, 428 can be positively pulled apart to collapse the central slips cartridge 424 and the seal cartridges 426, 428 and enable recovery of the downhole tool 410. In particular, in certain embodiments, upper and lower prongs of a central collet 496 (e.g., disposed radially about an inner mandrel 498) are configured to move within respective travel limiting recesses 500, 502 formed between the inner mandrel 498 and inner diameters of the first support cones 430*a*, 432*a*, respectively, of the upper and lower support cone assemblies 430, 432 to limit axial travel of the first support cones 430*a*, 432*a* relative to the inner mandrel 498 and, thus, relative to the central slips cartridge 424.

In addition, in certain embodiments, upper and lower travel limiting pins 504, 506, which extend radially though second support cones 430*b*, 432*b* of the upper and lower support cone assemblies 430, 432, respectively, may be configured to move within respective travel limiting slots 508, 510 through respective telescoping necks 512, 514 that extend axially from the first support cones 430*a*, 432*a* and between respective second support cones 430*b*, 432*b* and the inner mandrel 498 to limit axial travel of the second support cones 430*b*, 432*b* relative to the respective telescoping necks 512, 514 and, thus, relative to the respective first support cones 430*a*, 432*a*. As will be appreciated, such embodiments having the telescoping necks 512, 514 extending through respective second support cones 430*b*, 432*b* enables that second support cones 430*b*, 432*b* to move axially relative to the respective first support cones 430*a*, 432*a*. In addition, in certain embodiments, the first support cones 430*a*, 432*a* of the upper and lower support cone assemblies 430, 432 house respective o-rings 516, 518, for example, between the first support cones 430*a*, 432*a* and the inner mandrel 498, which provide a pressure seal to the inner mandrel 498.

Figure 50A:
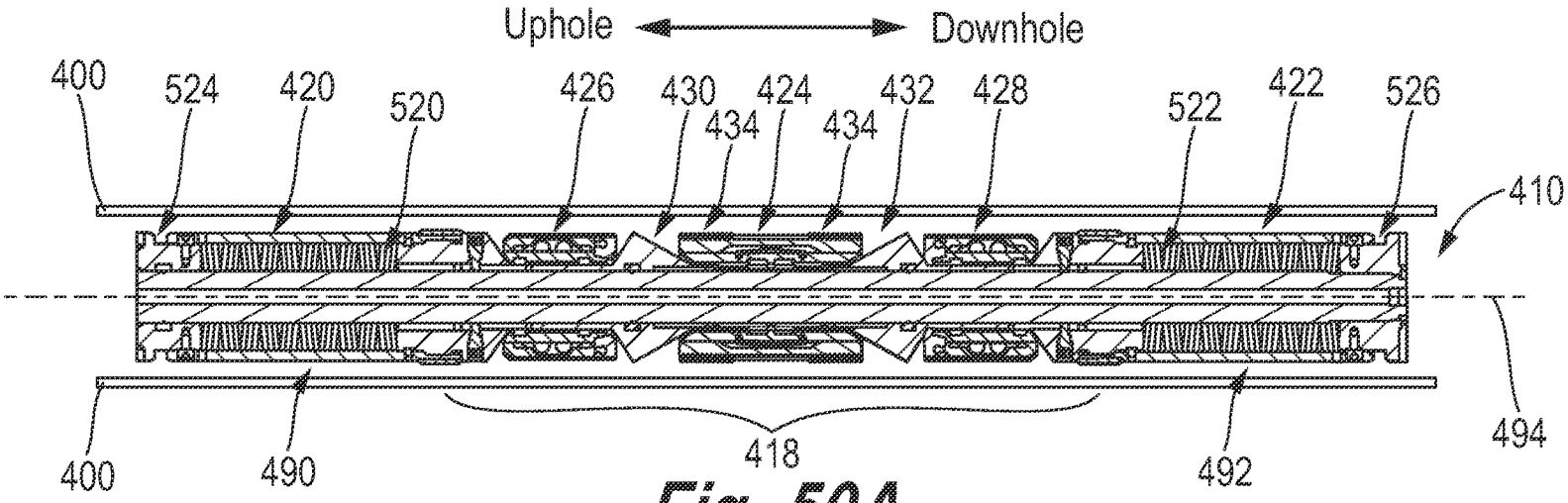
FIGS. 50A and 50B are cross-sectional cutaway views of upper and lower seal energizing spring assemblies and the combined seal and anchor assembly in a collapsed condition and an expanded (e.g., set) position, respectively, in accordance with embodiments of the present disclosure.
Figure 50B:
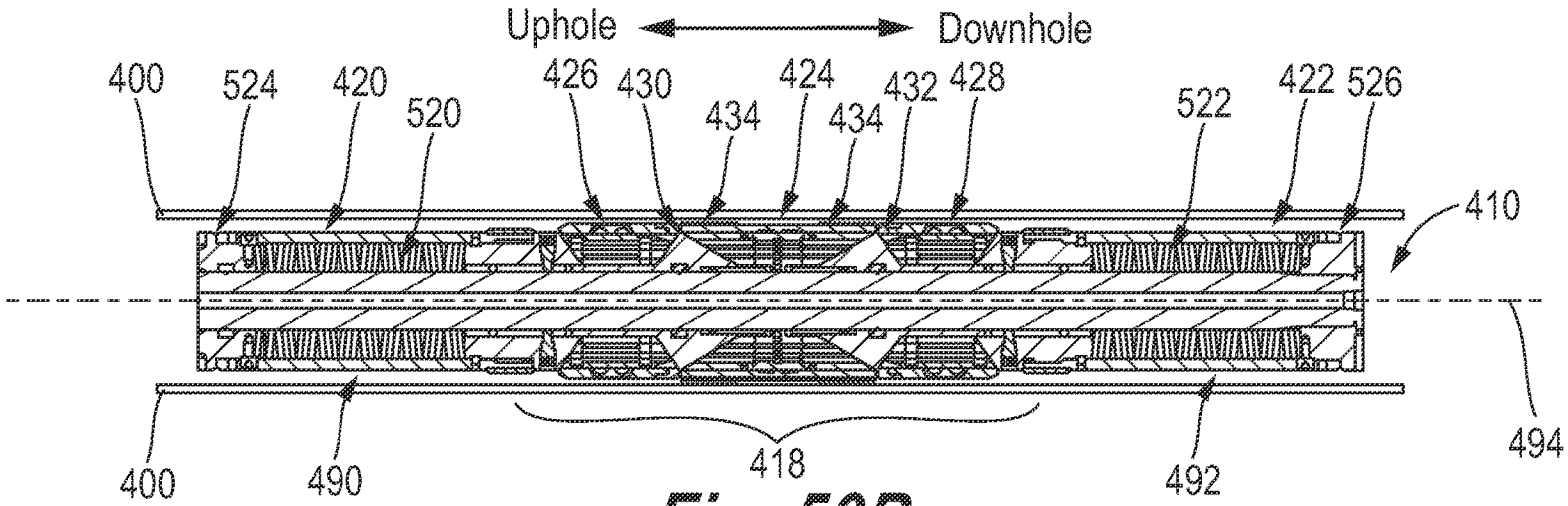

FIGS. 50A and 50B are cross-sectional cutaway views of the upper and lower seal energizing spring assemblies 420, 422 and the combined seal and anchor assembly 418 in a collapsed condition and an expanded (e.g., set) position, respectively, illustrating how the upper and lower seal energizing spring assemblies 420, 422 interact with the combined seal and anchor assembly 418. As illustrated in FIGS. 50A and 50B, in certain embodiments, the upper seal energizing spring assembly 420 includes an upper energizing spring 520 disposed within the upper spring cover sleeve 490 of the upper seal energizing spring assembly 420, and the lower seal energizing spring assembly 422 includes a lower energizing spring 522 disposed within the lower spring cover sleeve 492 of the lower seal energizing spring assembly 422.

In certain embodiments, once a setting tool has disconnected from the downhole tool 410 and differential pressure is applied to the downhole tool 410, the teeth 434 on the outer surface of the central slips cartridge 424 may bite deeper into the wellbore casing 400 and introduce a certain amount of additional free-play into the system. The energizing springs 520, 522 compensate for any backlash to maintain a minimum compression load against the seals. In conventional bridge plugs, for example, pre-compression is provided by the elastomer itself. However, the embodiments of the combined seal and anchor assembly 418 described herein have a relatively small volume of elastomer (e.g., the seal elements 436). As such, the mechanical energizing springs 520, 522 provide the pre-compression function. For example, FIG. 50A illustrates upper and lower compression gaps 524, 526 that are available in the upper and lower seal energizing spring assemblies 420, 422, respectively, and FIG. 50B illustrates these compression gaps 524, 526 closed. The energizing springs 520, 522 are relatively strong to keep the seal energized and prevent the central slips cartridge 424 from losing its grip on the wellbore casing 400. In certain embodiments, the energizing springs 520, 522 may be Belleville washer (disc) springs or wave type springs, which have a relatively high load to compression ratio.

FIGS. 51A through 51E are cross-sectional views of the downhole tool 410 to illustrate a sequence of how the downhole tool 410 may be: (1) run into a wellbore casing 400 (e.g., FIG. 51A), (2) set within the wellbore casing 400 (e.g., FIG. 51B), (3) equalized (e.g., FIG. 51C) and (4) released (e.g., FIG. 51D) within the wellbore casing 400, and then (5) retrieved out of the wellbore casing 400 (e.g., FIG. 51E). The wellbore casing 400 has been omitted from these figures to aid in the illustration of specific features of the downhole tool 410 that enable the sequence illustrated in these figures. In addition, it is noted that the downhole tool 410 has been split in two midway through the upper seal energizing spring assembly 420 to further aid in the illustration of the specific features of the downhole tool 410 that enable the sequence illustrated in these figures.

Figure 51A:
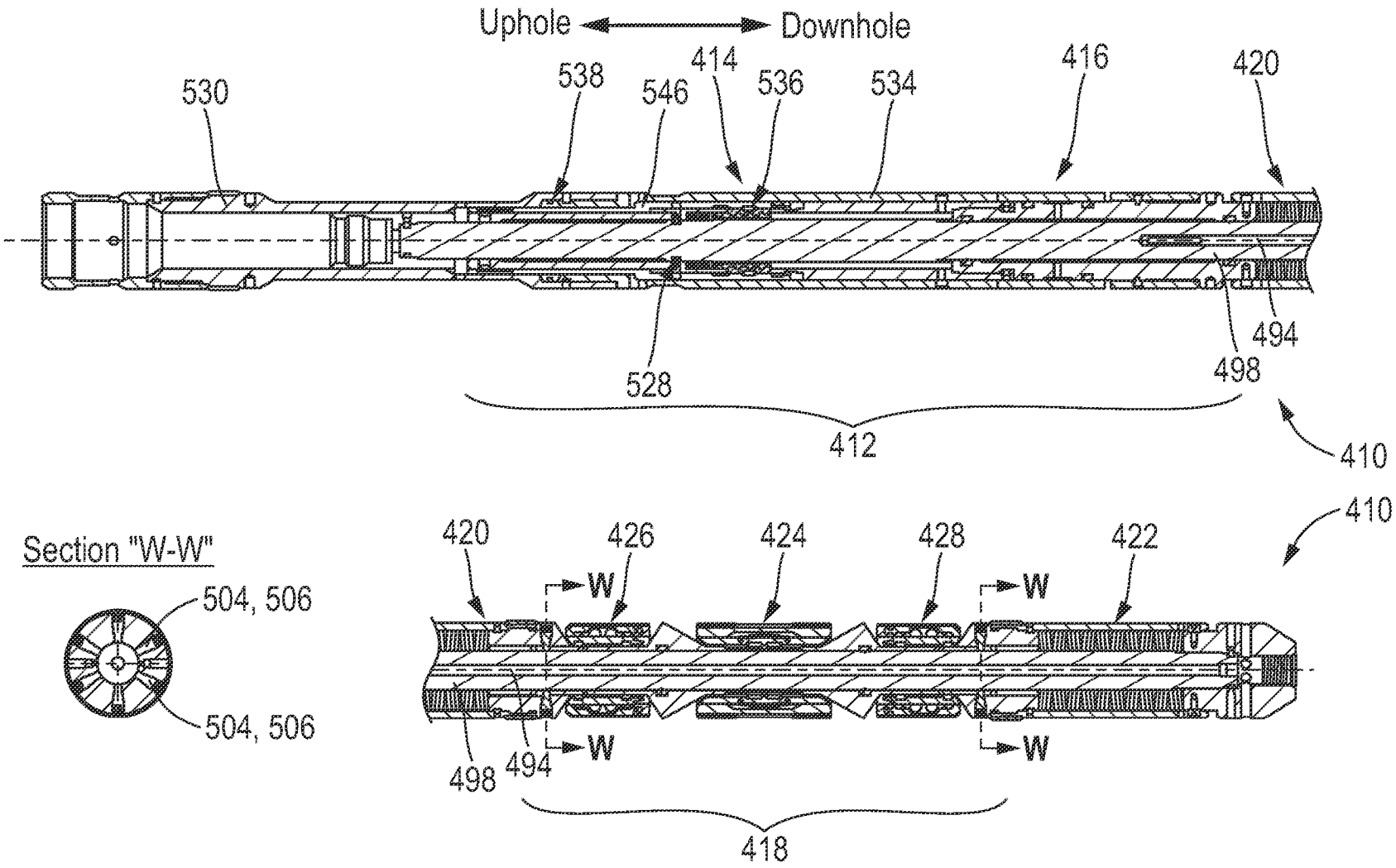
FIGS. 51A through 51E are cross-sectional views of the downhole tool to illustrate a sequence of how the downhole tool may be run into a wellbore casing, set within the wellbore casing, equalized and released within the wellbore casing, and then pulled back out of the wellbore casing, in accordance with embodiments of the present disclosure.
Figure 51B:
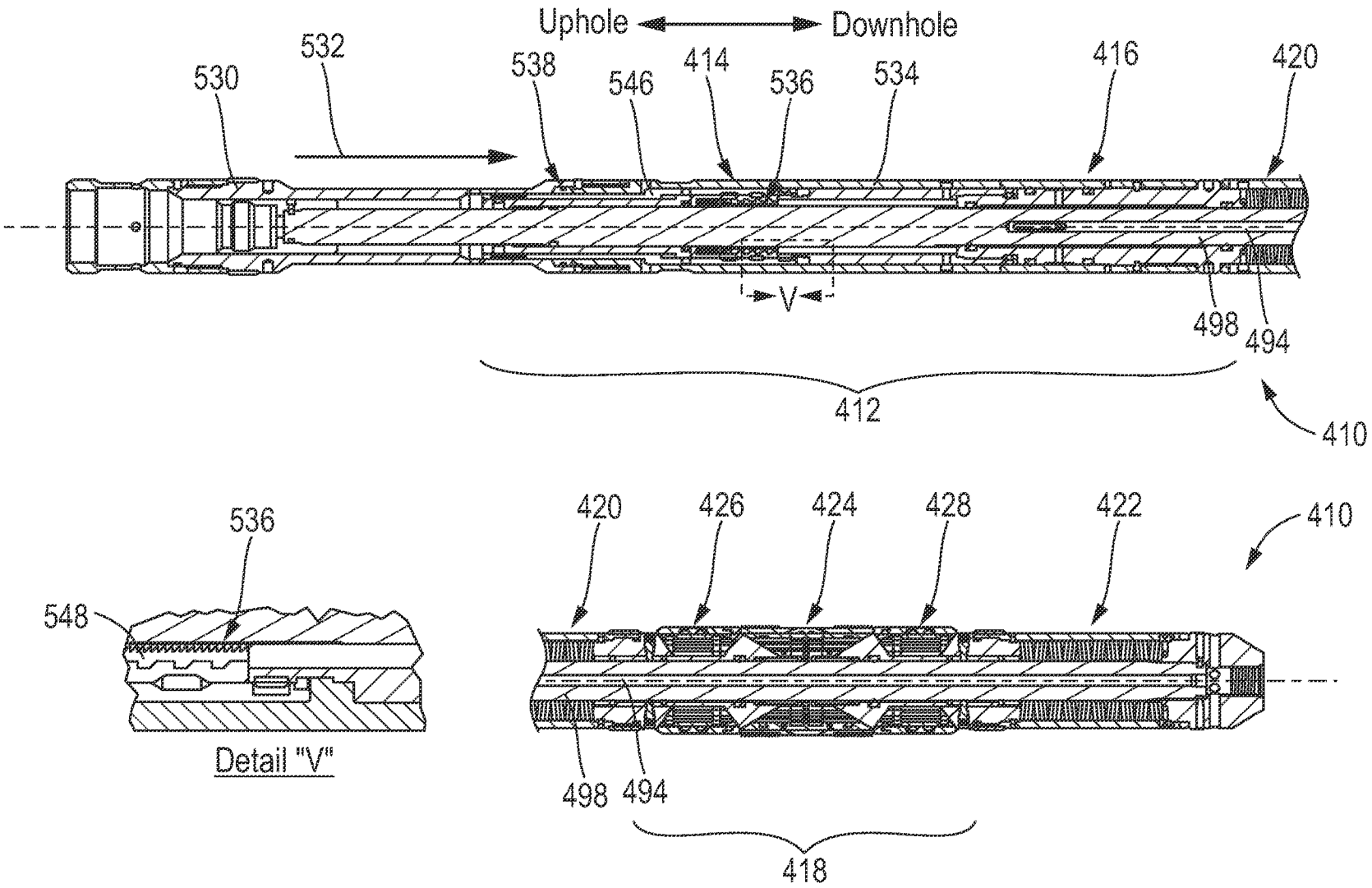
Figure 51C:
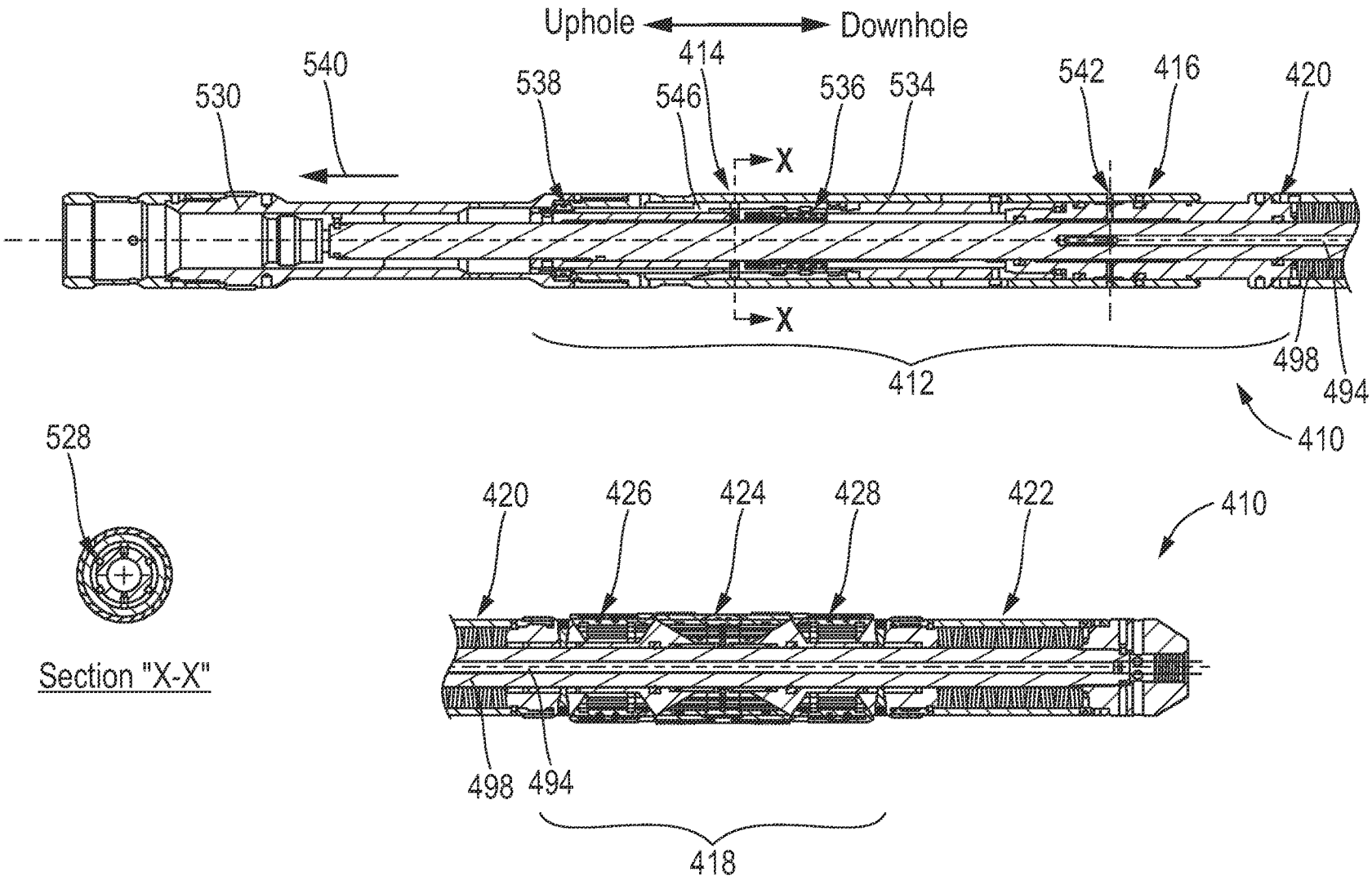
Figure 51D:
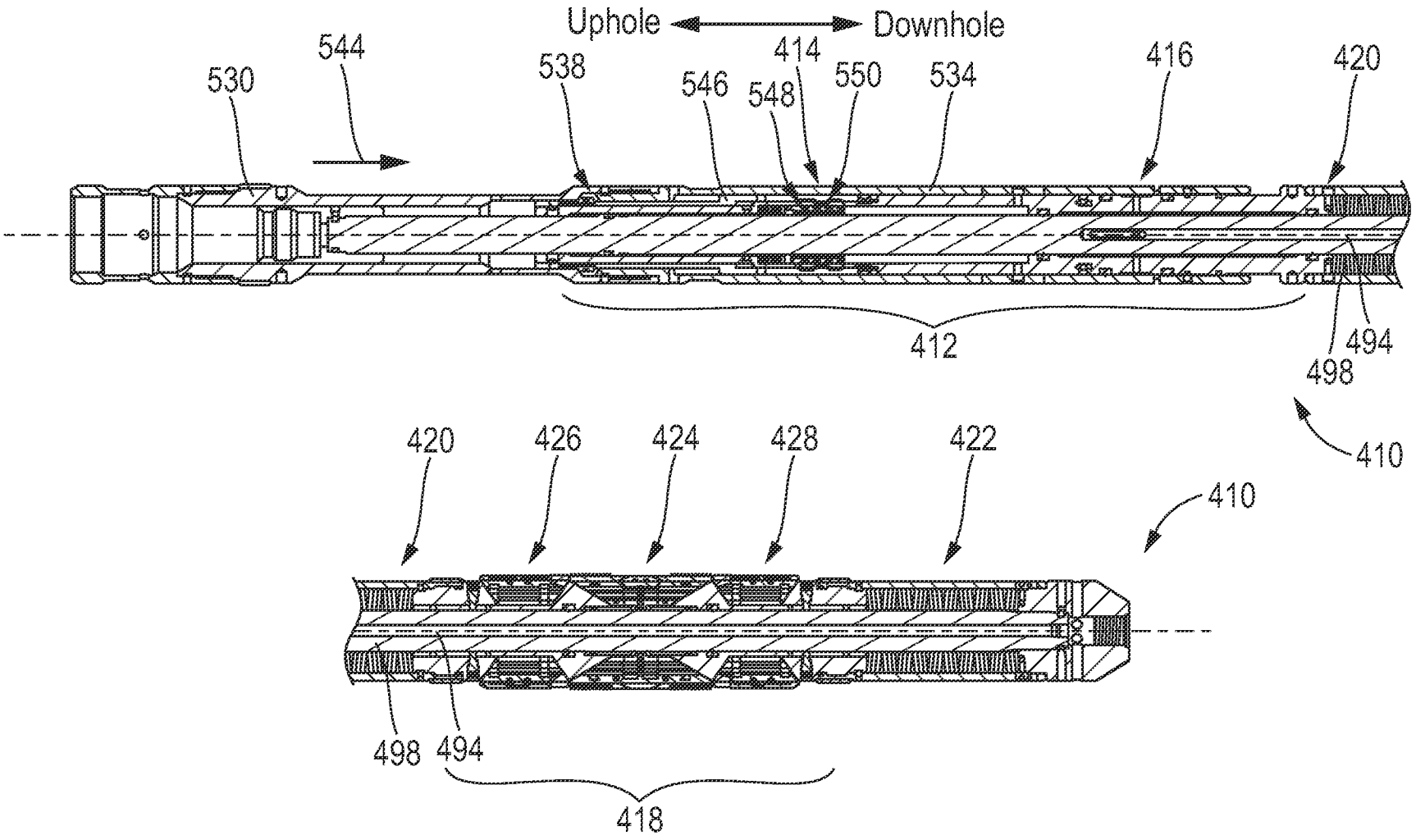
Figure 51E:
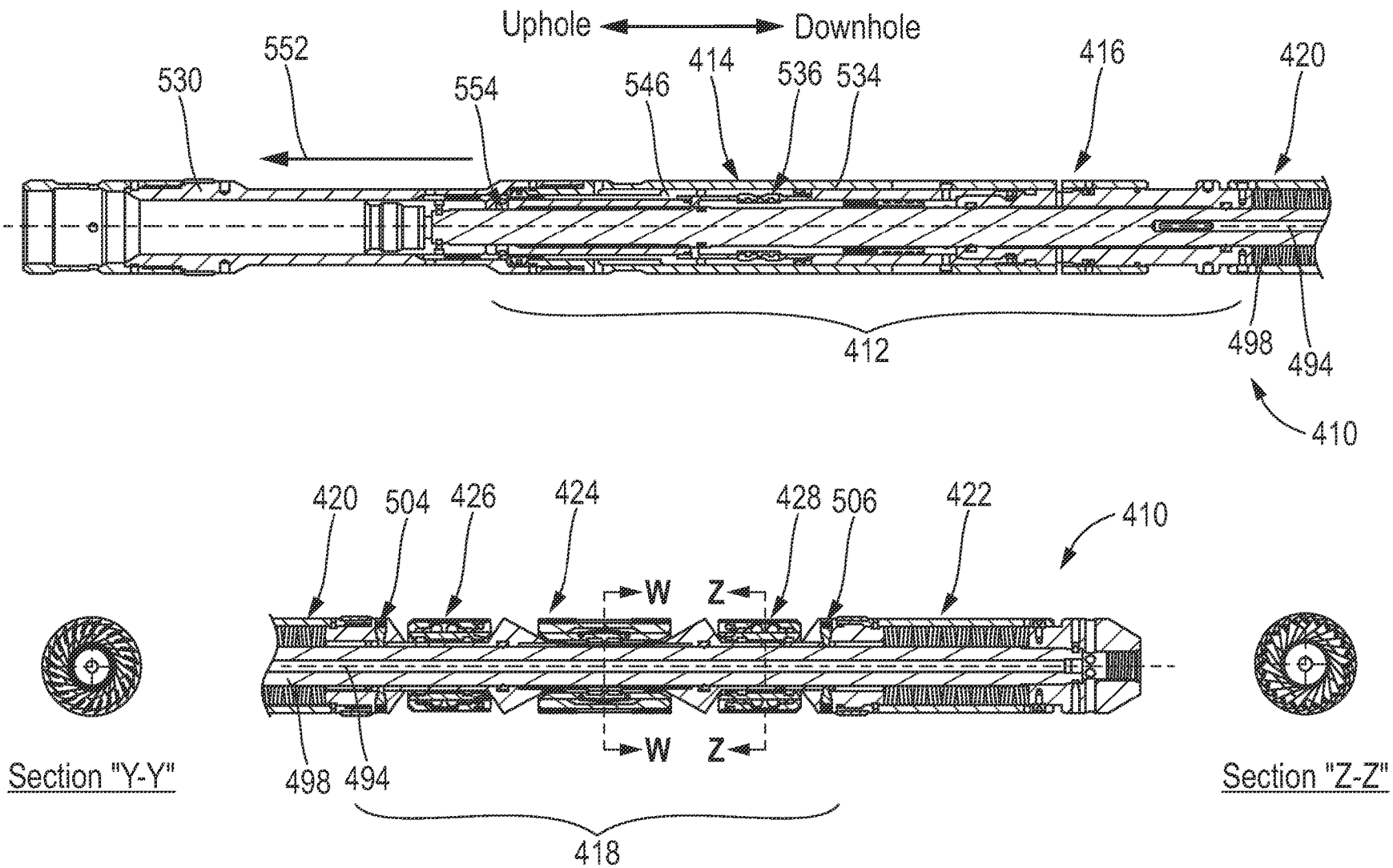

As illustrated in FIG. 51A (e.g., a run stage), the sequence begins with setting ratchet release shear screws 528 and allowing the load retention/equalization mechanism 412 to move axially relative to the inner mandrel 498. Section 'W-W' illustrates the travel limiting pins 504, 506 described above. At this point, as illustrated in FIG. 51B (e.g., a set stage), the outer fishneck 530 of the downhole tool 410 is pushed downward axially, as illustrated by arrow 532, such that an outer sleeve 534 of the load retention/equalization mechanism 412 is moved axially toward the upper seal energizing spring assembly 420 to collapse (e.g., compress) the upper seal energizing spring assembly 420, the combined seal and anchor assembly 418, and the lower seal energizing spring assembly 422 axially, as described in greater detail herein, until a ratchet 536 of the load retention mechanism 414 of the load retention/equalization mechanism 412 engages. Detail 'V' illustrates the ratchet 536 in more detail. The downhole tool 410 is now "set" as an isolation pressure barrier in the well and could be left for as long as necessary to perform its function. Upon recovery, as illustrated in FIG. 51C (e.g., an equalization stage), lock keys 538 of the load retention/equalization mechanism 412 engage, and the ratchet release shear screws 528 are primed, as illustrated in Section 'X-X'. In addition, the outer fishneck 530 is pulled back up slightly, as illustrated by arrow 540, until equalization slots 542 through the outer sleeve 534 are exposed to facilitate equalization. At this point, as illustrated in FIG. 51D (e.g., a release stage), the outer fishneck 530 is jarred back down slightly, as illustrated by arrow 544, and the lock keys 538 drive an internal ratchet release sleeve 546 downward axially, which releases ratchet keys 548 of the ratchet 536, and a detent ring 550 locates the internal ratchet release sleeve 546 relative to the outer sleeve 534 of the load retention/equalization mechanism 412. Later, as illustrated in FIG. 51E (e.g., a pull stage), the outer fishneck 530 is pulled back up axially, as illustrated by arrow 552, and a snap ring 554 locates the outer fishneck 530 relative to the inner mandrel 498. Tension is applied by the travel limiting pins 504, 506 and the central collet 496 to collapse the central slips cartridge 424 and the seal cartridges 426, 428. The snap ring 554 prevents the inner mandrel 498 from moving relative to the outer housing, thus preventing the downhole tool 410 from re-setting. Sections 'Y-Y' and 'Z-Z' illustrate the central slips cartridge 424 and the lower seal cartridge 428, respectively, in greater detail.

Figure 52A:
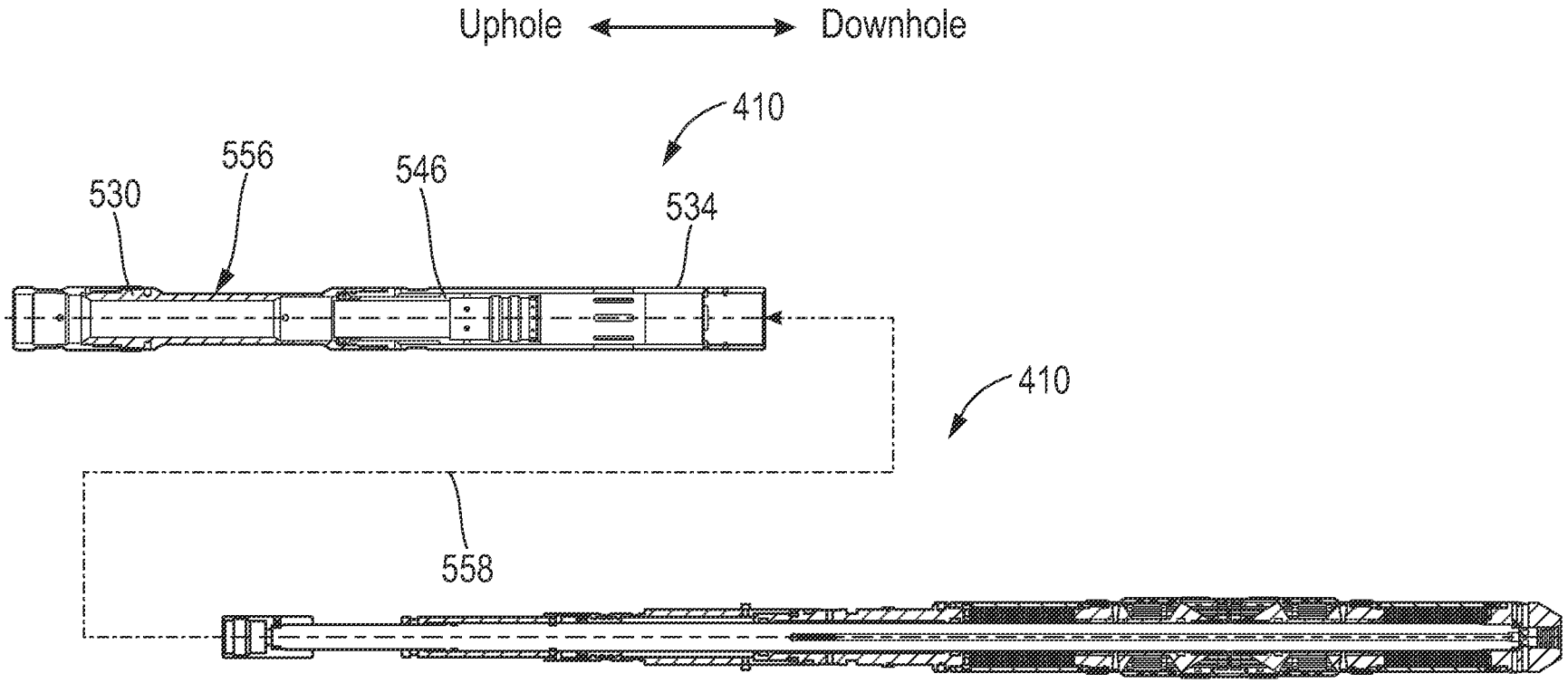
FIGS. 52A and 52B illustrate features of the downhole tool that facilitate a contingency recovery method, in accordance with embodiments of the present disclosure.
Figure 52B:
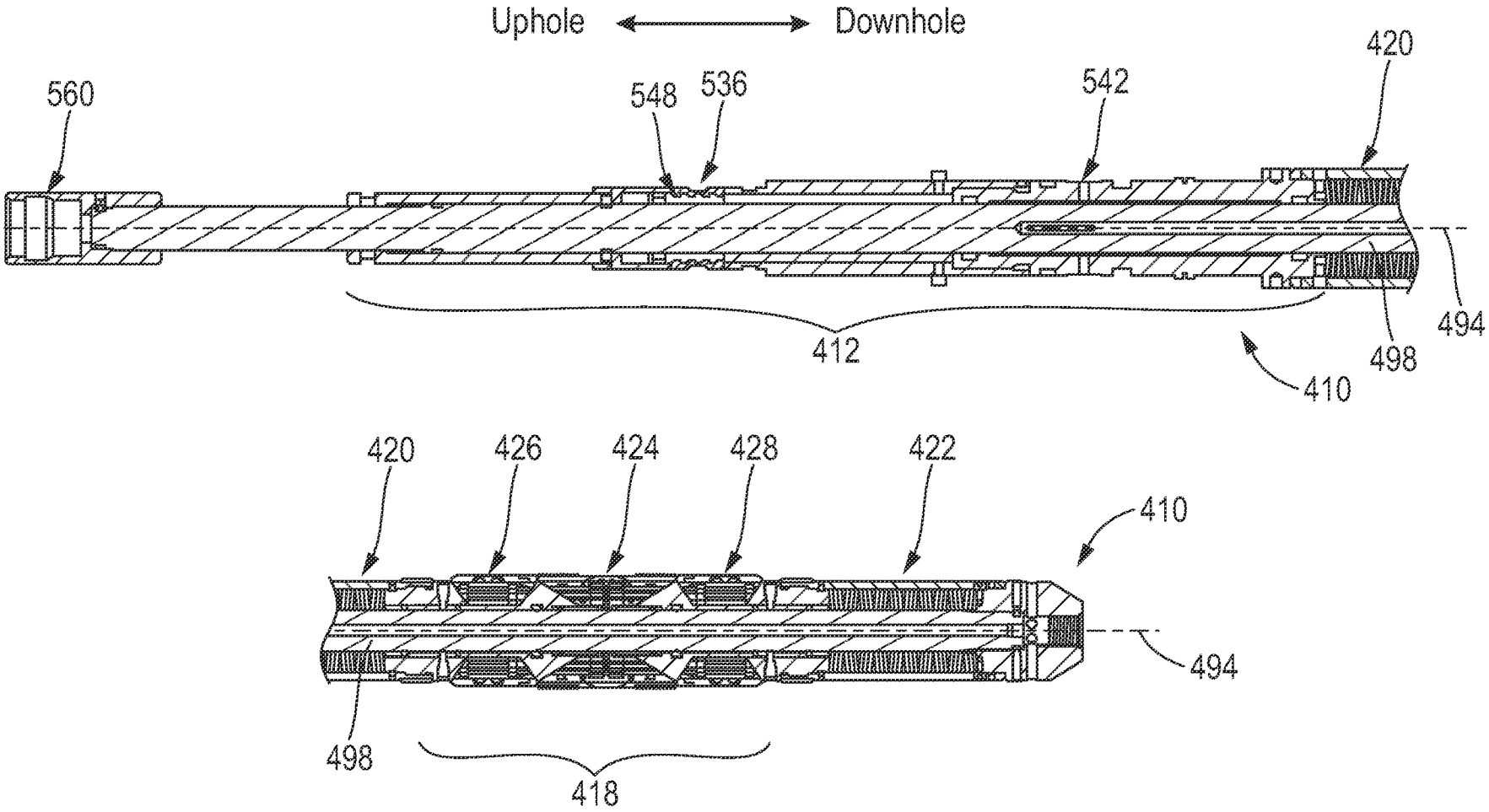

In addition to the pull stage illustrated in FIG. 51E, in certain embodiments, a contingency recovery method may be employed. FIGS. 52A and 52B illustrate features of the downhole tool 410 that facilitate such contingency recovery method. In particular, FIG. 52A illustrates how an outer shell 556 (e.g., including the outer fishneck 530, the outer sleeve 534, and the internal ratchet release sleeve 546) of the downhole tool 410 may first be removed from the rest of the downhole tool 410, as illustrated by arrow 558, and recovered to the surface. Then, as illustrated in FIG. 52B, an upper axial end 560 of the inner mandrel 498 may be latched (e.g., using a special pulling tool or overshot) to drive the inner mandrel 498 axially downward, as illustrated by arrow 562, to release the ratchet 536 and again collapse (e.g., compress) the downhole tool 410, at which point the ratchet keys 548 of the ratchet 536 are free to be ejected, and the equalization slots 542 are exposed, thereby facilitating recovery of the downhole tool 410.

The embodiments of the combined seal and anchor assembly 418 described herein with reference to FIGS. 40 through 52B are exemplary of the types of components that enable the functionality of the combined seal and anchor assembly 418. However, in certain embodiments, the combined seal and anchor assembly 418 may include certain alternate designs. For example, in certain embodiments, instead of using upper and lower seal cartridges 426, 428 disposed on opposite axial sides of the central slips cartridge 424, the central slips cartridge 424 may be used by itself. As such, the number of expanding and collapsing components may be reduced from three to one.

Figure 53B:
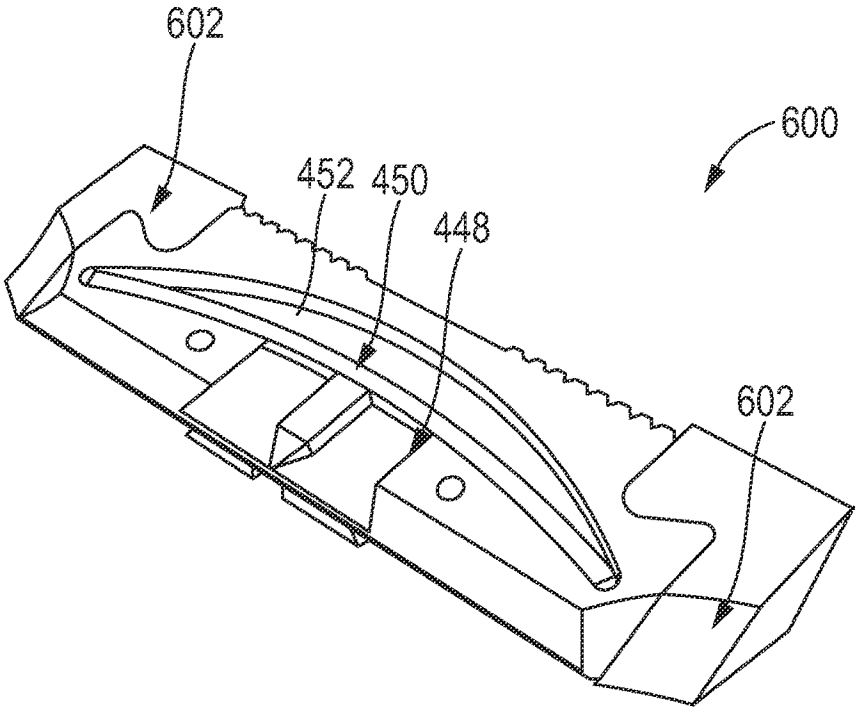
FIGS. 53A and 53B are top and bottom perspective views, respectively, of slip elements, which may include seal elements disposed on opposite axial ends of the slip elements, in accordance with embodiments of the present disclosure.
Figure 53A:
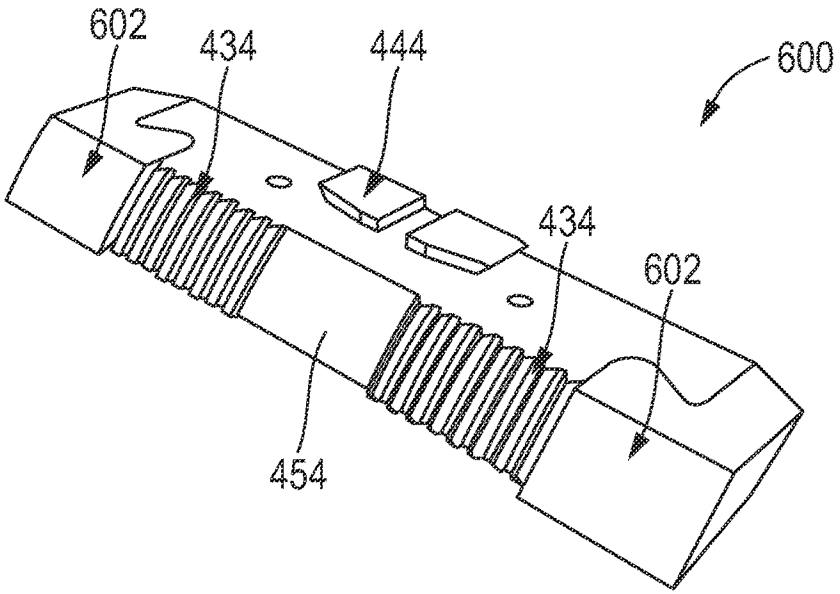

In such, embodiments, the slip elements 438 of the central slips cartridge 424 may be replaced with slip elements 600 that are associated with seal elements 602 that are substantially similar to the seal elements 436 associated with the seal body elements 456 described above. FIGS. 53A and 53B are top and bottom perspective views, respectively, of slip elements 600, which may include seal elements 602 disposed on opposite axial ends of the slip elements 600. In certain embodiments, the slip elements 600 may have mounting features (e.g., seal element mounting mechanisms 470 and separate tabs 476) substantially similar to those of the seal body elements 456 described above and illustrated most clearly in FIGS. 45A and 45B at the opposite axial ends of the slip elements 600, which enable the seal elements 602 to be mounted onto the slip elements 600.

Figure 54B:
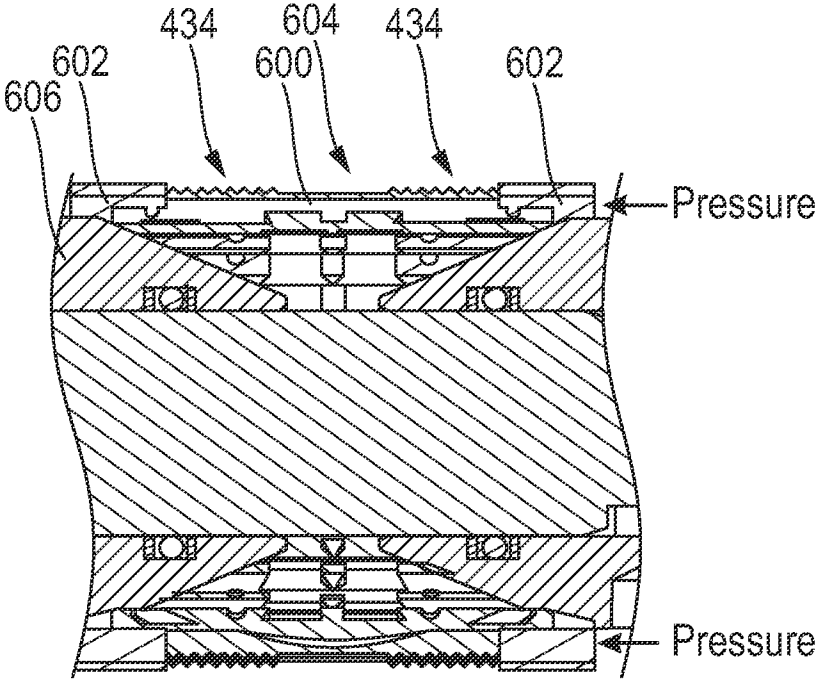
FIGS. 54A and 54B are cross-sectional cutaway views of a portion of two embodiments of a combined seal and anchor assembly, which compare and contrast the embodiments of the central slips cartridge described herein (e.g., FIG. 54A) and a hybrid slips/seal cartridge that is not associated with upper and lower seal cartridges (e.g., FIG. 54B), in accordance with embodiments of the present disclosure.
Figure 54A:
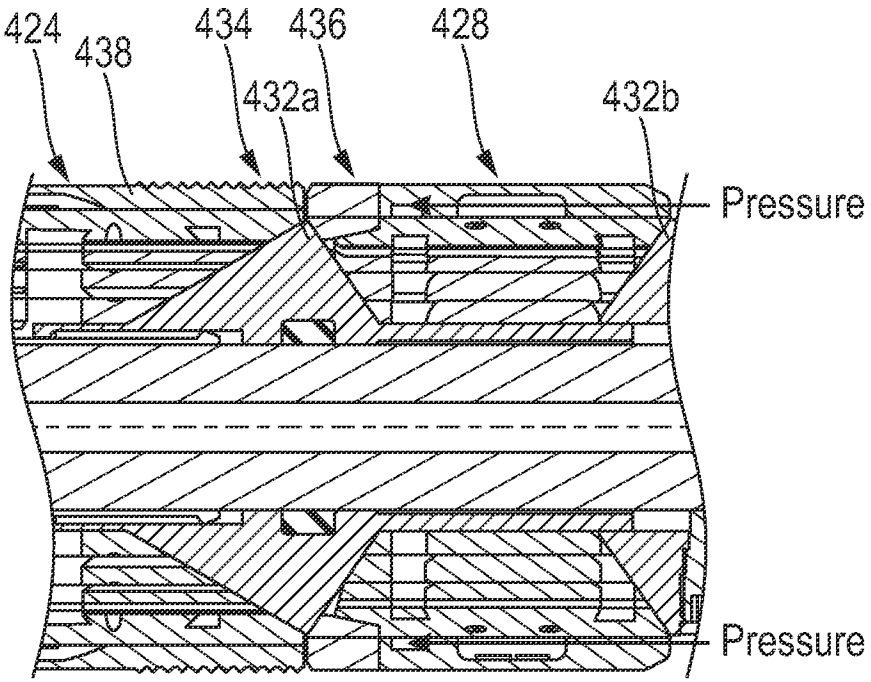

FIGS. 54A and 54B are cross-sectional cutaway views of a portion of two embodiments of a combined seal and anchor assembly 418, which compare and contrast the embodiments of the central slips cartridge 424 described above (e.g., FIG. 54A) and a hybrid slips/seal cartridge 604 that is not associated with upper and lower seal cartridges 426, 428 (e.g., FIG. 54B). As illustrated in FIG. 54B, instead of interacting with two cone assemblies (e.g., support cone assembly 432, as illustrated in FIG. 54A) that each include two separate support cones (e.g., support cones 432*a*, 432*b*, as illustrated in FIG. 54A), the hybrid slips/seal cartridge 604 may simply interact with upper and lower support cones 606, 608 that are disposed on opposite axial ends of the hybrid slips/seal cartridge 604.

In the embodiment illustrated in FIG. 54B, the hybrid slips/seal cartridge 604 would also provide plug anchoring and seal extrusion barrier functions, similar to the central slips cartridge 424 and its associated upper and lower seal cartridges 426, 428. However, the ring of seal elements 602 of the hybrid slips/seal cartridge 604 is intended to seal down the supporting cone ramp provided by the upper and lower support cones 606, 608, as opposed to the upwards direction with respect to the central slips cartridge 424 and its associated upper and lower seal cartridges 426, 428. In addition, in such an embodiment, one side of the seal is open ended when compared with the central slips cartridge 424 and its associated upper and lower seal cartridges 426, 428.

The expansion apparatus described herein may be applied to a high expansion packer or plug and, in particular, to a high expansion retrievable bridge plug. The ring structure may be arranged to provide a high-expansion anti-extrusion ring for a seal element of a retrievable bridge plug. Alternatively, or in addition to, elements of ring structures of the apparatus may be provided with engaging means to provide anchoring forces that resist movement in upward and/or downward directions. The elements of the rings structure may therefore function as slips, and may in some cases function as an integrated slip and anti-extrusion ring. Advantages over previously proposed plugs include the provision of a highly effective anti-extrusion ring; providing an integrated slip and anti-extrusion assembly, which reduces the axial length of the tool; providing slips with engaging surfaces that extend around the entire circumference of the tool to create an enlarged anchoring surface, which reduces indentation depth damage to the casing and enables a reduction in the axial length of the slips for the same anchoring force; the ability of slips of a ring structure of one particular size to function effectively over a wider range of tubular inner diameters and tubing weights/wall thicknesses. Alternatively, or in addition to, the apparatus may be used to anchor any of a wide range of tools in a wellbore, by providing the surfaces of the element with engaging means to provide anchoring forces that resist movement in upward and/or downward directions.

Variations to embodiments described herein may include the provision of functional formations on the basic elements in various arrangements. These may include knurls and sockets for location and support, hooks, balls and sockets or knuckles and sockets for axial connection, and/or pegs and recesses to prevent relative rotation of the elements with respect to one another and/or with respect to the underlying structure of the apparatus.

The embodiments described herein also have benefits in creating a seal and/or filling an annular space, and an additional example application is to downhole locking tools. A typical locking tool uses one or more radially expanding components deployed on a running tool. The radially expanding components engage with a pre-formed locking profile at a known location in the wellbore completion. A typical locking profile and locking mechanism includes a recess for mechanical engagement by the radially expanding components of the locking tool. A seal bore is typically provided in the profile, and a seal on the locking tool is designed to seal against the seal bore.

In addition, in certain embodiments, each of the ring structures provides a smooth, unbroken circumferential surface, which may engage a locking recess, providing upper and lower annular surfaces in a plane perpendicular to the longitudinal axis of the bore. This annular surface may be relatively smooth and unbroken around the circumference of the ring structures and, therefore, the lock is in full abutment with upper and lower shoulders defined in the locking profile. This is in contrast with conventional locking mechanisms that may only have contact with a locking profile at a number of discrete, circumferentially-separated locations around the device. The increased surface contact can support larger axial forces being directed through the lock. Alternatively, in other embodiments, an equivalent axial support may be provided in a lock, which has reduced size and/or mass.

Another advantage of the embodiments described herein is that a seal bore (i.e., the part of the completion with which the elastomer creates a seal) may be recessed in the locking profile. The benefit of such configuration is that the seal bore is protected from the passage of tools and equipment through the locking profile. This avoids impact with the seal bore that would tend to damage the seal bore, reducing the likelihood of reliably creating a successful seal.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The invention claimed is:

1. A downhole tool, comprising:

a combined seal and anchor assembly configured to anchor the downhole tool against a wellbore casing within which the downhole tool is disposed, and to provide a radial seal between the downhole tool and the wellbore casing only in compression, the combined seal and anchor assembly comprising:

a central slips cartridge comprising a plurality of slip elements disposed in a central ring structure and configured to move radially outward and slide circumferentially relative to each other to form a relatively constant outer diameter to enable the central slips cartridge to anchor the downhole tool against the wellbore casing;

a first seal cartridge disposed on a first axial side of the central slips cartridge, wherein the first seal cartridge comprises a first plurality of seal body elements disposed in a first ring structure and configured to move radially outward and slide circumferentially relative to each other to form the relatively constant outer diameter, wherein each seal body element of the first plurality of seal body elements has a seal element mounted to a first axial end of the seal body element, and wherein each respective seal element is configured to provide the radial seal between the downhole tool and the wellbore casing only in compression, and to provide a first axial seal between the respective seal body element and the central slips cartridge; and a second seal cartridge disposed on a second axial side of the central slips cartridge opposite the first axial side, wherein the second seal cartridge comprises a second plurality of seal body elements disposed in a second ring structure and configured to move radially outward and slide circumferentially relative to each other to form the relatively constant outer diameter, wherein each seal body element of the second plurality of seal body elements has a seal element mounted to a first axial end of the seal body element, and wherein each respective seal element is configured to provide the radial seal between the downhole tool and the wellbore casing only in compression, and to provide a second axial seal between the respective seal body element and the central slips cartridge.

2. The downhole tool of claim 1, wherein each slip element of the plurality of slip elements comprises a first set of teeth disposed on an outer surface of the slip element near a first axial end of the slip element, and a second set of teeth disposed on the outer surface of the slip element near a second axial end of the slip element opposite the first axial end, wherein the first and second sets of teeth are axially separated on the outer surface of the slip element by a smooth portion of the outer surface of the slip element, and wherein the first and second sets of teeth enable the central slips cartridge to anchor the downhole tool against the wellbore casing.

3. The downhole tool of claim 1, wherein each slip element of the plurality of slip elements comprises one or more dovetail projections disposed on a first surface of the slip element, and one or more dovetail recesses disposed on a second surface of the slip element opposite the first surface, wherein the one or more dovetail projections and the one or more dovetail recesses of adjacent slip elements are configured to interact with each other to ensure that the slip elements remain axially aligned while the slip elements slide circumferentially relative to each other.

4. The downhole tool of claim 1, wherein each slip element of the plurality of slip elements comprises one or more return bias springs disposed within one or more respective spring mounting cavities internal to the slip element body, wherein the one or more return bias springs are configured to act opposite to circumferential movement of adjacent slip elements to provide a return bias force.

5. The downhole tool of claim 1, wherein each seal body element of the first and second pluralities of seal body elements comprises one or more dovetail projections disposed on a first surface of the seal body element, and one or more dovetail recesses disposed on a second surface of the seal body element opposite the first surface, wherein the one or more dovetail projections and the one or more dovetail recesses of adjacent seal body elements are configured to interact with each other to ensure that the seal body elements remain axially aligned while the seal body elements slide circumferentially relative to each other.

6. The downhole tool of claim 1, wherein each seal body element of the first and second pluralities of seal body elements comprises one or more return bias springs disposed within one or more respective spring mounting cavities internal to the seal body element, wherein the one or more return bias springs are configured to act opposite to circumferential movement of adjacent seal body elements to provide a return bias force.

7. The downhole tool of claim 1, wherein each seal body element of the first and second pluralities of seal body elements comprises one or more seal element mounting mechanisms disposed at the first axial end of the seal body element and configured to hold a respective seal element in place relative to the seal body element.

8. The downhole tool of claim 1, wherein each seal body element of the first and second pluralities of seal body elements comprises one or more anti-rotation tabs extending from the first axial end of the seal body element and configured to prevent rotation of the respective seal element relative to the seal body element.

9. The downhole tool of claim 1, wherein the combined seal and anchor assembly comprises a first support cone assembly comprising:

a first support cone having a first tapered surface configured to contact the plurality of slip elements of the central slips cartridge, and a second tapered surface configured to contact the first plurality of seal body elements of the first seal cartridge at the first axial ends of the seal body elements; and a second support cone having a third tapered surface configured to contact the first plurality of seal body elements of the first seal cartridge at second axial ends of the seal body elements opposite the first axial ends;

wherein the first support cone is attached to a first telescoping neck that extends axially from the first support cone and radially between the second support cone and an inner mandrel of the downhole tool.

10. The downhole tool of claim 9, wherein the combined seal and anchor assembly comprises a second support cone assembly comprising:

a third support cone having a fourth tapered surface configured to contact the plurality of slip elements of the central slips cartridge, and a fifth tapered surface configured to contact the second plurality of seal body elements of the second seal cartridge at the first axial ends of the seal body elements; and a fourth support cone having a sixth tapered surface configured to contact the second plurality of seal body elements of the second seal cartridge at second axial ends of the seal body elements opposite the first axial ends;

wherein the third support cone is attached to a second telescoping neck that extends axially from the third support cone and radially between the fourth support cone and the inner mandrel of the downhole tool.

11. The downhole tool of claim 10, wherein the first and second support cone assemblies are each configured to move axially toward the central slips cartridge to:

wedge the first and third support cones under the plurality of slip elements of the central slips cartridge and under the first and second pluralities of seal body elements of the first and second seal cartridges to cause each of the plurality of slip elements, the first pluralities of seal body elements, and the second plurality of seal body elements to move radially outward and slide circumferentially relative to the others in the respective pluralities; and wedge the second and fourth support cones under the first and second pluralities of seal body elements of the first and second seal cartridges to cause each of the first pluralities of seal body elements and the second plurality of seal body elements to move radially outward and slide circumferentially relative to the others in the respective pluralities.

12. The downhole tool of claim 10, wherein the combined seal and anchor assembly comprises a central collet disposed radially about the inner mandrel, wherein the central collet comprises prongs configured to move within travel limiting recesses formed between the inner mandrel and inner diameters of the first and third support cones to limit axial travel of the first and third support cones relative to the inner mandrel and relative to the central slips cartridge.

13. The downhole tool of claim 10, wherein the combined seal and anchor assembly comprises travel limiting pins that extend radially though the second and fourth support cones and are configured to move within travel limiting slots through respective telescoping necks to limit axial travel of the second and fourth support cones relative to the respective telescoping necks and relative to the respective first and third support cones.

14. The downhole tool of claim 10, wherein the combined seal and anchor assembly comprises o-rings disposed between the first and third support cones and the inner mandrel to provide a pressure seal to the inner mandrel.

15. The downhole tool of claim 1, comprising first and second seal energizing spring assemblies disposed on opposite axial ends of the combined seal and anchor assembly and configured to maintain a minimum compression load against the seals provided by the combined seal and anchor assembly.

16. A downhole tool, comprising:

a combined seal and anchor assembly configured to anchor the downhole tool against a wellbore casing within which the downhole tool is disposed, and to provide a seal between the downhole tool and the wellbore casing only in compression, the combined seal and anchor assembly comprising:

a hybrid slips or a seal cartridge comprising a plurality of slip elements disposed in a ring structure and configured to move radially outward and slide circumferentially relative to each other to form a relatively constant outer diameter to enable the hybrid slips or the seal cartridge to anchor the downhole tool against the wellbore casing, wherein each slip element of the plurality of slip elements has a first seal element mounted to a first axial end of the slip element and a second seal element mounted to a second axial end of the slip element opposite the first axial end, and wherein the first and second seal elements are configured to provide the seal between the downhole tool and the wellbore casing only in compression;

a first support cone having a first tapered surface configured to contact the first seal elements of the hybrid slips or the seal cartridge; and a second support cone having a second tapered surface configured to contact the second seal elements of the hybrid slips or the seal cartridge; and first and second seal energizing spring assemblies disposed on opposite axial ends of the combined seal and anchor assembly and configured to maintain a minimum compression load against the seals provided by the combined seal and anchor assembly.

17. The downhole tool of claim 16, wherein each slip element of the plurality of slip elements comprises a first set of teeth disposed on an outer surface of the slip element near the first axial end of the slip element, and a second set of teeth disposed on the outer surface of the slip element near the second axial end of the slip element opposite the first axial end, wherein the first and second sets of teeth are axially separated on the outer surface of the slip element by a smooth portion of the outer surface of the slip element, and wherein the first and second sets of teeth enable the hybrid slips/seal cartridge to anchor the downhole tool against the wellbore casing.

18. The downhole tool of claim 16, wherein each slip element of the plurality of slip elements comprises one or more dovetail projections disposed on a first surface of the slip element, and one or more dovetail recesses disposed on a second surface of the slip element opposite the first surface, wherein the one or more dovetail projections and the one or more dovetail recesses of adjacent slip elements are configured to interact with each other to ensure that the slip elements remain axially aligned while the slip elements slide circumferentially relative to each other.

19. The downhole tool of claim 16, wherein each slip element of the plurality of slip elements comprises one or more return bias springs disposed within one or more respective spring mounting cavities internal to the slip element body, wherein the one or more return bias springs are configured to act opposite to circumferential movement of adjacent slip elements to provide a return bias force.

20. The downhole tool of claim 16, wherein each slip element of the plurality of slip elements comprises seal element mounting mechanisms disposed at the first and second axial ends of the slip element and configured to hold a respective seal element in place relative to the slip element.

* * * * *